US012384601B2

(12) United States Patent
Ahn

(10) Patent No.: US 12,384,601 B2
(45) Date of Patent: Aug. 12, 2025

(54) CONTAINER CAP AND CONTAINER COMBINED WITH SAME

(71) Applicant: Jin Hee Ahn, Yongin-si (KR)

(72) Inventor: Jin Hee Ahn, Yongin-si (KR)

( * ) Notice: Subject to any disclaimer, the term of this patent is extended or adjusted under 35 U.S.C. 154(b) by 0 days.

(21) Appl. No.: 17/627,514

(22) PCT Filed: Jul. 16, 2020

(86) PCT No.: PCT/KR2020/009405

§ 371 (c)(1),
(2) Date: Jan. 14, 2022

(87) PCT Pub. No.: WO2021/010779

PCT Pub. Date: Jan. 21, 2021

(65) Prior Publication Data

US 2022/0281648 A1 Sep. 8, 2022

(30) Foreign Application Priority Data

Jul. 16, 2019 (KR) ..... 10-2019-0087162
Oct. 17, 2019 (KR) ..... 10-2019-0129355

(51) Int. Cl.
*B65D 41/04* (2006.01)

(52) U.S. Cl.
CPC ..... *B65D 41/0428* (2013.01); *B65D 41/0414* (2013.01); *B65D 2251/20* (2013.01)

(58) Field of Classification Search
CPC ..... B65D 41/0428; B65D 41/0414; B65D 41/0421; B65D 41/3442; B65D 41/0407; B65D 41/0485; B65D 43/0225; B65D 23/00; B65D 51/18; B65D 53/02; B65D 2251/20
USPC ..... 215/316, 253, 254, 256, 270–271, 215/329–331, 343; 220/86.1; 206/219, 206/432, 497; 222/147
See application file for complete search history.

(56) References Cited

U.S. PATENT DOCUMENTS 2,818,204 A * 12/1957 Henchert ..... B65D 47/123 215/DIG. 1
3,001,658 A * 9/1961 Herter ..... B65D 53/04 215/45
3,074,579 A * 1/1963 Miller ..... B65D 41/0421 215/354

(Continued)

FOREIGN PATENT DOCUMENTS

CN 101600626 A 12/2009
DE 810349 C 8/1951

(Continued)

OTHER PUBLICATIONS

Extended European Search Report dated Jul. 12, 2023, in the counterpart European patent application No. EP20841180.1.

*Primary Examiner* — Orlando E Aviles
*Assistant Examiner* — Brijesh V. Patel
(74) *Attorney, Agent, or Firm* — RABIN & BERDO, P.C.

(57) ABSTRACT

A container cap which is combined with a container containing a beverage or the like, and a container combined with the container cap. The container cap is combined with a container inlet of a container body. A plurality of close contact portions in contact with the container inlet are formed, and the close contact portions form a closed curve enclosing the container inlet so as to block inflow of external air from the outside into the container body.

2 Claims, 55 Drawing Sheets

(56) References Cited

U.S. PATENT DOCUMENTS 3,335,774 A * 8/1967 Reed ..... B65D 43/0208 220/790
3,428,208 A * 2/1969 Kosar ..... B65D 41/0428 215/44
3,441,161 A * 4/1969 Van Baarn ..... B65D 41/0421 D9/446
3,474,884 A * 10/1969 Braun ..... F16N 19/003 184/6.4
3,482,725 A * 12/1969 Exton ..... B65D 41/0428 215/354
3,494,496 A * 2/1970 Livingstone ..... B65D 41/185 215/DIG. 1
3,532,244 A * 10/1970 Yates, Jr. ..... B65D 45/322 220/792
3,568,871 A * 3/1971 Livingstone ..... B65D 41/185 215/354
3,595,418 A * 7/1971 Adcock ..... B65D 41/0428 215/354
3,596,694 A * 8/1971 Jaeniche ..... B65D 39/04 215/45
3,707,240 A * 12/1972 Wilson ..... B65D 41/485 215/901
3,747,792 A * 7/1973 Anthony ..... B65D 41/0428 215/DIG. 1
3,770,156 A * 11/1973 Yates, Jr. ..... B65D 43/0256 215/DIG. 1
3,815,771 A * 6/1974 Marks ..... B65D 41/0428 215/344
3,830,395 A * 8/1974 Crisci ..... B65D 43/0227 215/329
3,833,141 A * 9/1974 Leitz ..... B65D 41/0428 215/354
3,844,439 A * 10/1974 Demers ..... B65D 41/0428 215/344
3,881,627 A * 5/1975 Davolt ..... B65D 41/0421 215/344
3,900,122 A * 8/1975 Dichter ..... B65D 39/04 215/355
3,944,104 A * 3/1976 Watson ..... B65D 41/0421 215/354
4,089,463 A * 5/1978 Babiol ..... B65D 41/0428 215/DIG. 1
4,322,012 A * 3/1982 Conti ..... B65D 41/3442 215/DIG. 1
4,418,833 A * 12/1983 Landis ..... B65D 43/0212 220/792
4,444,332 A * 4/1984 Widen ..... B65D 43/0212 220/792
4,489,845 A * 12/1984 Aichinger ..... B65D 41/0421 215/DIG. 1
4,560,077 A * 12/1985 Dutt ..... B65D 41/0421 215/DIG. 1
4,564,112 A * 1/1986 Breuer ..... B29C 45/4407 215/246
4,711,365 A * 12/1987 Fomby ..... B65D 41/0428 215/DIG. 1
5,297,688 A * 3/1994 Beck ..... B65D 41/0421 215/354
5,549,213 A * 8/1996 Robbins, III ..... B65D 43/0212 215/354
5,630,522 A * 5/1997 Montgomery ..... B65D 41/0421 215/354
5,725,115 A * 3/1998 Bosl ..... B65D 41/3428 215/258
5,762,218 A * 6/1998 Sachau ..... B65D 41/0414 215/354
5,954,215 A * 9/1999 Alter ..... B65D 41/185 215/354
6,021,912 A * 2/2000 Hertrampf ..... B65D 41/0421 215/270
6,283,318 B1 * 9/2001 Lee ..... B65D 41/485 215/354
6,619,498 B2 * 9/2003 von Holdt, Jr. .... B65D 43/0256 220/792
6,679,395 B1 * 1/2004 Pfefferkorn ..... B65D 41/0421 215/DIG. 1
6,889,857 B2 * 5/2005 Francois ..... B65D 41/0421 215/232
7,086,551 B2 * 8/2006 von Holdt, Jr. .... B65D 43/0256 220/276
7,575,121 B2 * 8/2009 Ooka ..... B65D 41/325 215/344
7,922,017 B2 * 4/2011 Shingle ..... B65D 50/045 215/DIG. 1
8,066,133 B2 * 11/2011 Takamatsu ..... B65D 41/0421 215/307
8,083,094 B2 * 12/2011 Caulfield ..... B65D 43/162 220/780
8,393,483 B2 * 3/2013 Druitt ..... B65D 41/04 215/344
9,199,769 B2 * 12/2015 Wood ..... B65D 41/0421
10,246,227 B2 * 4/2019 Wada ..... B65D 43/162
2002/0162846 A1 * 11/2002 Mercier ..... B65D 43/0212 220/795
2003/0026508 A1 2/2003 Smith
2006/0138071 A1 * 6/2006 Tsutsumi ..... B65D 41/0421 215/354
2006/0151423 A1 * 7/2006 Seidita ..... B65D 41/325 215/341
2006/0255003 A1 11/2006 Fuchs
2019/0023463 A1 1/2019 Knight
2021/0086954 A1 * 3/2021 Suzuki ..... B65D 41/325

FOREIGN PATENT DOCUMENTS

DE 202007012885 U1 12/2007
EP 1327587 A1 7/2003
GB 2050320 A * 1/1981 ..... B01L 3/50825
JP S493782 A 1/1974
JP S53129651 U 10/1978
JP S5512040 A 1/1980
JP S5512041 A 1/1980
JP 2002104452 A 4/2002
JP 2012232767 A 11/2012
JP 2015009824 A 1/2015
KR 1020040041302 A 5/2004
KR 1020080000543 A 1/2008
KR 101631438 B1 6/2016
WO 2015194040 A1 12/2015

* cited by examiner

CONTAINER CAP AND CONTAINER COMBINED WITH SAME

TECHNICAL FIELD

The present invention relates to a container cap and a container combined with same, and more particularly, to a container cap combined with a container containing a beverage or the like and a container combined with the container cap.

BACKGROUND ART

A plastic container includes a container containing contents such as a beverage and a container cap combined with a container inlet.

However, the container cap combined with the container inlet may form a minute gap due to a tolerance with the container inlet. Through the gap, the contents such as a beverage may be leaked to the outside, or moisture and bacteria may be introduced from the outside into the container to contaminated or deteriorated.

In order to prevent above described limitations, typically, 1) a sealing member is mounted to a top surface of the container inlet, 2) an inner ring is formed on an inner bottom surface of the container cap, or 3) a packing is mounted to an inner space of the container cap.

However, although the 1) is the safest method, the method of the 1) may increase a manufacturing cost by adding a process of installing the sealing member to the top surface of the container inlet and may not be recycled because a different material is combined.

The method of 2) has a limitation in completely blocking moisture, external air, or bacteria because the tolerance is generated between an inner wall or an outer wall of the container and an inner space of the container cap when the container cap is combined with the container inlet.

DISCLOSURE OF THE INVENTION

Technical Problem

The present invention provides a container cap having a structure combined with a container inlet to completely block moisture, external air, or bacteria from being introduced into a container and a container combined with same to solve the above-described limitations.

Technical Solution

The present invention is disclosed to achieve the objects of the invention. The present invention will solve the above-described limitations by deforming structures of various portions that are combined to have a blocking function when the container inlet is combined with the container cap.

In order to achieve the objects, the present invention provides a container cap 20 which is combined with a container inlet 12 of a container body 10, wherein a plurality of close contact portions in contact with the container inlet 12 are formed, and the close contact portions form a closed curve enclosing the container inlet 12 so as to block inflow of external air from the outside into the container body 10.

According to the present invention, a container includes: a container body 10 containing contents and having a container inlet 12; and a container cap 20 combined with the container inlet 12. Here, a plurality of close contact portions in close contact with each other are formed on at least one of the container cap 20 and the container inlet 12, and the close contact portions form a closed curve enclosing the container inlet 12 so as to block inflow of external air from the outside into the container body 10.

The container may include: a container body 10 containing contents and having a container inlet 12; and a container cap 20 combined with the container inlet 12. Here, the container cap 20 may include: a body part 26 in close contact with an upper end of the container inlet 12; a sidewall part 25 which extends downward from the body part 26 and in which a female screw part 24 that is screw-coupled with a male screw part 14 formed on an outer circumferential surface of the container inlet 12 is formed; and an inner ring 100 protruding from a bottom surface of the body part 26 and inserted to an inner circumferential surface of the container inlet 12.

At least one inner circumferential protruding part 121 that protrudes toward the inner ring 100 to contact an outer circumferential surface of the inner ring 100 when the container cap 20 is combined with the container inlet 12 may be formed on an inner circumferential surface of the container inlet 12.

At least one inner ring protruding part that protrudes toward an inner circumferential surface of the container cap 20 to contact the inner circumferential surface of the container cap 20 when the container cap 20 is combined with the container inlet 12 may be formed on the container cap 20.

A middle ring 210 inserted to a recessed groove 220 having a circular shape formed on the upper end of the container inlet 12 and formed on the bottom surface of the body part 26 to form at least one close contact portion when the container cap 20 is combined with the container inlet 12 may be formed on the container cap 20.

An inner upper end 221 may be lower than an outer upper end 222 based on the recessed groove 220 in the upper end of the container inlet 12.

At least one of an inner upper end 221 and an outer upper end 222 of the container inlet 12 may have a curved outer circumferential surface, and an inclined surface 215 in contact with the curved outer circumferential surface when the container cap 20 is combined with the container inlet 12 may be formed on the container cap 20.

Advantageous Effects

The container cap and the container combined with the same according to the present invention have an advantage in that the close contact portions contacting the container inlet form the closed curve, and the plurality of close contact portions are combined with the container inlet to completely block moisture, external air, and bacteria from being introduced into the container.

Also, the container cap and the container combined with the same according to the present invention have an advantage in that as the close contact portions contacting the container inlet form the closed curve, and the plurality of close contact portions completely block moisture, external air, and bacteria, the sealing force of the container is improved to secure safety of the contents contained in the container and diversify the kinds of the contents.

Also, the container cap and the container combined with the same according to the present invention have an advantage in that as the close contact portions contacting the container inlet form the closed curve, and the plurality of close contact portions completely block moisture, external air, and bacteria, the sealing member for sealing the container is not necessary to remarkably reduce the manufacturing costs of the product including the container and contribute to the environment.

Also, the container cap and the container combined with the same according to the present invention have an advantage in that the close contact portions contacting the container inlet form the closed curve, the plurality of close contact portions completely block moisture, external air, and bacteria, and the container cap is maximally recycled as the container and the container cap are made of the single material such as synthetic resin materials (e.g., PE, PP, PET).

Furthermore, the container cap and the container combined with the same according to the present invention have an advantage in that as the container and the container cap are made of the single material such as synthetic resin materials, the container cap and all sorts of containers are maximally recycled.

MODE FOR CARRYING OUT THE INVENTION

Figure 1:
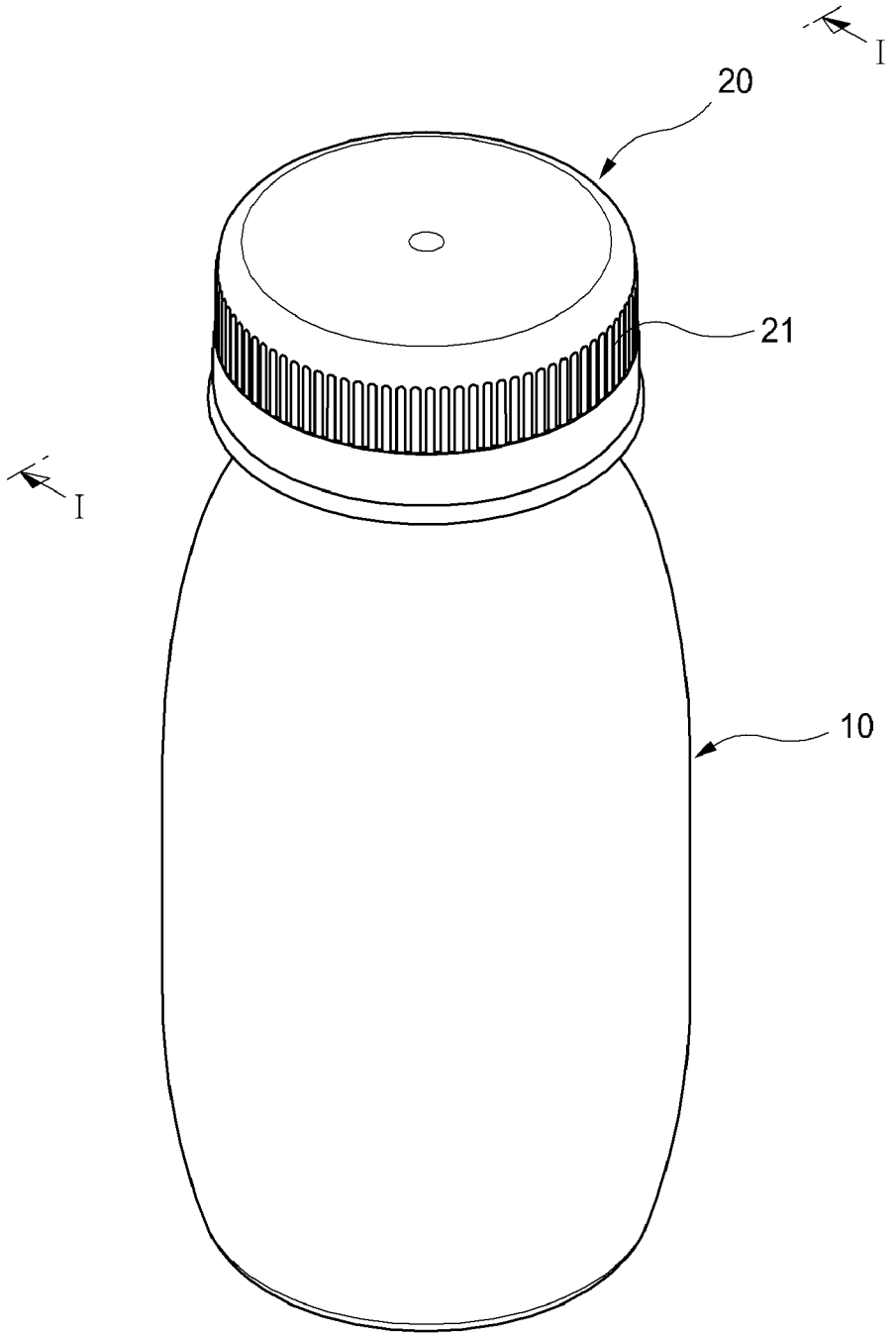
FIG. 1 is a perspective view illustrating a container according to a first embodiment of the present invention.

Hereinafter, a container cap and a container combined with same according to the present invention will be described with reference to the accompanying drawings.

The present invention provides a novel container cap and a container structure, which are capable of preventing external air or bacteria from being introduced into a container or preventing contents from being leaked to the outside.

Specifically, a container according to the present invention includes a container body 10 containing the contents and having a container inlet 12 and a container cap 20 combined with the container inlet 12. Here, at least one of the container cap 20 and the container inlet 12 forms a plurality of close contact portions, and the close contact portions form a closed curve enclosing the container inlet 12 so as to block inflow of external air from the outside into the container body 10.

Here, the container body 10 may contain the contents including powder, tablets, and granules in addition to liquid materials such as a beverage and be made of various materials such as a synthetic resin material and a glass material according to shapes and materials of liquids, powder, or particles.

Particularly, the container body 10 may be made of the same material as the container cap 20 such as PP, PE, and PET for combination with the container cap according to the present invention.

The close contact portion, as a portion closely contacting at least one of the container cap 20 and the container inlet 12, may include all sorts of structures of forming a portion closely contacting the container cap 20 and the container inlet 12.

Particularly, the close contact portion of the present invention may be combined with the container inlet to completely block moisture, external air, or bacteria from being introduced into the container as the container cap 20 closely contacts the container inlet 12 by a descending force when the container cap 20 is rotated and/or descended to be combined with the container inlet 12 (e.g., one piece or two piece one-touch cap and undercut cap (snap-type cap)).

In the container body 10, the container inlet 12 that is a portion combined with the container cap 20 has a basic shape of a cylindrical shape, and the rest portion may have various configurations according to a design.

Also, the container inlet 12 may be an outlet formed in the container body 10 so that the contents are discharged to the outside and include various configurations according to a combining structure of the container because the container inlet 12 is coupled with the container cap 20.

Particularly, since the container cap 20 of main products is combined by rotation, the container inlet 12 may have a partially cylindrical shape. The cylindrical container inlet 12 may be applied to products having a combining structure, in which the container cap descends to be combined with the container inlet 12, like one-piece one touch cap (also known as Duma cap), two-piece one touch cap in which a cap and a body are integrated by a hinge, and a undercut cap that is combined only with undercut (representative products: *lactobacillus* yogurt products).

The container cap 20 is a component combined with the container inlet 12 of the container body 10. The container cap 20 has the basic shape of an overall cylindrical shape corresponding to a shape of the container inlet 12 and having an opened side heading toward the container inlet 12.

For example, the container cap 20 may include: a body part 26 closely contacting an upper end of the container inlet 12; and a sidewall part 25 extending downward from the body part 26 and combined with the container inlet 12.

The body part 26 may be a portion closely contacting the upper end of the container inlet 12 and have various shapes according to an outer structure of the container cap 20, e.g., a circular plate shape.

The container cap 20 may include an inner ring 100, so called a ring gasket, protruding from a bottom surface of the body part 26 and inserted to an inner circumferential surface of the container inlet 12 to increase a sealing force of the container body 10.

The inner ring 100, as a portion protruding from the bottom surface of the body part 26 and inserted to the inner circumferential surface of the container inlet 12 to increase the sealing force of the container body 10, may have various configurations according to a contact structure with the container inlet 12.

The sidewall part 25, as a component extending downward from the body part 26 and combined with the container inlet 12, may have various configurations according to a combining structure with the container inlet 12.

For example, the sidewall part 25 may be combined with the container inlet 12 through a screw combining structure, and here, a female screw part 24 screw-combined with a male screw part 14 formed on an outer circumferential surface of the container inlet 12 may be formed.

Also, the sidewall part 25 may be combined with the container inlet 12 by a snap-type combining structure (e.g., one-piece and two-piece one touch cap and undercut cap structure).

Here, as at least one ring-shaped combining projection may be formed on the outer circumferential surface of the container inlet 12, and a ring-shaped combining groove to which the combining projection formed on the container inlet 12 is inserted is formed in an inner surface of the sidewall part 25, the container cap 20 may be combined with the container inlet 12.

The container cap 20 according to the present invention may include a plurality of close contact portions closely contacting the container inlet 12 by relative close contact with the container inlet 12.

Also, the close contact portions may form a closed curve enclosing the container inlet 12 to block inflow of external air from the outside into the container body 10 and have various configurations according to the formation position, formation structure, and number of the close contact portions.

A scut part 27 caught by and combined with a scut combining projection 13 formed on the container inlet 12 may be integrated with a lower end of the sidewall part 25 of the container cap 20.

The scut part 27 is a portion integrated with the lower end of the sidewall part 25 to be caught by and combined with the scut combining projection 13 formed on the container inlet 12 and a portion separated from the sidewall part 25 when the container cap 20 is initially opened.

Here, the scut part 27 may have various configurations according to a combining structure with the scut combining projection 13.

Also, the scut part 27 may be connected with the sidewall part 25 by a plurality of bridges or a cutting line for easy separation from the sidewall part 25.

A separation preventing projection 15 for preventing the container cap 20 from being unintentionally separated from the container inlet 12 may be additionally formed at a position corresponding to a lower end of the scut part 27.

The separation preventing projection 15, as a component formed at the position corresponding to the lower end of the scut part 27 of the container inlet 12 for preventing the container cap 20 from being unintentionally separated from the container inlet 12, may protrude further than an outer circumferential surface of the sidewall part 25 of the container cap 20.

Also, a plurality of projections 21 may be formed along a circumferential direction of the container cap 20 so that a user easily rotates the container cap 20.

Hereinafter, a specific embodiment of the present invention will be described in detail. Also, characteristic parts will be described in detail for convenience of description.

Although the present invention is described for each embodiment, one or more embodiments may be combined as long as the embodiments are not conflicted with each other.

First Embodiment

Figure 2A:
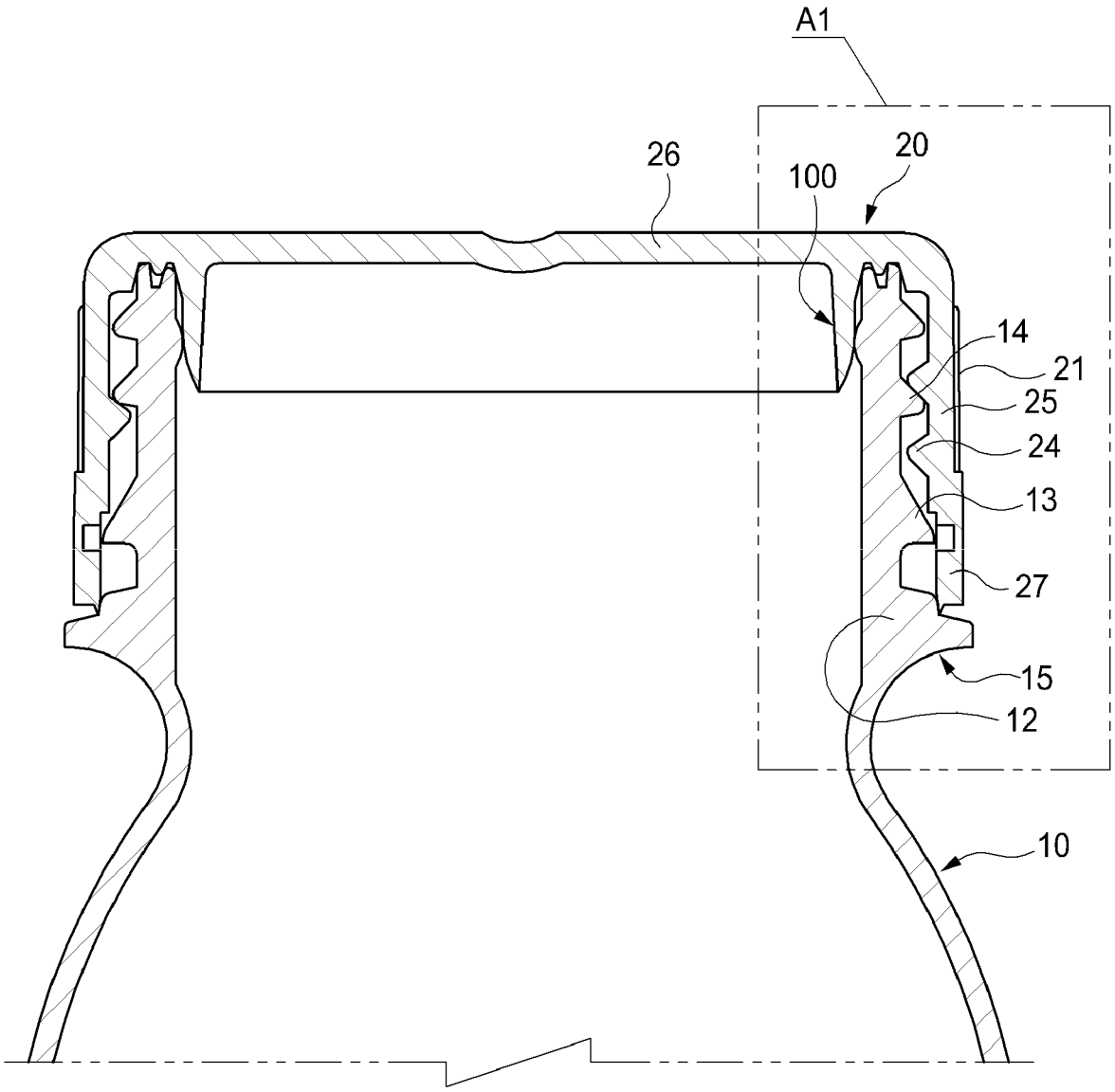
FIG. 2A is a cross-sectional view taken along line I-I of FIG. 1.
Figure 2B:
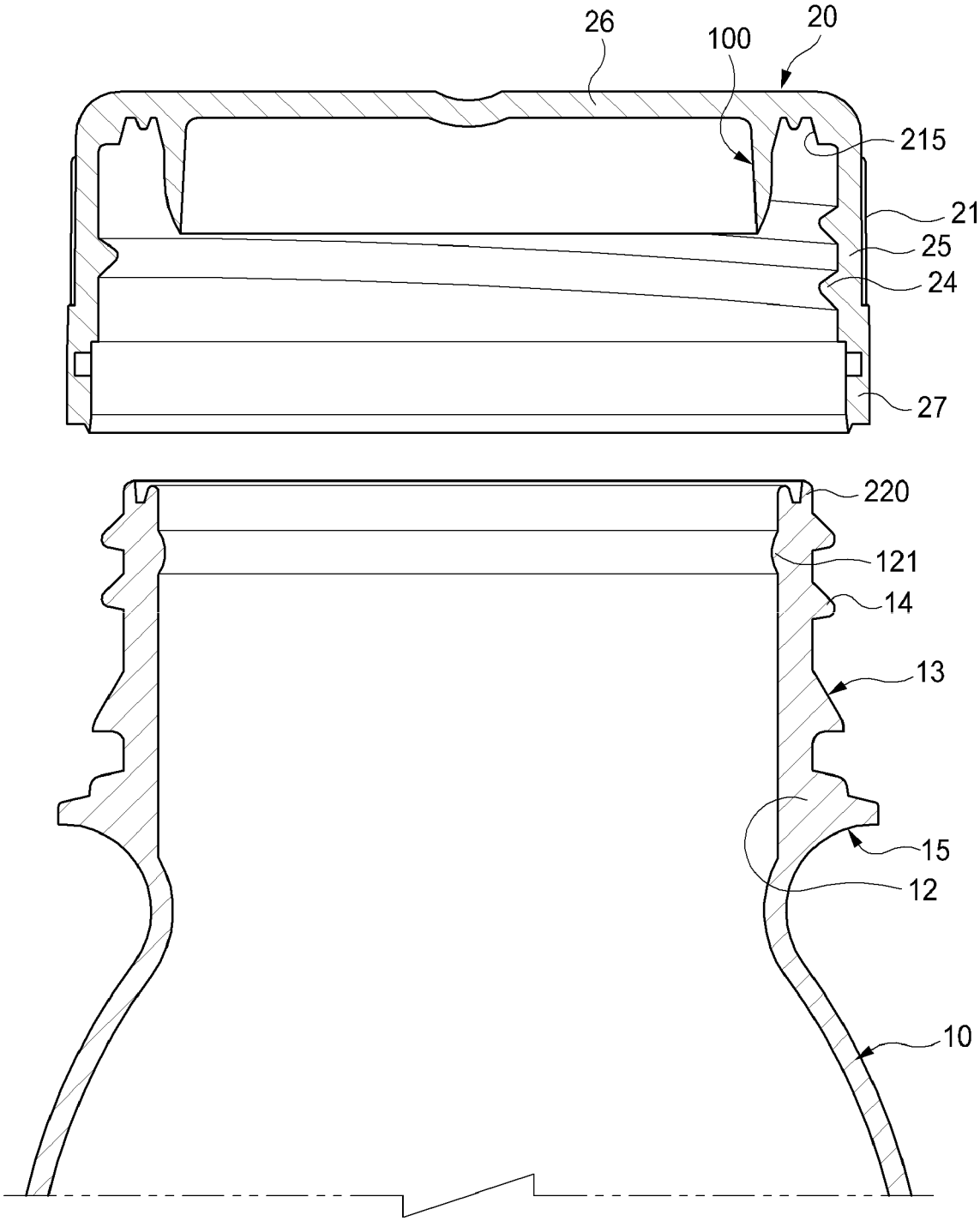
FIG. 2B is a cross-sectional view illustrating a state in which a container cap is separated from the container.
Figure 3:
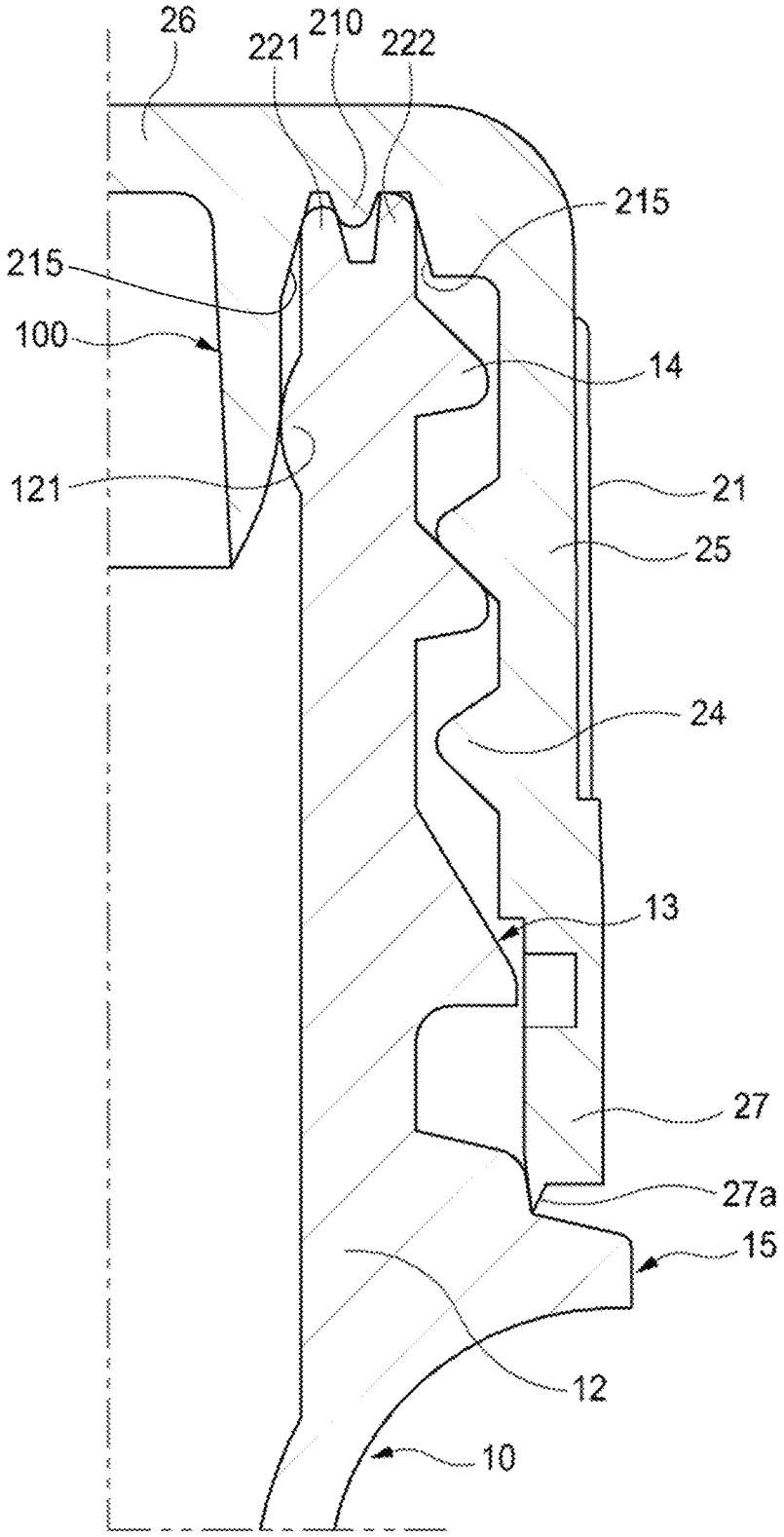
FIG. 3 is an enlarged cross-sectional view illustrating portion A1 of FIG. 2A.

As illustrated in FIGS. 1 to 3, according to a first embodiment of the present invention, at least one inner circumferential protruding part 121 protruding toward the inner ring 100 to contact an outer circumferential surface of the inner ring 100 when the inner ring 100 of the container cap 20 is combined with the container inlet 12 may be formed.

The inner circumferential protruding part 121, as a portion protruding toward the inner ring 100 to contact the outer circumferential surface of the inner ring 100, may have a ring shape in a circumferential direction based on a central axis of a longitudinal direction of the container inlet 12.

Also, the inner circumferential protruding part 121 may have a gentle curved shape so that a cross-section in the longitudinal direction of the container inlet 12 is in surface-contact with the outer circumferential surface of the inner ring 100 instead of line-contact.

In the container cap 20, at least one inner ring protruding part protruding toward an inner circumferential surface of the container cap 20 to contact the inner circumferential surface of the container cap 20 when the container cap 20 is combined with the container inlet 12 may be formed as a component similar to the inner circumferential protruding part 121.

The inner ring protruding part, as a component protruding toward an inner circumferential surface of the container cap 20 to contact the inner circumferential surface of the container cap 20 when the container cap 20 is combined with the container inlet 12, may have a ring shape in a circumferential direction based on the central axis of the longitudinal direction of the container inlet 12.

Also, the inner ring protruding part may have a gentle curved shape so that a cross-section in the longitudinal direction of the container inlet 12 is in surface-contact with the inner circumferential surface of the container inlet 12 instead of line-contact.

In the container cap 20, a middle ring 210 inserted to a recessed groove 220 integrated along a circumference of the upper end of the container inlet 12 when the container cap 20 is combined with the container inlet 12 may be formed on the bottom surface of the body part 26 to increase a sealing force to the container body 10.

The middle ring 210 may have various configurations according to a contact structure with the recessed groove 220 as a ring formed on the bottom surface of the body part 26 and inserted to the recessed groove 220 integrated along the circumference of the upper end of the container inlet 12 when the container cap 20 is combined with the container inlet 12.

For example, the middle ring 210 may have a vertical cross-section having a reverse triangular shape or a reverse trapezoidal shape. Here, an end of the middle ring 210 may have various shapes such as a flat surface or a curved surface.

Also, the recessed groove 220 to which the middle ring 210 is inserted may have a shape corresponding to a cross-sectional shape of the middle ring 210. Here, the cross-sectional shape of the middle ring 210 may have a width that is decreased more than that of the recessed groove 220 so that the middle ring 210 closely contacts the recessed groove 220 when inserted.

Alternatively, two or more recessed groove 220 and two or more middle ring 210 may be formed according to the sealing force.

When the recessed groove 220 is formed, the recessed groove 220 may be formed by two (inner and outer) upper ends 211 and 222 forming the upper end of the container inlet 12.

Here, the two upper ends 221 and 222 may have a structure inclined at a portion in which the recessed groove 220 is formed and having elasticity.

Also, at least one of the two upper ends 221 and 222 may have a curved outer circumferential surface.

Here, as illustrated in FIG. 3, as an inclined surface 215 contacting the curved outer circumferential surface of the upper ends 221 and 222 is formed in the container cap 20, at least one close contact portion may be formed so that the container cap 20 closely contacts the container inlet 12 when the container cap 20 is combined with the container inlet 12.

Also, the upper end of the container inlet 12, i.e., the two upper ends 221 and 222, the inner upper end 221 may be lower than the outer upper end 222 based on the recessed groove 220.

Second Embodiment

As illustrated in FIGS. 4A to 6B, according to a second embodiment of the present invention, a tight sealing contact portion 330 supported by at least one contact support surface 310 and 320 formed on the container inlet 12 may be formed on the container cap 20.

The contact support surface 310 and 320 may include various structures capable of supporting the tight sealing contact portion 330 as a portion supporting the close contact portion 330 when the container cap 20 is combined with the container inlet 12.

For example, as illustrated in FIGS. 4A to 5C, the contact support surface 310 and 320 may be formed on the scut combining projection 13.

Figure 4A:
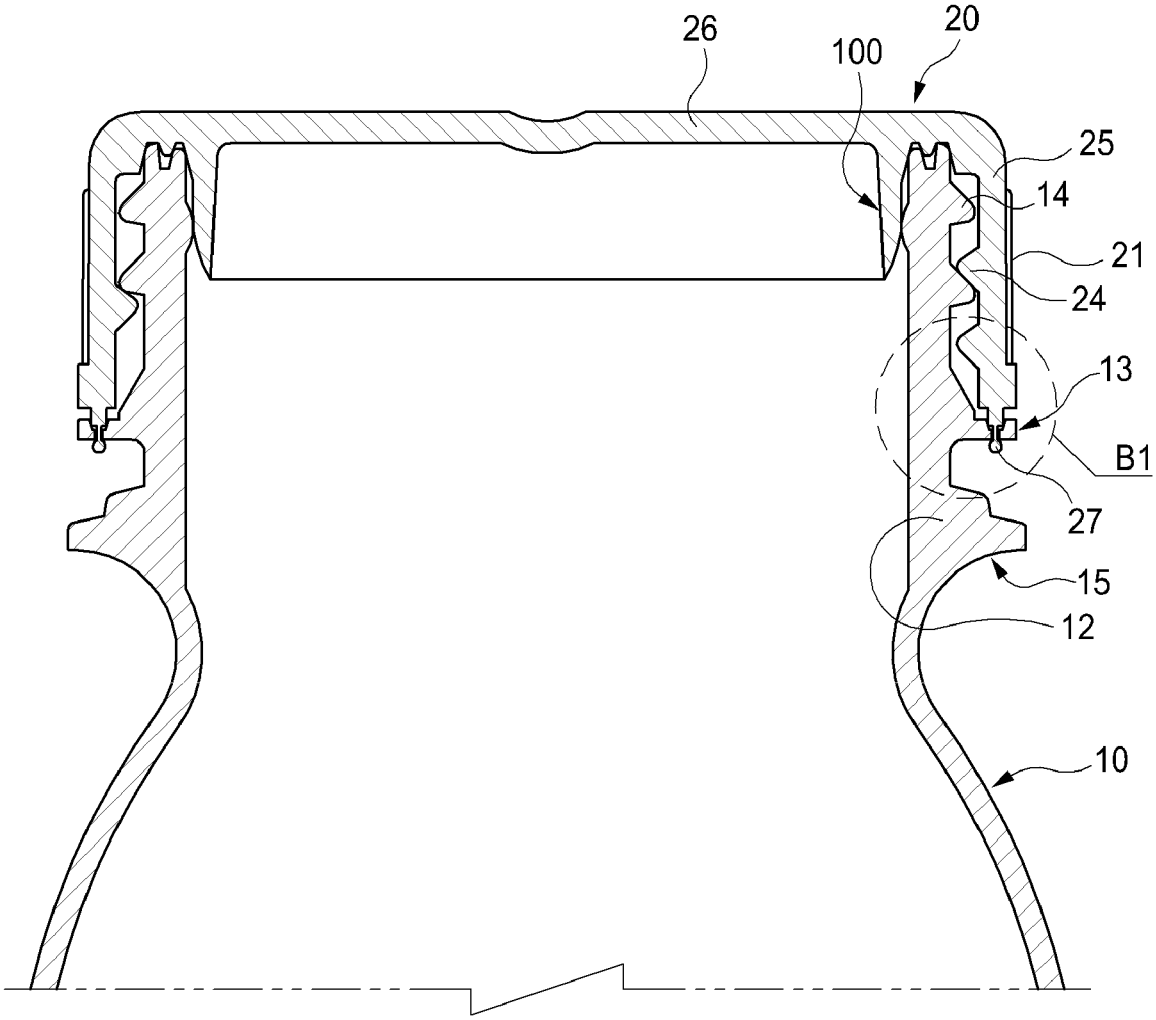
FIG. 4A is a cross-sectional view illustrating a container according to a second embodiment of the present invention.
Figure 4B:
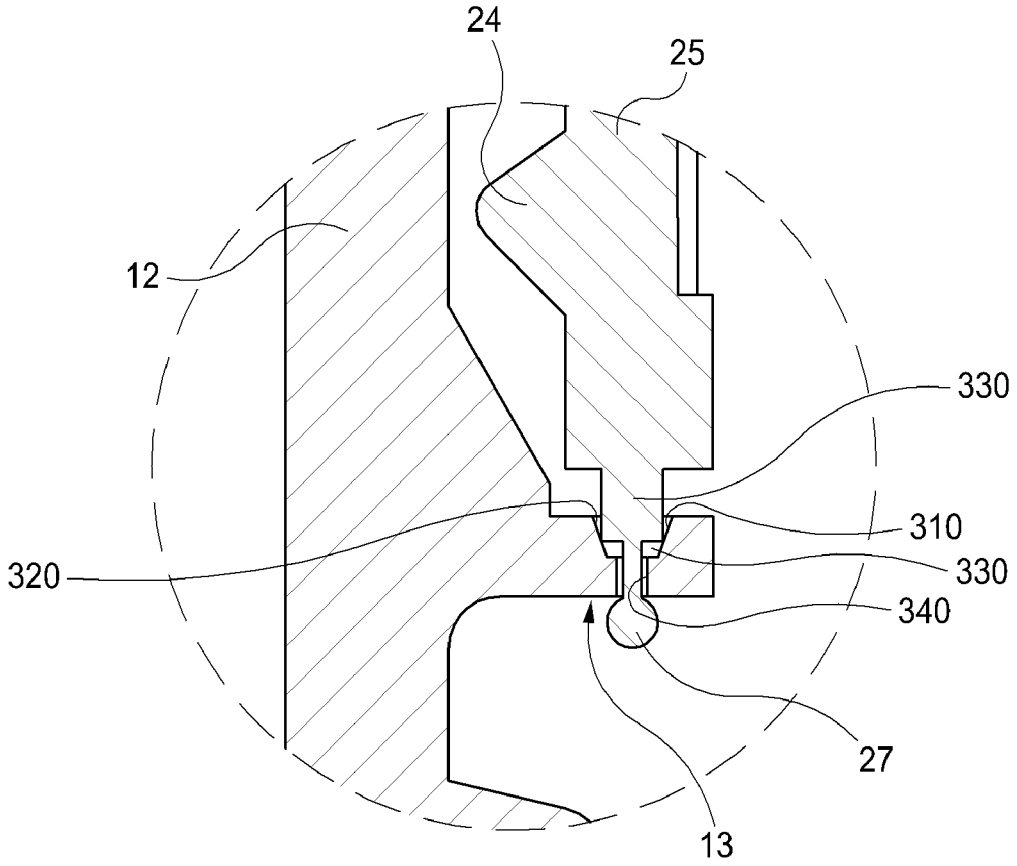
FIG. 4B is an enlarged cross-sectional view illustrating portion B1 of FIG. 4A.
Figure 5A:
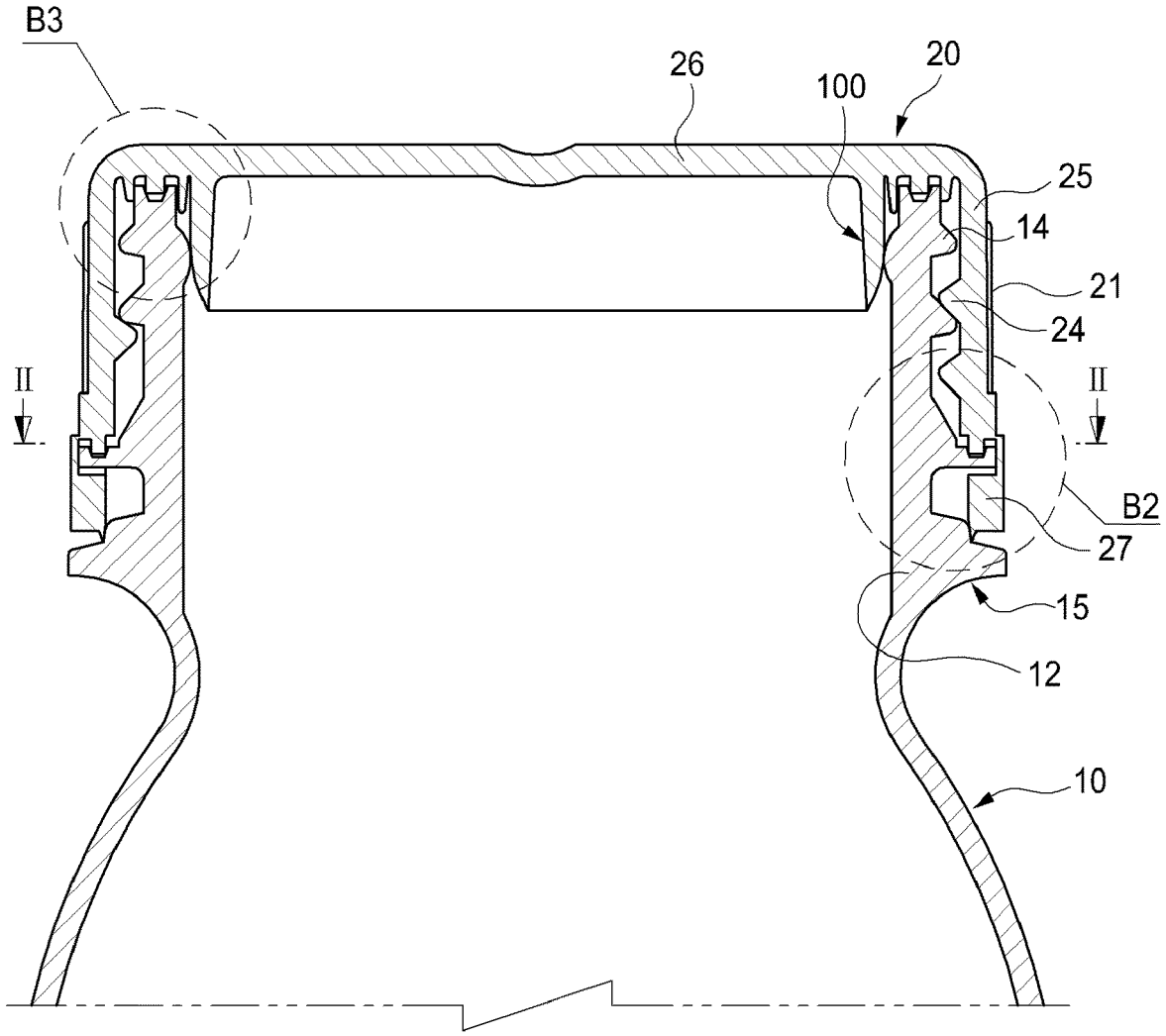
FIG. 5A is a cross-sectional view illustrating a modified example of the container in FIG. 4A.
Figure 5B:
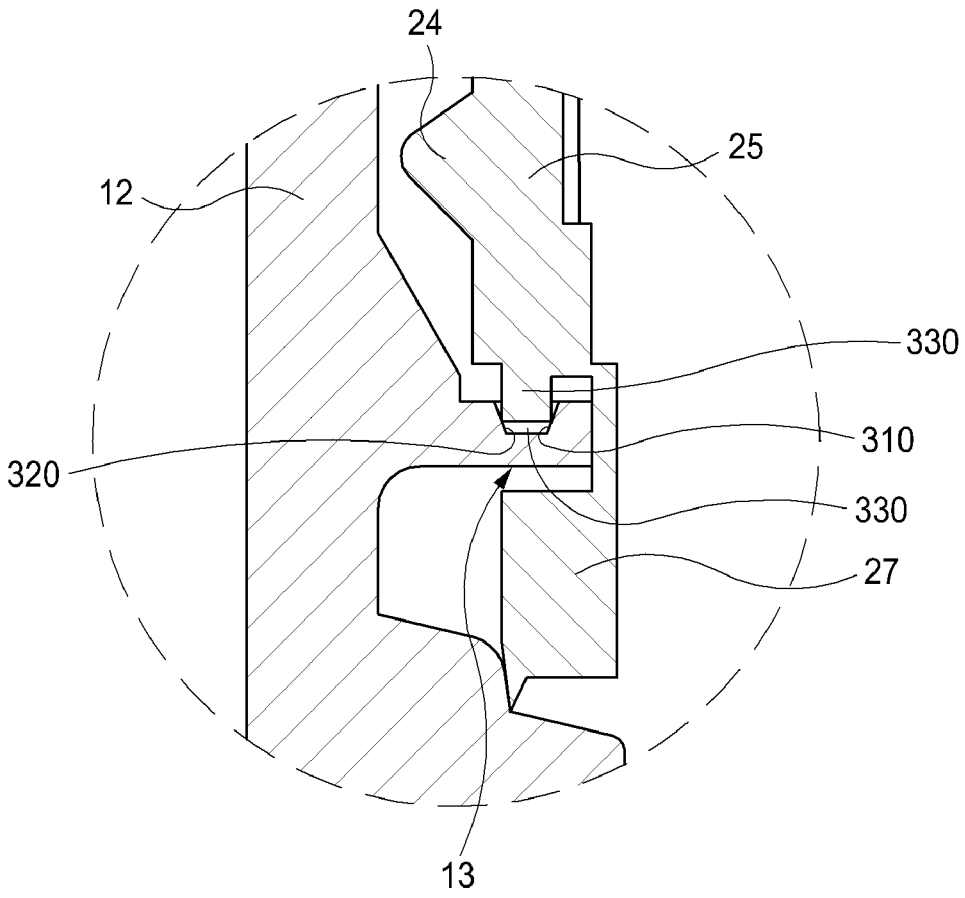
FIG. 5B is an enlarged cross-sectional view illustrating portion B2 of FIG. 5A.

Specifically, as illustrated in FIGS. 4B and 5B, a ring-shaped groove 330 that is recessed so that a lower end of the tight sealing contact portion 330 is inserted when the container cap 20 is combined with the container inlet 12 may be formed in the scut combining projection 13, and side surfaces of the groove 330 may form the contact support surfaces 310 and 320.

Specifically, sidewalls of the groove 330, which are inclined in a downward direction to contact a lower end, e.g., a corner, of the tight sealing contact portion 330, may form the contact support surfaces 310 and 320.

Here, the contact support surfaces 310 and 320 may include a first contact support surface 310 disposed at the inside and a second contact support surface 320 disposed at the outside, and when one contact support surface is provided, the second contact support surface 320 disposed at the outside may form the contact support surface.

The scut combining projection 13 may have various shapes according to a combining structure of the scut part 27.

For example, the scut part 27 may extend from the lower end of the tight sealing contact portion 330. Here, the scut part 27 may be combined with the scut combining projection 13 by passing through the groove 330.

As illustrated in FIGS. 4A and 4B, the scut part 27 may include a plurality of scut portions extending in the circumferential direction instead of having a ring structure integrated in the circumferential direction, and a plurality of through-holes 340 may be formed in the groove 330 so that the scut portions are respectively inserted thereto.

For another example, as illustrated in FIGS. 5A and 5B, the scut part 27 may be installed beyond an outside of the scut combining projection 13.

The tight sealing contact portion 330 may have various configurations according to a contact structure of the contact support surface 310 and 320 as a portion formed on the container cap 20 and supported by at least one contact support surface 310 and 320 formed on the container inlet 12.

For example, the tight sealing contact portion 330 may be formed on a lower end of a wall part 25. The tight sealing contact portion 330 may form the lower end of the wall part 25 or a projection formed at the lower end of the wall part 25 and having a thickness less than a cross-sectional thickness of the wall part in consideration of a connection structure of the scut part 27.

Here, the tight sealing contact portion 330 may close contact an inclined structure of the contact support surface 310 and 320 when descended to the container inlet 12 by rotation of the container cap 20.

That is, the tight sealing contact portion 330 is inserted to the groove forming the contact support surface 310 and 320 and closely contacts the inclined structure of the contact support surface 310 and 320 when descended to the container inlet 12 by the rotation of the container cap 20.

When one pair of contact support surfaces 310 and 320 are provided, the tight sealing contact portion 330 may have a thickness greater than a minimum width of the one pair of contact support surfaces 310 and 320.

Also, in a cross-section of the lower end of the tight sealing contact portion 330, each corner may have the right angle.

The tight sealing contact portion 330 may have increased flexibility to increase a sealing effect when closely contacts the contact support surfaces 310 and 320.

Figure 6A:
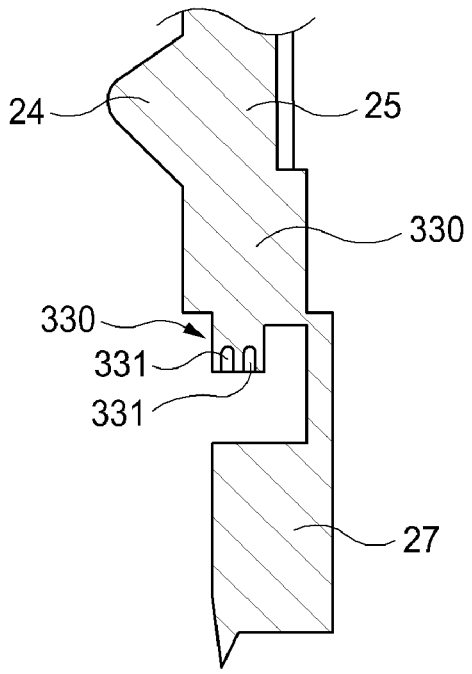
FIGS. 6A and 6B are enlarged cross-sectional views respectively illustrating a modified example of a portion in FIG. 4A and a modified example of a portion in FIG. 5B.
Figure 6B:
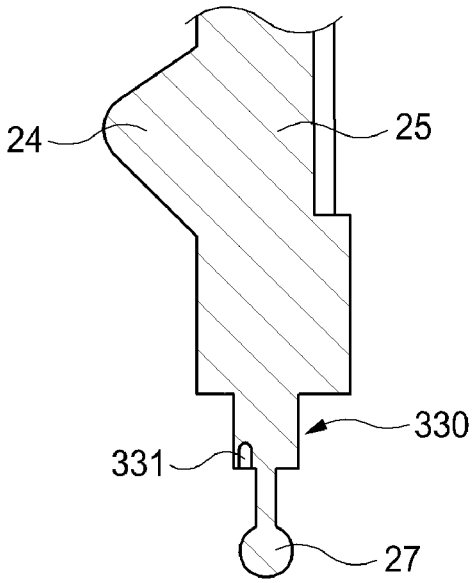

To this end, as illustrated in FIGS. 6A and 6B, at least one deformed groove 160 adjacent to a contact portion contacting the contact support surfaces 310 and 320 may be formed in the tight sealing contact portion 330.

The deformed groove 160 has a ring shape formed along the circumferential direction at a position adjacent to the contact portion contacting the contact support surfaces 310 and 320. The deformed groove 160 may be deformed when the contact portion contacting the contact support surfaces 310 and 320 contacts the contact support surfaces 310 and 320 to apply flexibility and increase the sealing effect.

An upper end of the container inlet 12 may have the same or similar structure as that of the first embodiment.

Figure 5C:
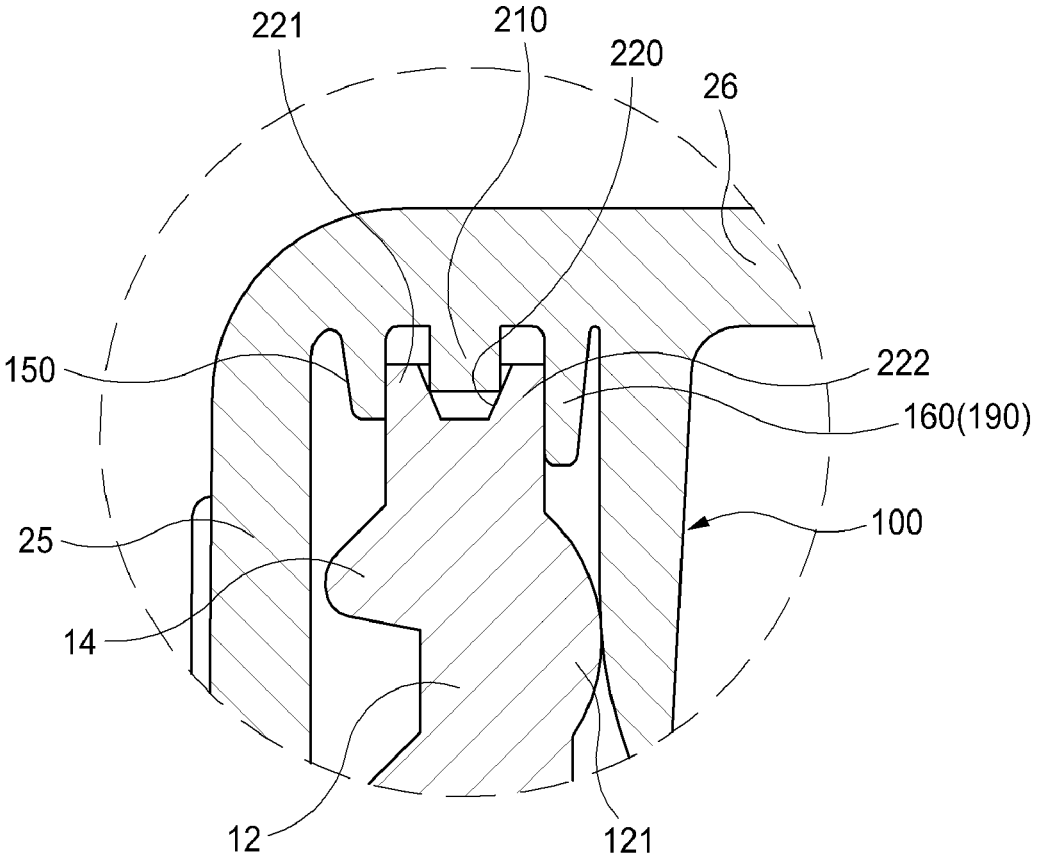
FIG. 5C is an enlarged cross-sectional view illustrating portion B3 of FIG. 5A.

As illustrated in FIG. 5C, at least one contact ring 150 and 160 may be formed on the upper end of the container inlet 12 by extending from the lower end of the body part 26 to closely contact the upper end of the container inlet 12 in addition to or separately from the same or similar structure as that of the first embodiment.

The contact ring 150 and 160 may have a ring shape as a portion extending from the lower end of the body part 26 to closely contact the upper end of the container inlet 12.

Particularly, the contact ring 150 and 160 may include an inner ring 150 and an outer ring 160 so that the upper end of the container inlet 12 is inserted therebetween.

Third Embodiment

In terms of sealing between the container cap 20 and the container inlet 12, the sealing force of the container may be remarkably improved by applying flexibility to portions contacting each other.

In the container according to a third embodiment of the present invention, at least one flexibility applying groove 231, 232, 233, and 234 is formed in the container inlet 12, and a pressing contact part 241, 242, 243, and 215 may be formed in the container cap 20 at a position corresponding to the flexibility applying groove 231, 232, 233, and 234.

The flexibility applying groove 231, 232, 233, and 234 may be formed in any portion at which the container cap 20 and the container inlet 12 contact each other as a groove formed to improve the sealing force of the container by applying the flexibility to the portion at which the container cap 20 and the container inlet 12 contact each other.

Figure 7:
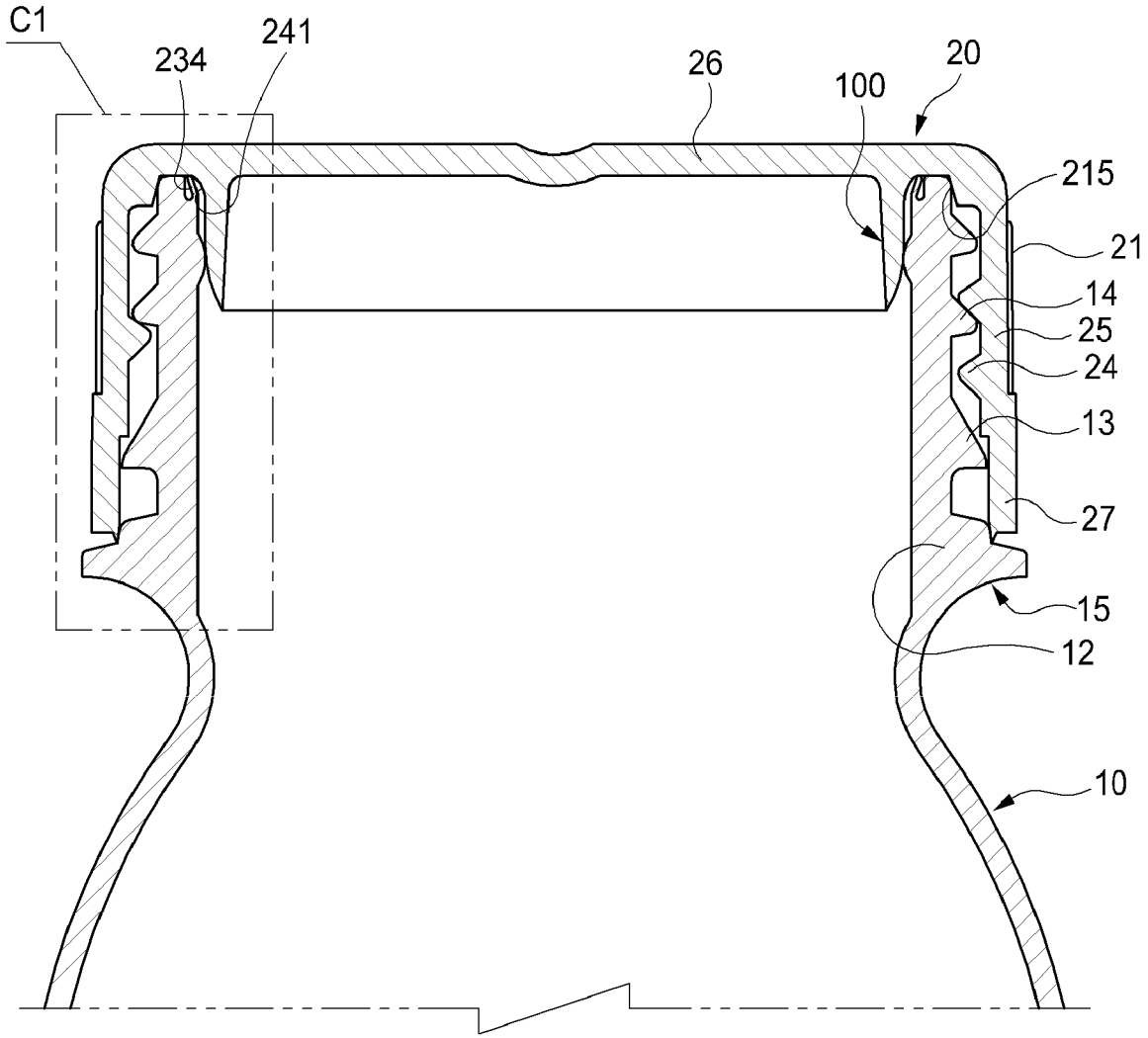
FIG. 7 is a cross-sectional view illustrating a container according to a third embodiment of the present invention.
Figure 8A:
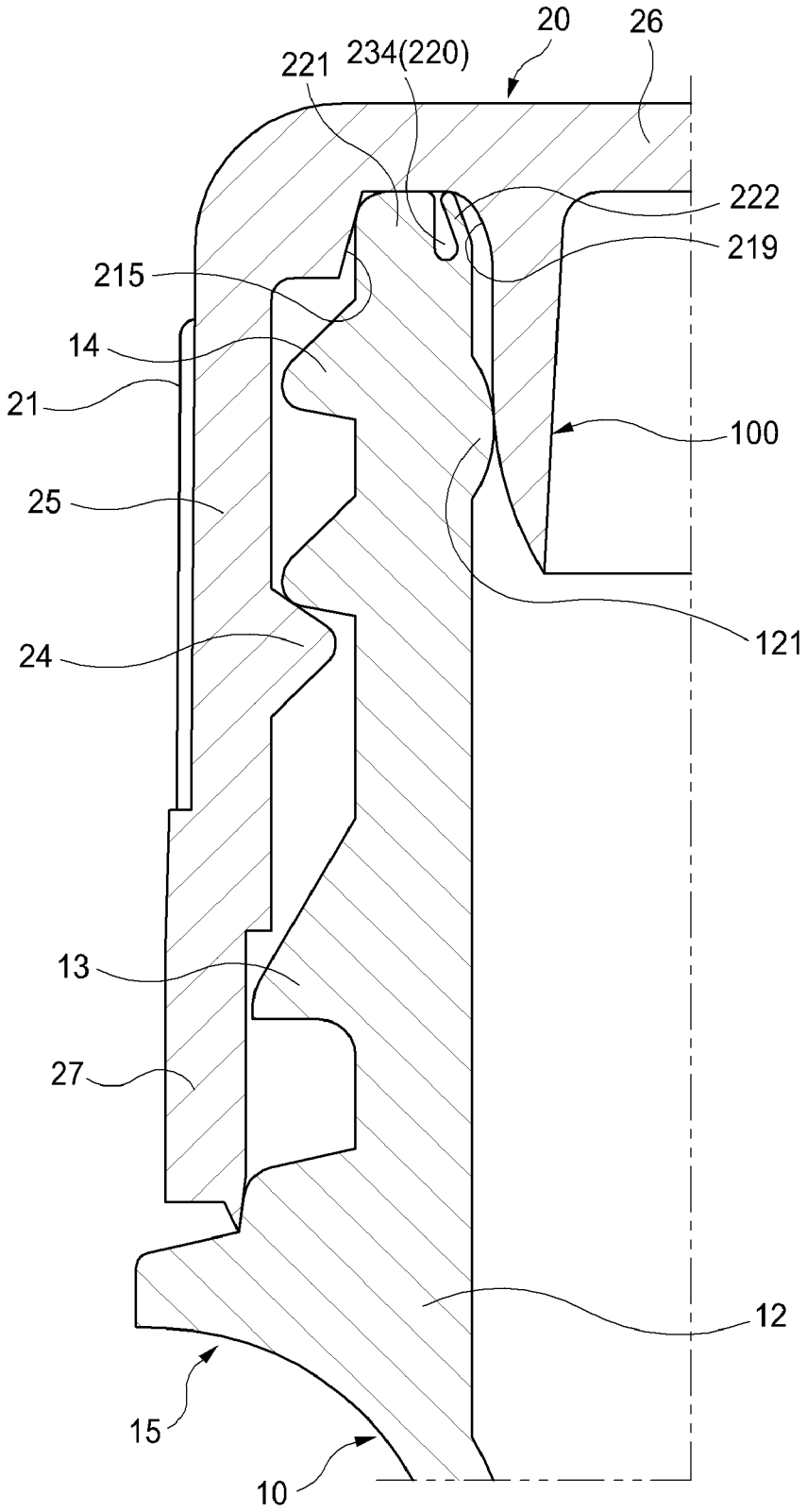
FIG. 8A is an enlarged cross-sectional view illustrating portion C1 of FIG. 7.
Figure 8B:
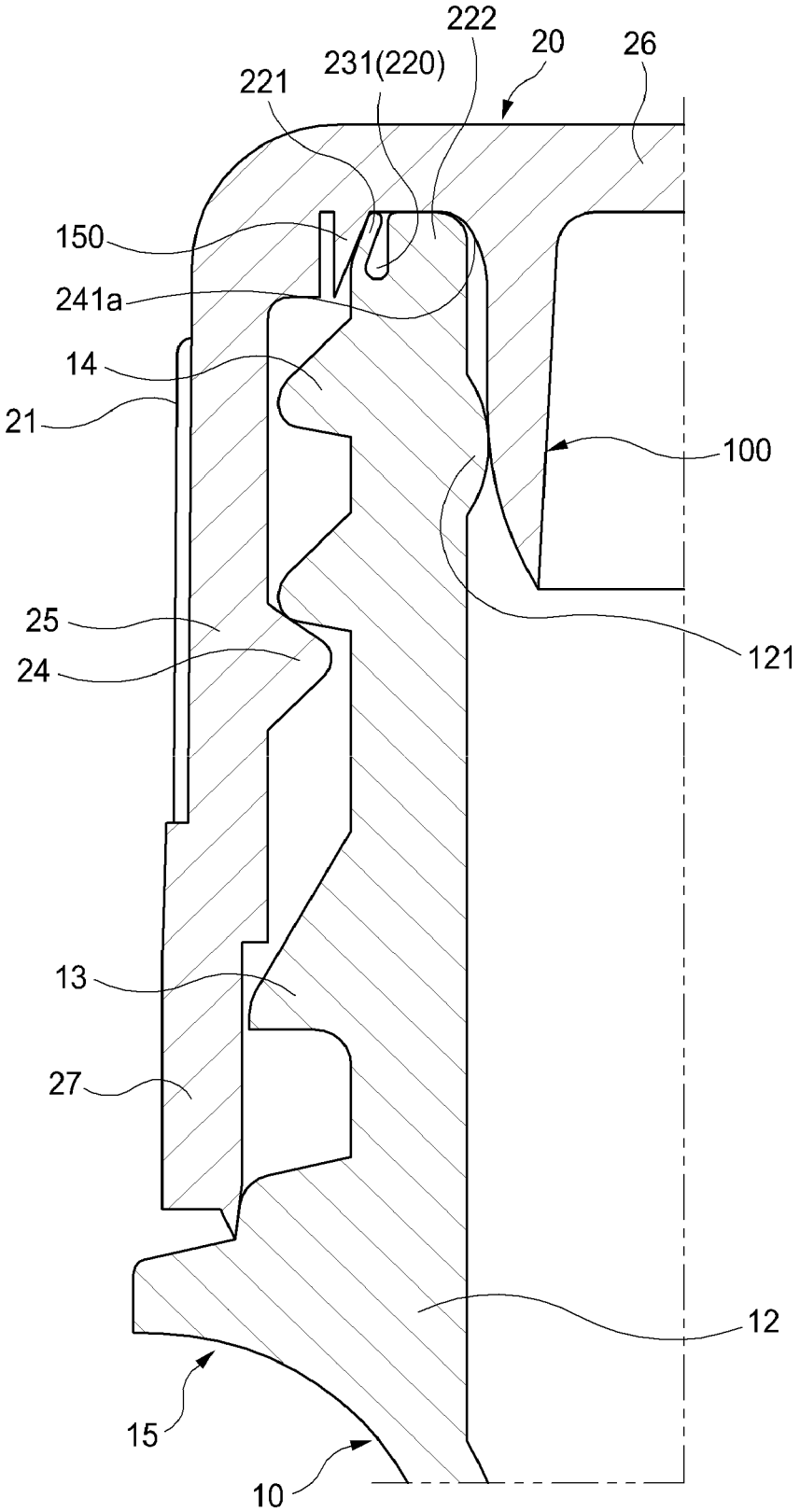
FIG. 8B is an enlarged cross-sectional view illustrating a modified example of FIG. 8A.

For example, as illustrated in FIGS. 7 to 8*b*, the flexibility applying groove 231 may be formed in the upper end of the container inlet 12.

The flexibility applying groove 231 formed in the upper end of the container inlet 12 may be as same as the recessed groove 220 of the first embodiment as a ring-shaped groove formed in the upper end of the container inlet 12.

Particularly, the flexibility applying groove 231 formed in the upper end of the container inlet 12 may be formed adjacent to the inner circumferential surface (refer to FIGS. 7 and 8A) or the outer circumferential surface (refer to FIG. 8B) of the upper end of the container inlet 12, so as to be deformed when contacts the container cap 20.

For another example, as illustrated in FIGS. 7 to 8A, when the flexibility applying groove 234 formed in the upper end of the container inlet 12 is formed adjacent to the inner circumferential surface of the upper end of the container inlet 12, the container cap 20 may press and contact a portion at which the flexibility applying groove 234 is formed by the pressing contact part 215 when the container cap 20 is combined with the container inlet 12 as the inclined surface 215 is formed at a position corresponding to the flexibility applying groove 234.

As illustrated in FIG. 8B, when the flexibility applying groove 231 formed in the upper end of the container inlet 12 is formed adjacent to the outer circumferential surface of the upper end of the container inlet 12, the container cap 20 may press and contact a portion at which the flexibility applying groove 231 is formed by the pressing contact part 241 when the container cap 20 is combined with the container inlet 12 as the inclined surface 241 is formed at a position corresponding to the flexibility applying groove 231.

As illustrated in FIG. 8B, when the pressing contact part 241 is formed in the container cap 20, the pressing contact part 241 may be formed on the outer ring 160 of the second embodiment in addition to the simple inclined surface.

Figure 8C:
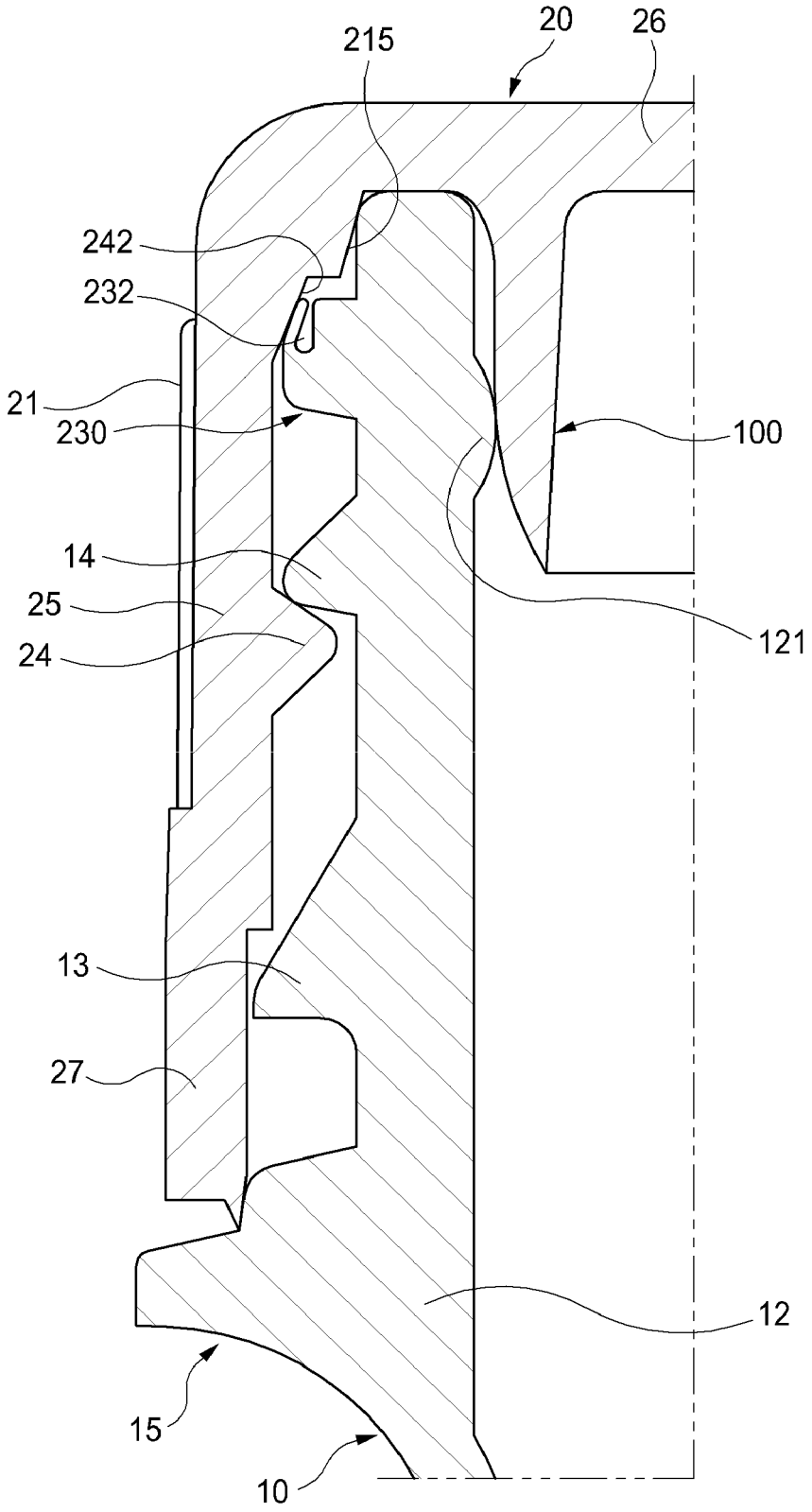
FIG. 8C is an enlarged cross-sectional view illustrating an example in which a flexibility applying groove is formed in a wall part as a modified example of FIG. 8A.

For another example, as illustrated in FIG. 8C, the flexibility applying groove 232 may be formed in the outer circumferential surface of the container inlet 12.

Here, a ring-shaped flexibility applying projection 230 may be formed on the outer circumferential surface of the container inlet 12 to form the flexibility applying groove 232 pressed by the container cap 20, and the flexibility applying groove 232 may be recessed from an upper side to a lower side of the flexibility applying projection 230.

In the container cap 20, the pressing contact part 242 may be formed on the inner circumferential surface of the container cap 20 in correspondence to the flexibility applying groove 232.

The pressing contact part 242 may be an inclined surface that is inclined upward to press a portion in which the flexibility applying groove 232 is formed in the flexibility applying projection 230 by descent of the container cap 20 when the container cap 20 is combined with the container inlet 12.

Figure 8D:
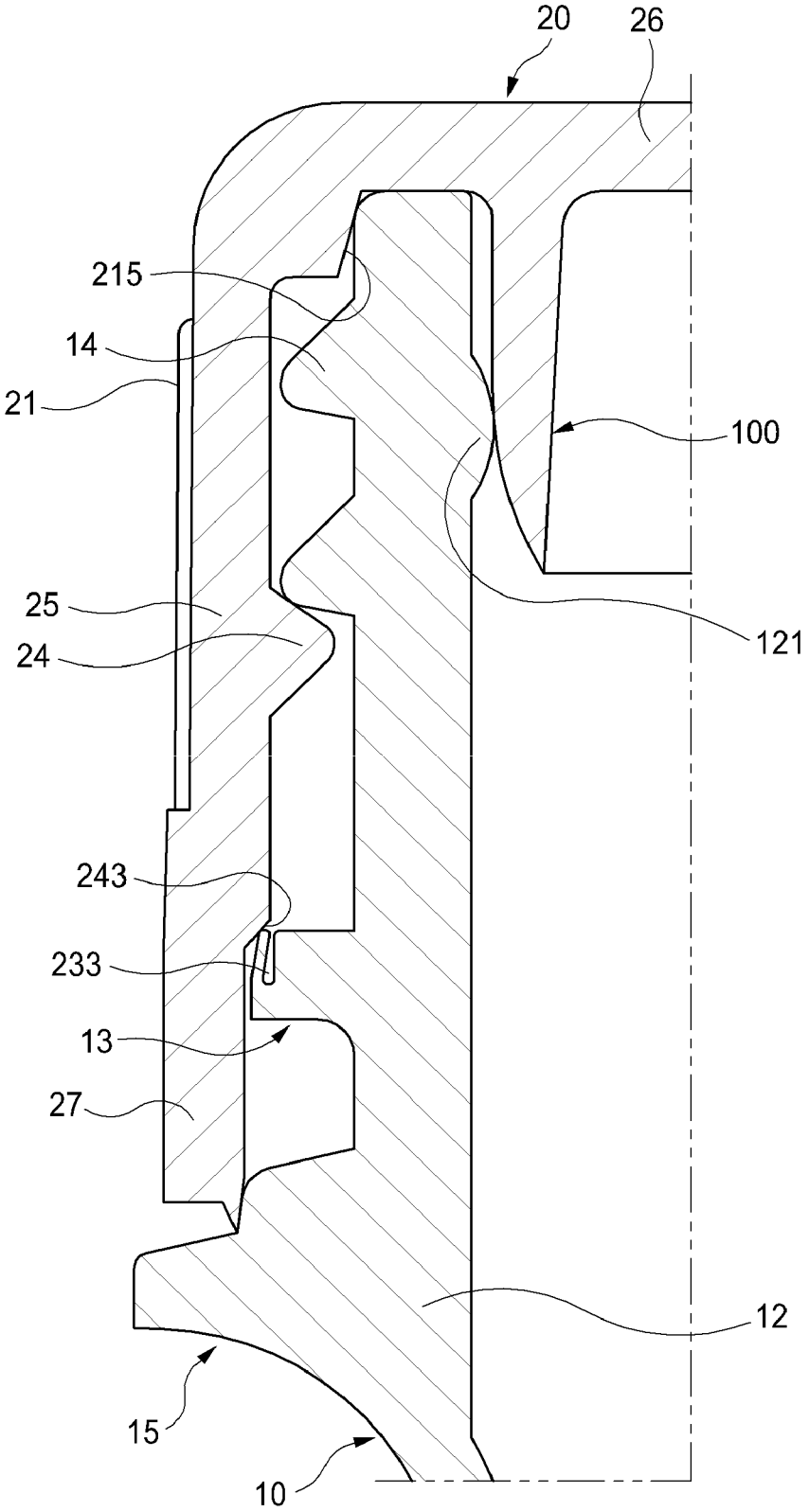
FIG. 8D is an enlarged cross-sectional view illustrating an example in which a flexibility applying groove is formed in a scut combining projection as a modified example of FIG. 8A.

For another example, as illustrated in FIG. 8D, the flexibility applying groove 233 may be formed in the outer circumferential surface, particularly the scut combining projection 13, of the container inlet 12.

Here, the flexibility applying groove 233 pressed by the container cap 20 may be recessed from an upper side to a lower side of the scut combining projection 13.

Also, the pressing contact part 243 may be formed on the wall part 25 of the container cap 20 in correspondence to the flexibility applying groove 233.

The pressing contact part 243 may be an inclined surface that is inclined upward to press a portion in which the flexibility applying groove 13 is formed in the scut combining projection 13 by the descent of the container cap 20 when the container cap 20 is combined with the container inlet 12.

As described above, the pressing contact part 241, 242, 243, and 215 may include various structures capable of pressing the portion in which the flexibility applying groove 231, 232, 233, and 234 is formed as a portion pressing and contacting the flexibility applying groove at a position corresponding to the flexibility applying groove 231, 232, 233, and 234 formed in the container inlet 12.

Specifically, the pressing contact part 241, 242, 243, and 215 may be formed as an inclined surface in consideration that the container cap 20 rotates and/or is descended with respect to the container inlet 12 and the pressing contact part presses the portion in which the flexibility applying groove 231, 232, 233, and 234 is formed by using a force applied by the descent.

However, the pressing contact part 241, 242, 243, and 215 may have various structures such as a projection in addition to the inclined surface, which are capable of pressing the portion in which the flexibility applying groove 231, 232, 233, and 234 is formed by the force applied by the descent.

Fourth Embodiment

The present invention may include various embodiments of intentionally increasing the portion closely contacting each other when the container cap 20 is combined with the container inlet 12 to improve the sealing force of the container.

Figure 9:
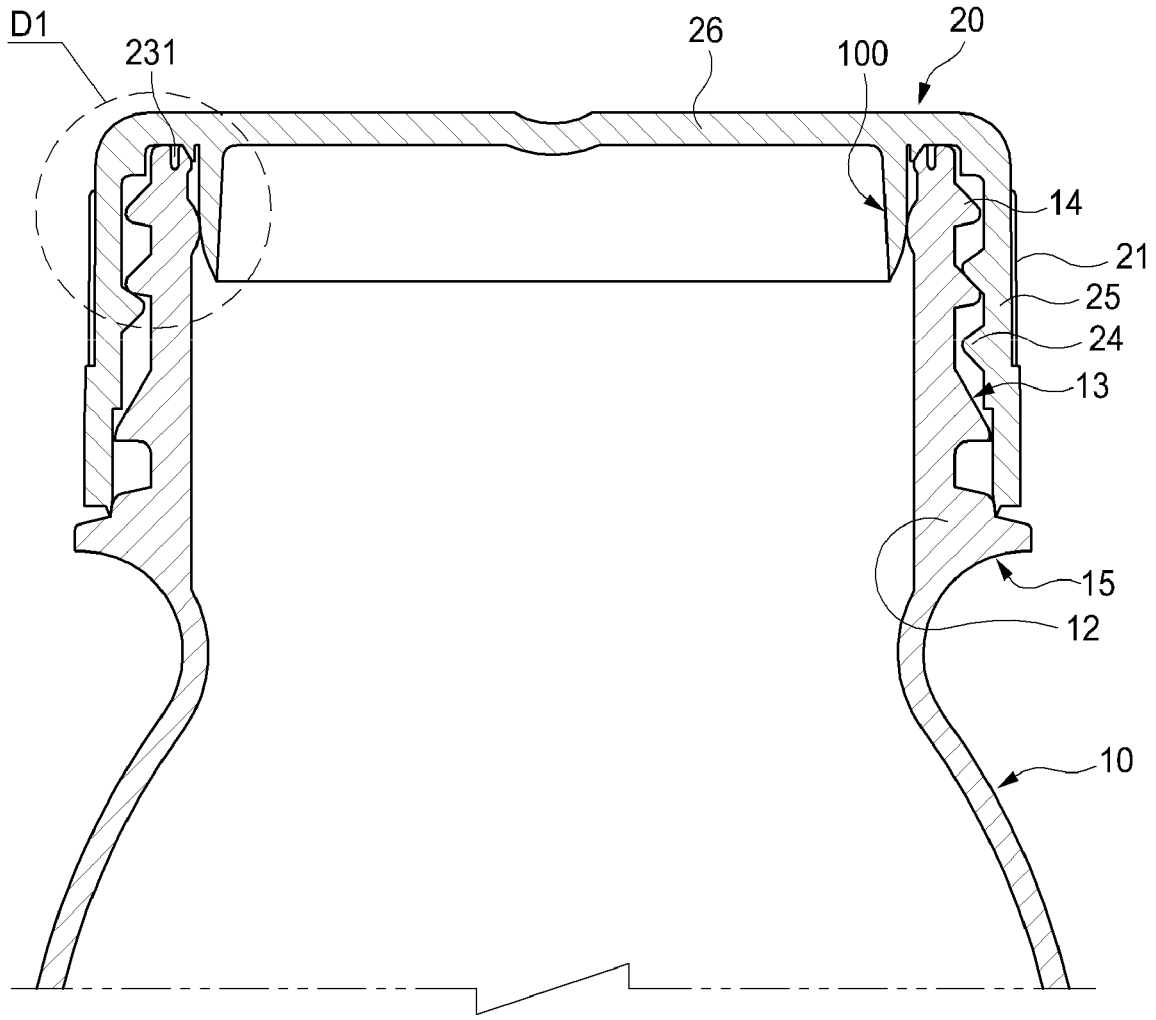
FIG. 9 is a cross-sectional view illustrating a container according to a fourth embodiment of the present invention.
Figure 10A:
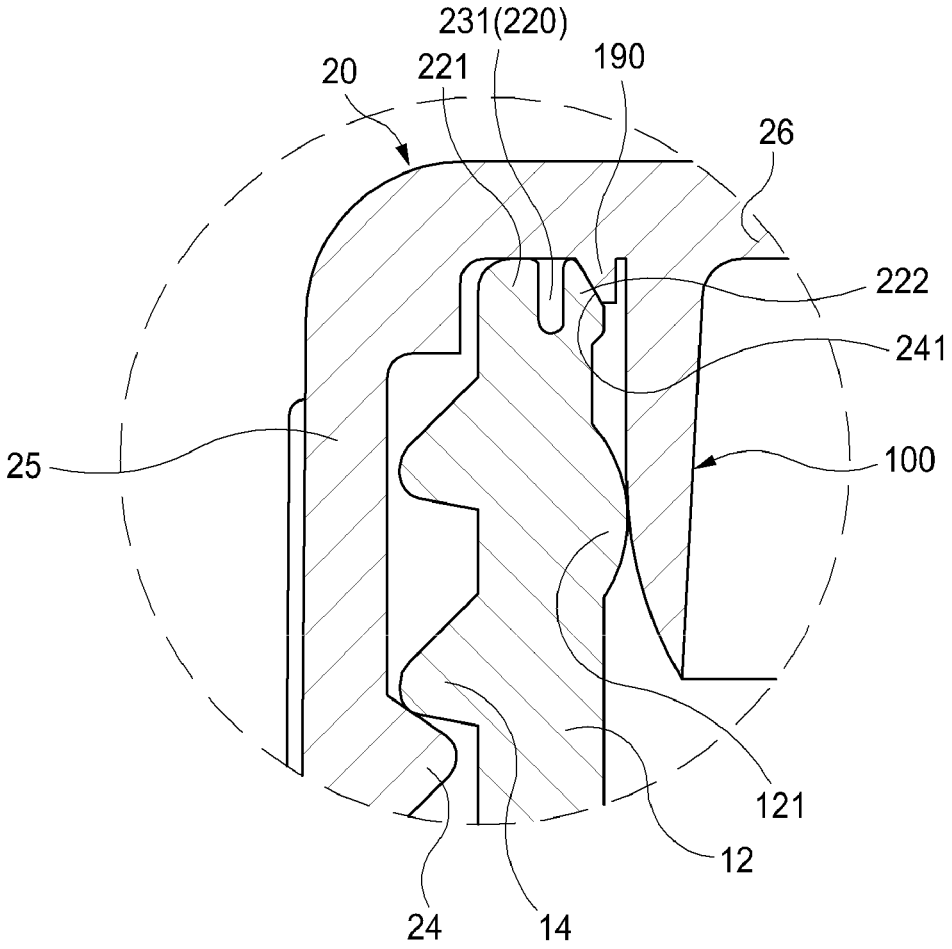
FIG. 10A is an enlarged cross-sectional view illustrating portion D1 of FIG. 9.

As illustrated in FIGS. 9 and 10A, the container according to a fourth embodiment of the present invention may have a configuration similar to that in FIGS. 7 and 8A.

Specifically, the container cap 20 may further include an auxiliary inner ring 190 between the inner ring 100 and the upper end of the container inlet 12 in comparison with the configuration in FIGS. 7 and 8A.

The auxiliary inner ring 190 may protrude downward from the container cap 20, particularly the bottom surface of the body part 26, between the inner ring 100 and the upper end of the container inlet 12.

Here, the auxiliary inner ring 190 may have a vertical length less than that of the inner ring 100 to prevent interference with the inner ring 100.

Also, the auxiliary inner ring 190 may form a surface inclined toward the upper end of the container inlet 12, and the upper end of the container inlet 12 may also form an inclined surface at a portion contacting the auxiliary inner ring 190 as the pressing contact part 241.

In the container inlet 12, an inner circumferential protruding part 121 contacting the outer circumferential surface of the inner ring 100 may be formed as described in the first embodiment.

The container having the above-described structure may increase the contact portion between the container cap 20 and the container inlet 12 to improve the sealing force of the container.

Figure 10B:
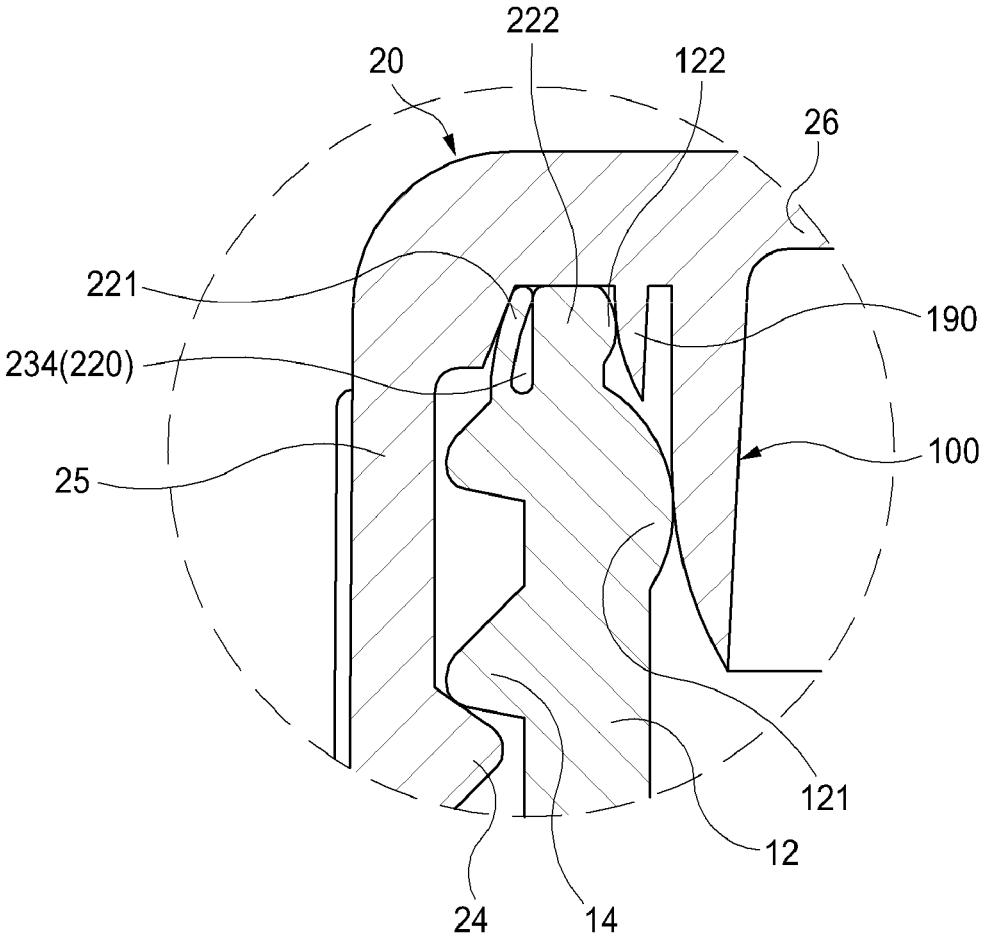
FIG. 10B is an enlarged cross-sectional view illustrating a modified example of FIG. 10A.

As illustrated in FIG. 10B, as a modified example of FIG. 10A, the container according to the fourth embodiment of the present invention may form an inclined surface as the pressing contact part 241 for pressing a portion at which the flexibility applying groove 234 is formed (a portion of the inner ring 100 and the auxiliary inner ring 190 are integrated instead of including the auxiliary inner ring 190).

In the embodiment in FIGS. 10A and 10B, the flexibility applying groove 234 or the recessed groove 220 may be formed by an inner upper end 222 and an outer upper end 221 as illustrated in FIG. 3, and the inner upper end 222 and the outer upper end 221 may have the same height or different heights.

Particularly, the inner upper end 222 may have a height less than that of the outer upper end 221 in FIGS. 10A and 10B.

Figure 10C:
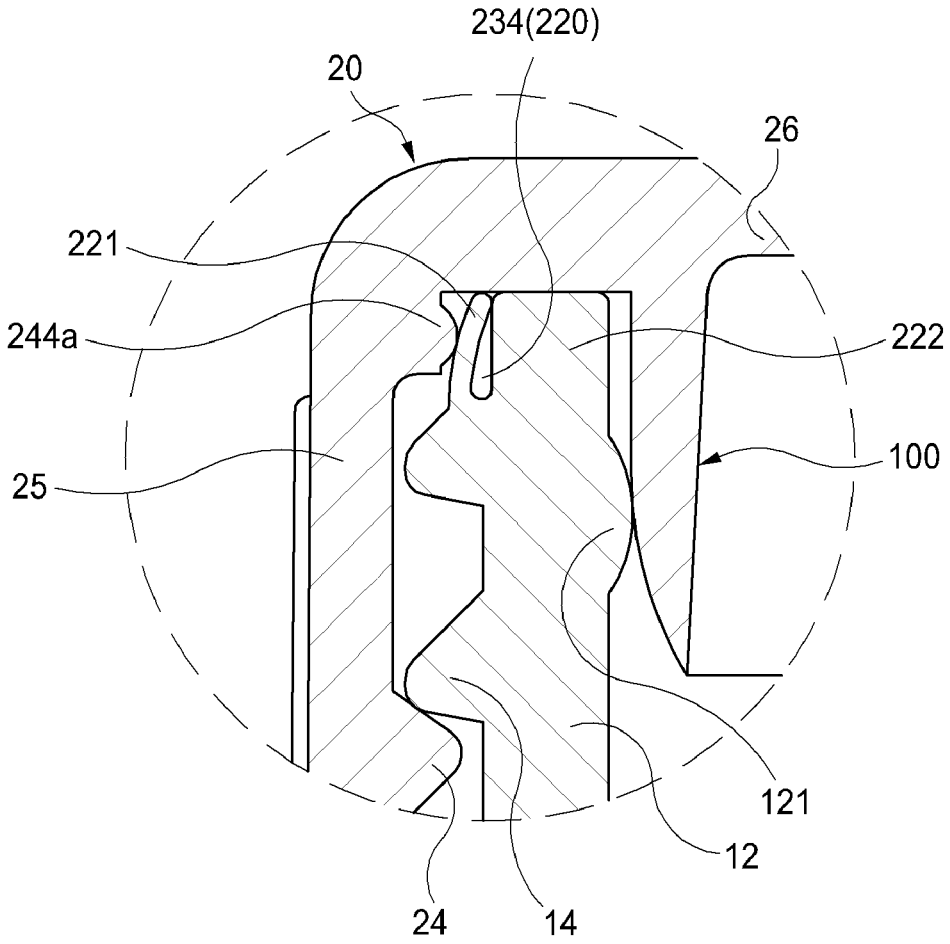
FIG. 10C is an enlarged cross-sectional view illustrating a modified example of FIG. 10A.

As a modified example of FIG. 10A, the container according to the fourth embodiment of the present invention may include the flexibility applying groove 234 formed adjacent to the outer circumferential surface of the upper end of the container inlet 12 as illustrated in FIG. 10C.

Here, the container cap 20 may form an inclined surface 215 as the pressing contact part 215 to press the portion in which the flexibility applying groove 234 is formed.

In FIG. 10C, the outer upper end may have a height less than that of the inner upper end 222.

Figure 10D:
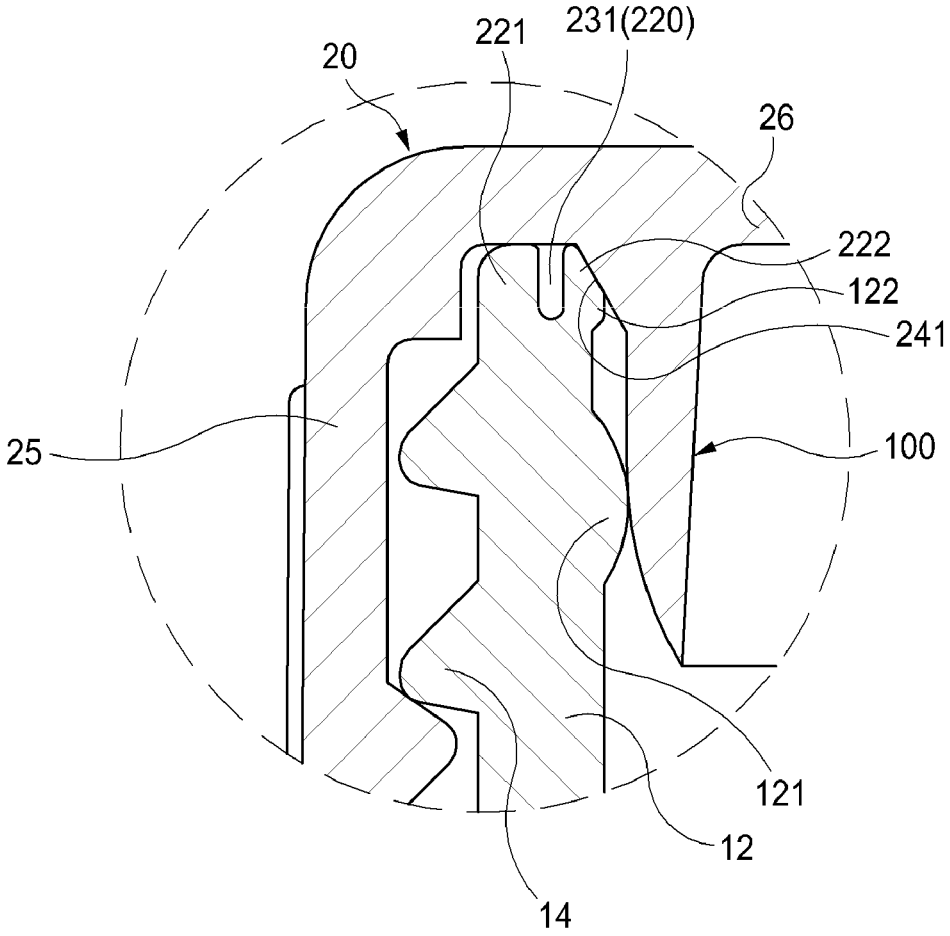
FIG. 10D is an enlarged cross-sectional view illustrating a modified example of FIG. 10C.

Also, as illustrated in FIG. 10D, as a modified example of FIG. 10B, the container according to the fourth embodiment of the present invention may include a projection 244*a* formed on the container cap 20 as the pressing contact part for pressing the portion in which the flexibility applying groove 234 is formed.

In order to improve the sealing force of the container, the contact portion between the container cap 20 and the upper end of the container inlet 12 may be relatively increased. Particularly, the plurality of contact portions may be formed along a path from the outside to the inside of the container instead of being connected to each other.

Figure 11A:
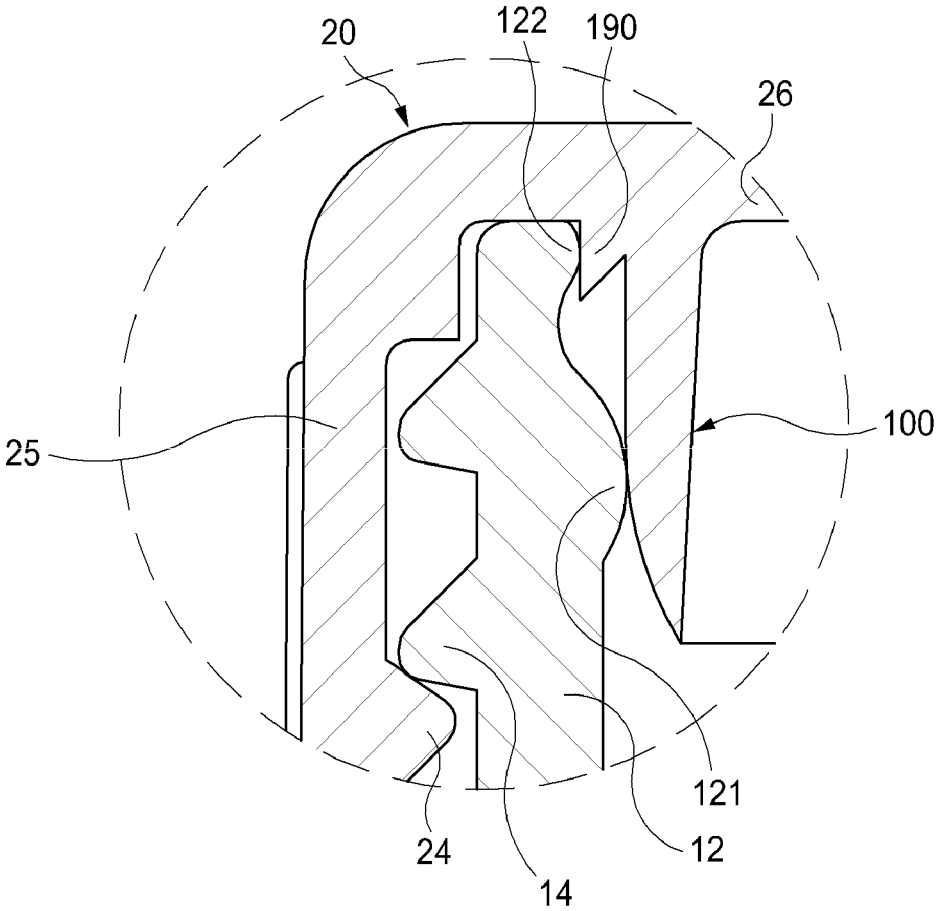
FIGS. 11A to 11E are enlarged cross-sectional views illustrating various embodiments for sealing the container as a modified example of portion D1 of FIG. 9.

As a first example illustrated in FIG. 11A, an auxiliary inner ring 190 closely contacting the upper end of the container inlet 12 may be formed on the container cap 20 in addition to the inner ring 100 and the inner circumferential protruding part 121 contacting the outer circumferential surface of the inner ring 100 of the first embodiment.

The auxiliary inner ring 190 may protrude downward from the container cap 20, particularly the bottom surface of the body part 26, between the inner ring 100 and the upper end of the container inlet 12.

Here, the auxiliary inner ring 190 may have a vertical length less than that of the inner ring 100 to prevent interference with the inner ring 100.

Also, the auxiliary inner ring 190 may contact the upper end of the container inlet 12 when the container cap 20 is combined with the container inlet 12.

To this end, the upper end of the container inlet 12 may have a curved cross-section, and an inner circumferential auxiliary protruding part 122 formed as the inner circumferential surface of the upper end of the container inlet 12 protrudes toward the inner circumferential surface of the auxiliary inner ring 190 may be formed.

Figure 11B:
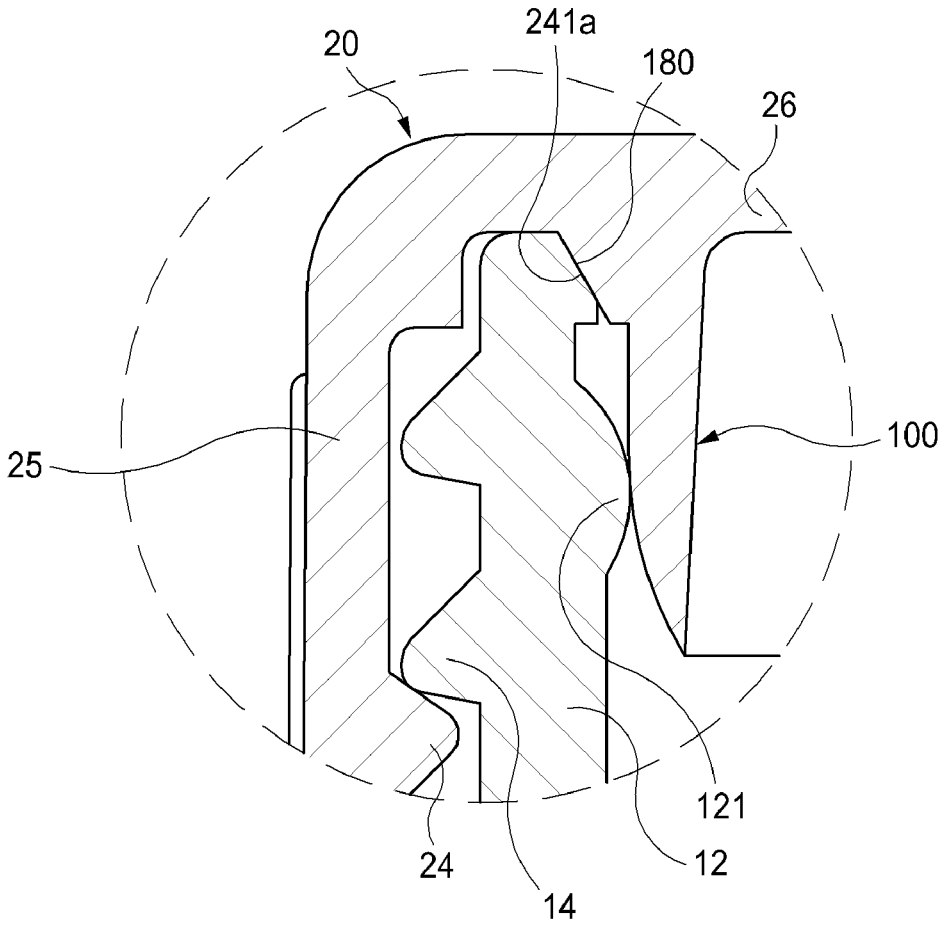
Figure 11C:
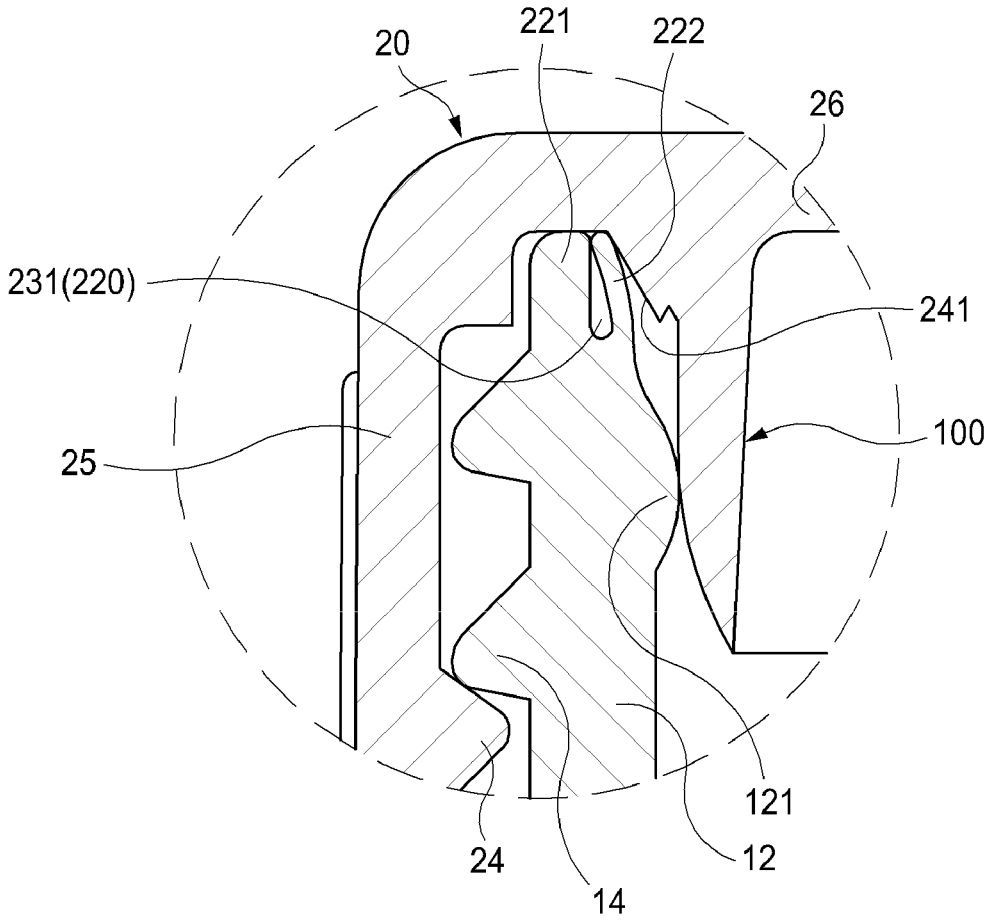

As a second example illustrated in FIG. 11B, at least one surface of surfaces of the auxiliary inner ring 190 and the upper end of the container inlet 12, which contact each other, may form an inclined surface 180 and 241*a* in a structure illustrated in FIG. 11*a*.

In the first and second examples, the auxiliary inner ring 190 may be disposed between the upper end of the container inlet 12 and the wall part 25 instead of being disposed between the upper end of the container inlet 12 and the inner ring 100, and a corresponding component may be symmetrically formed.

As a third example illustrated in FIG. 1C, the flexibility applying groove 231 may be additionally formed in the structure of FIG. 11B.

Here, an auxiliary projection 122 as in FIG. 11A may be formed on the inner circumferential surface of the container inlet 12.

Figure 11D:
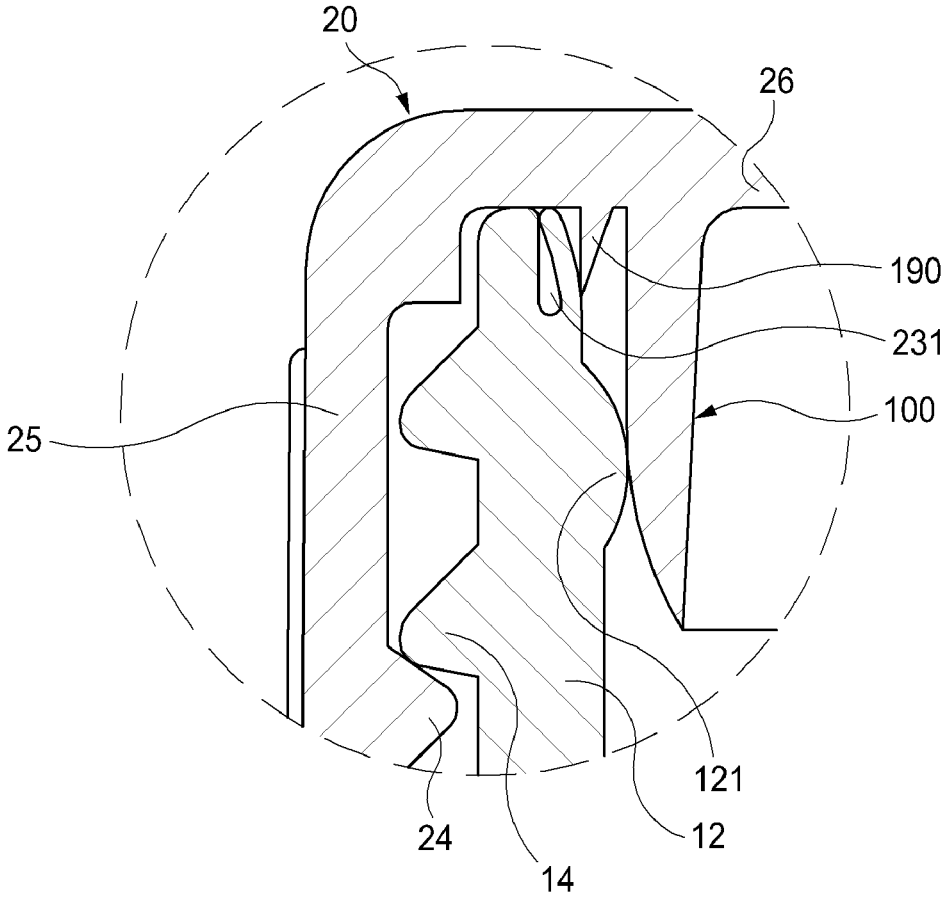

As a fourth example illustrated in FIG. 11D, the flexibility applying groove 231 may be additionally formed in the structure of FIG. 11A.

Figure 11E:
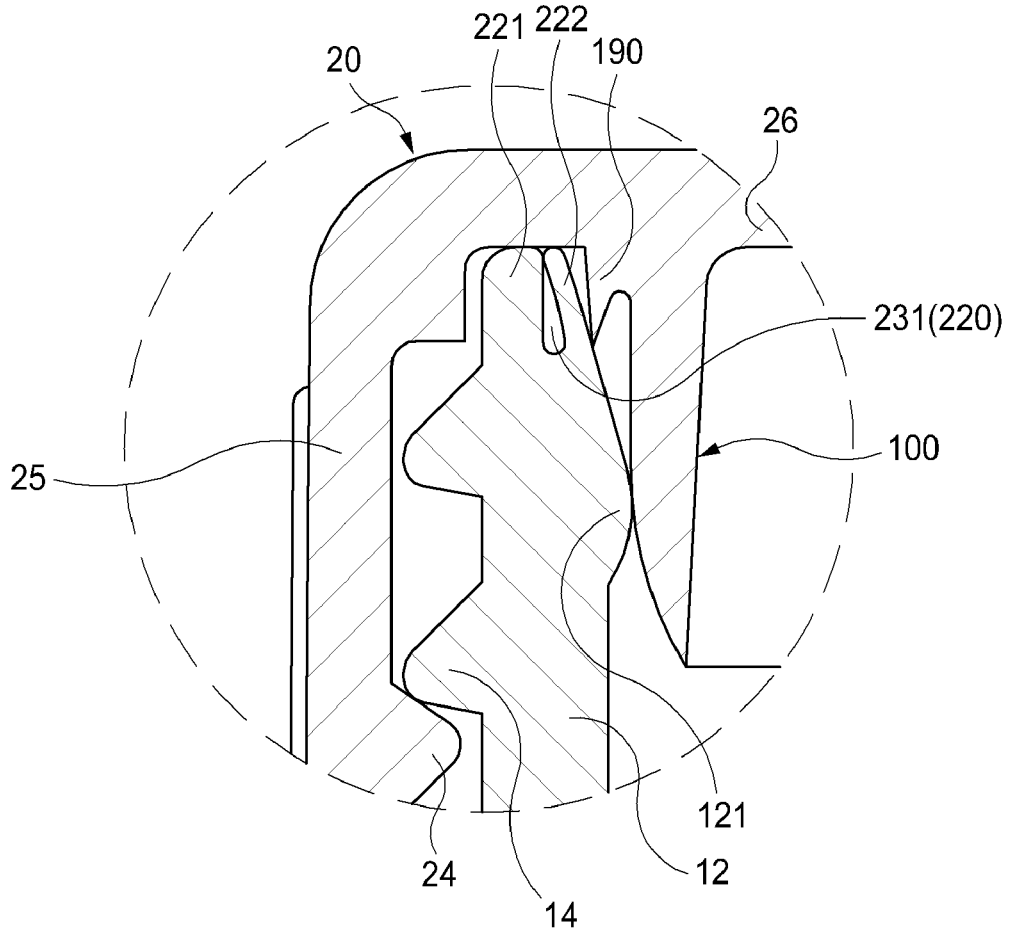
Figure 12:
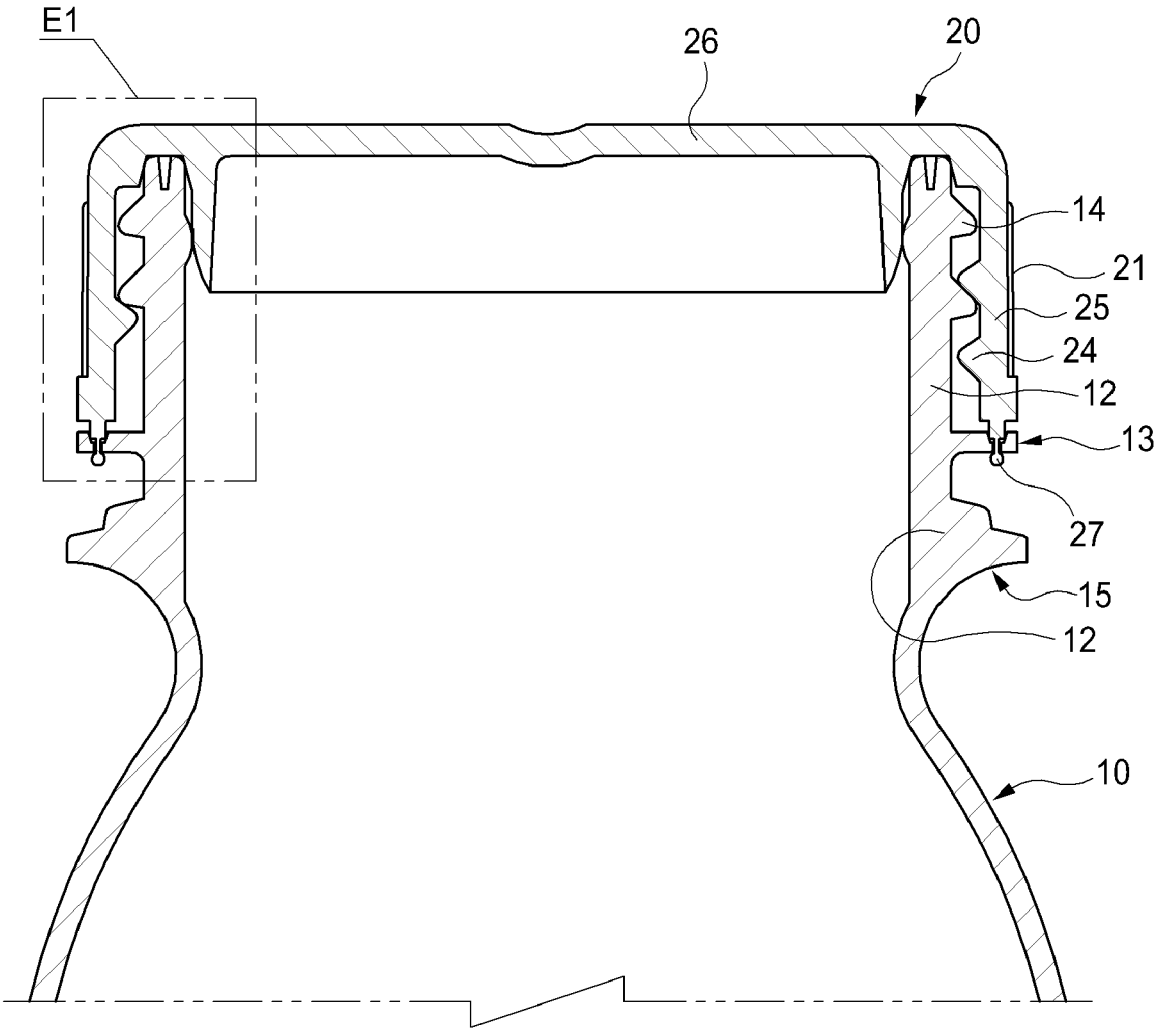
FIG. 12 is a cross-sectional view illustrating a container according to a fifth embodiment of the present invention.
Figure 13:
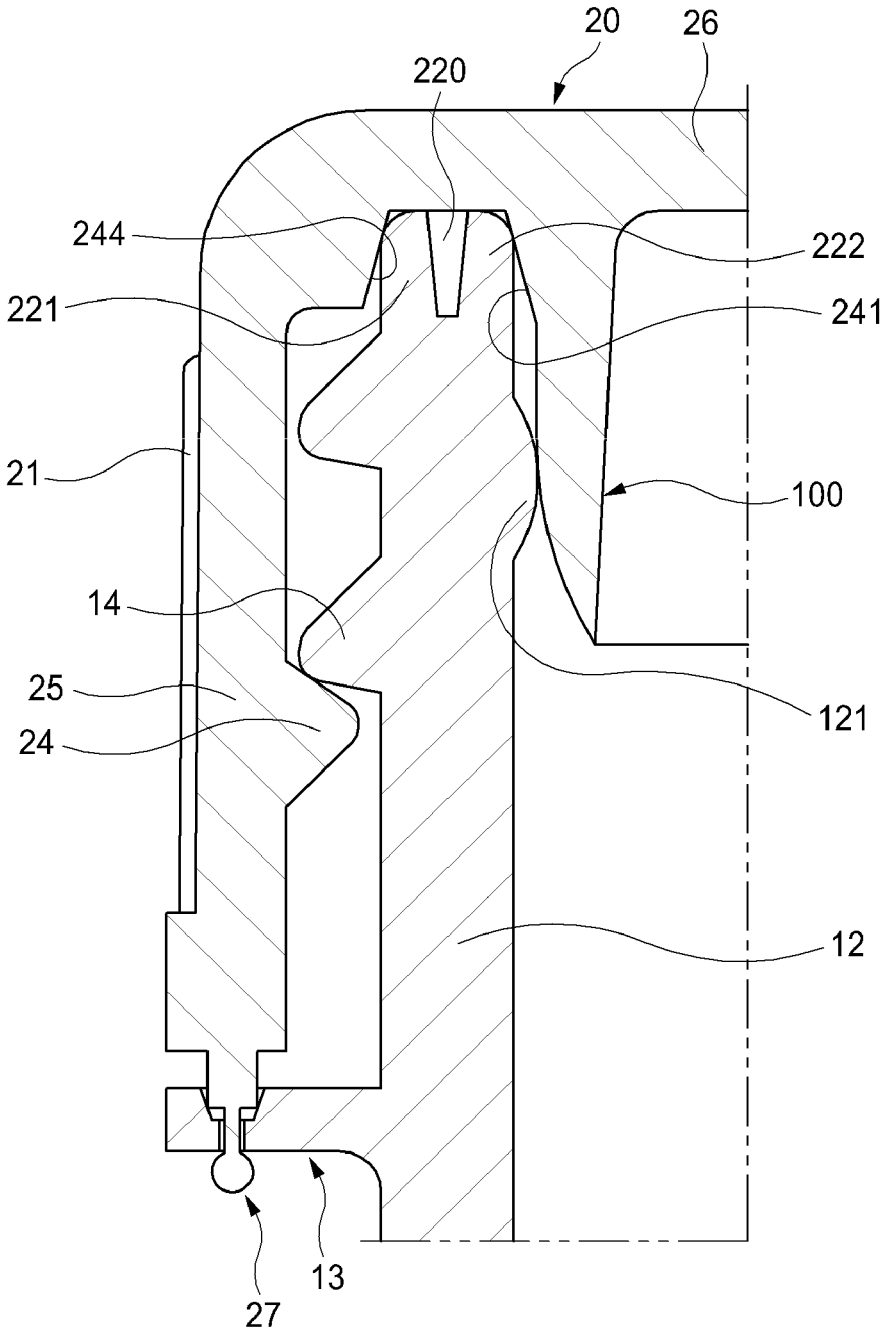
FIG. 13 is an enlarged cross-sectional view illustrating portion E1 of FIG. 12.

As a fifth example illustrated in FIG. 11E, a portion from the upper end of the container inlet 12 to the inner circumferential protruding part 121 in the structure of FIG. 11D may be inclinedly formed.

Specifically, in the container inlet 12, the inner circumferential surface may be inclined from the upper end to the inner circumferential protruding part 121 in a direction in which the internal diameter is decreased.

Due to the above-described structure, the outer circumferential surface of the auxiliary ring 190 may closely contact a portion between the upper end of the container inlet 12 and the inner circumferential protruding part 121 when the container cap 20 is combined with the container inlet 12 or when the container cap 20 is descended to the container inlet 12.

Fifth Embodiment

The present invention may include various embodiments of intentionally increasing the portion closely contacting each other when the container cap 20 is combined with the container inlet 12 to improve the sealing force of the container.

Particularly, when the contact portion in which the upper end of the container inlet 12 contacts the container cap 20 is improved, the sealing force of the container may be improved.

As illustrated in FIGS. 12 to 15, in the container according to the fourth embodiment of the present invention, a recessed groove 220 may be formed between and by an inner upper end 222 and an outer upper end 221 of the container inlet 12, and an inner inclined surface 241 and an outer inclined surface 242 respectively contacting an inner portion of the inner upper end 222 and an outer portion of the outer upper end 221 may be formed in the container cap 20.

Specifically, the recessed groove 220 may be formed at a center of the upper end of the container inlet 12 by the inner upper end 222 and the outer upper end 221.

Here, the inner portion of the inner upper end 222 and the outer portion of the outer upper end 221 may each have a curved surface shape to respectively closely contact the inner inclined surface 241 and the outer inclined surface 242.

Also, sidewalls of the recessed groove 220 may be inclined upward so that upper ends of the inner upper end 222 and the outer upper end 221 are deformed in a direction in which a width of the recessed groove is decreased, i.e., the inner upper end 222 and the outer upper end 221 are contracted toward each other.

In other words, the inner upper end 222 and the outer upper end 221 may have a 'V'-shape.

The container cap 20 has the inner inclined surface 241 and the outer inclined surface 242, which respectively contact an inner portion of the inner upper end 222 and an outer portion of the outer upper end 221.

The inner inclined surface 241 and the outer inclined surface 242 may have various structures to respectively contact the inner portion of the inner upper end 222 and the outer portion of the outer upper end 221 as a portion formed in the container cap 20.

For example, as illustrated in FIGS. 12 to 15, the inner inclined surface 241 may be formed as a portion of the inner ring 100.

Also, the inner inclined surface 241 may be formed as a portion of an auxiliary inner ring 190 when the auxiliary inner ring 190 is provided.

In the embodiments of the present invention in addition to the fifth embodiment, all of the screw-type combining structure and the snap-type combining structure (e.g., the one-piece and two-piece one touch cap and the undercut cap structure) may be applied to the container cap 20 and the container inlet 12.

Figure 14:
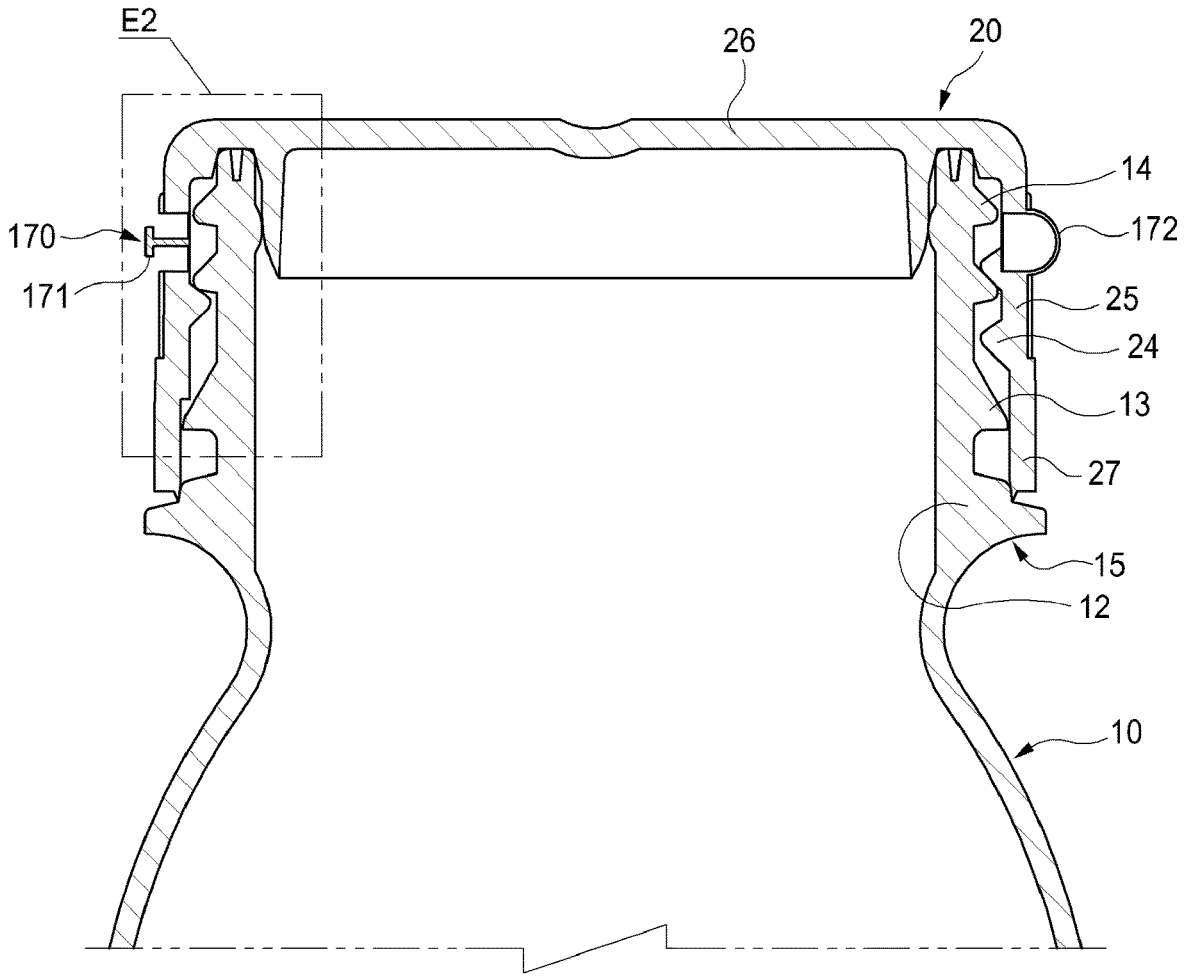
FIG. 14 is a cross-sectional view illustrating a modified example of the container of FIG. 12.
Figure 15:
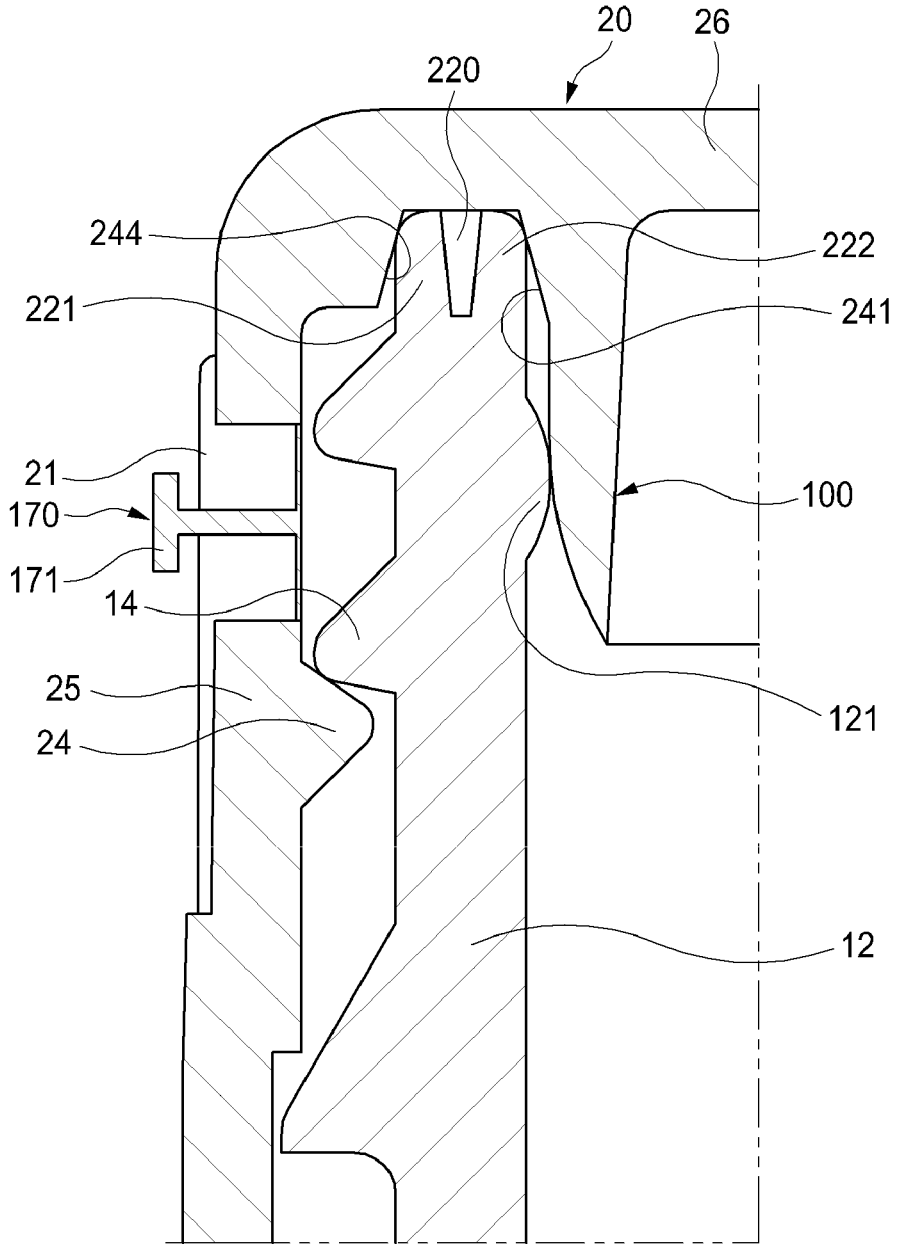
FIG. 15 is an enlarged cross-sectional view illustrating portion E2 of FIG. 14.

As illustrated in FIGS. 14 and 15, the container according to the embodiments including the fifth embodiment of the present invention may adopt the container cap in which the body part 26 is rotated around a portion of the wall part 25 by using a hinge.

Specifically, in the container cap 20, a portion of the wall part 25 may be cut in the circumferential direction by a cut part 170 formed on the wall part 25 as illustrated in FIGS. 14 and 15. Here, a portion of the wall part 25, which is not cut, may form a hinge portion 172 disposed at the right side in FIG. 15.

The reference numeral 171 that is not described indicates a handle installed to easily separate the cut part 170 from the wall part 25.

The structure in FIGS. 12 to 15 according to an embodiment may be variously deformed such that, e.g., components corresponding to each other of the container cap 20 and the container inlet 12 may be exchanged.

Figure 16:
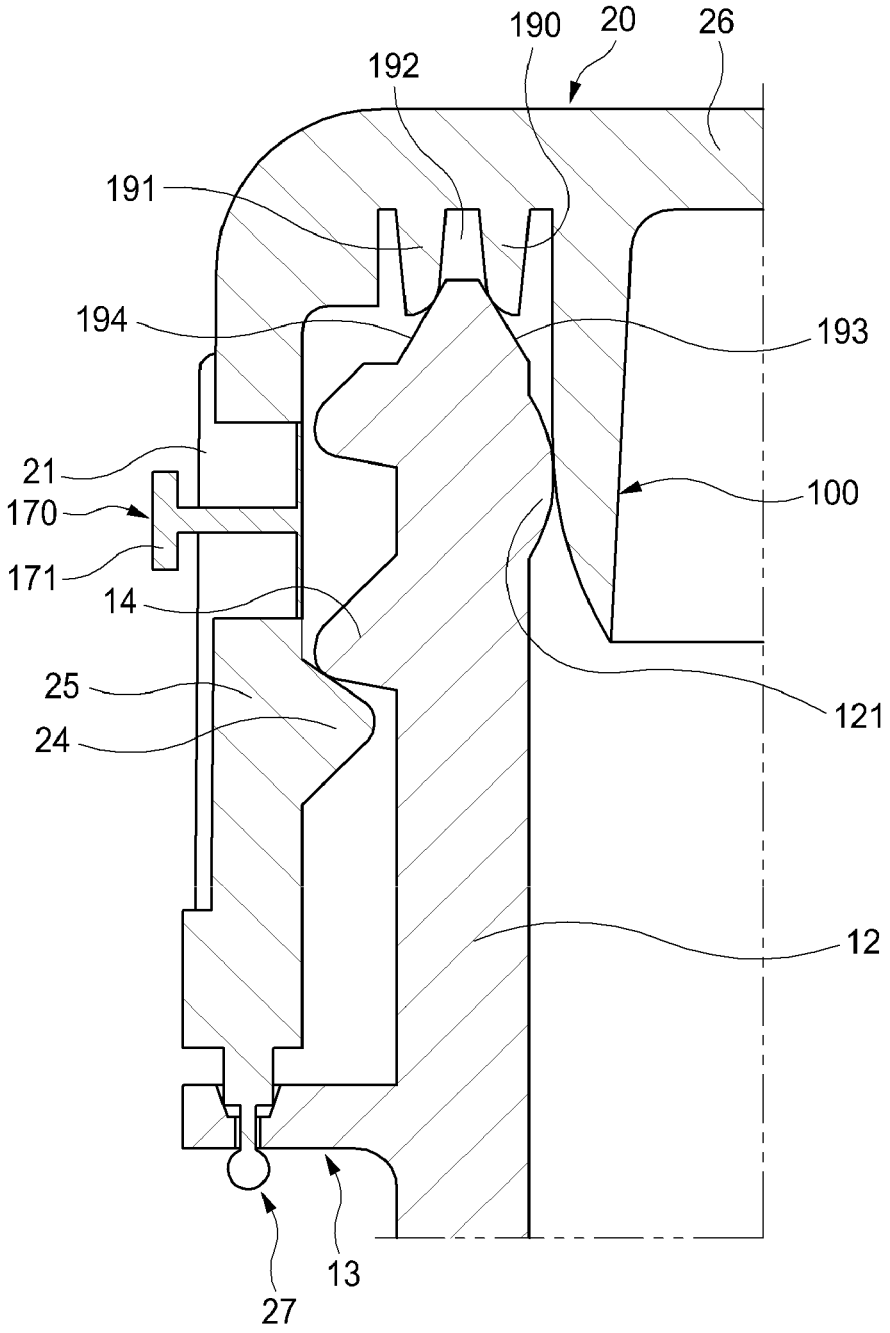
FIG. 16 is an enlarged cross-sectional view illustrating a modified example of FIG. 13.
Figure 17:
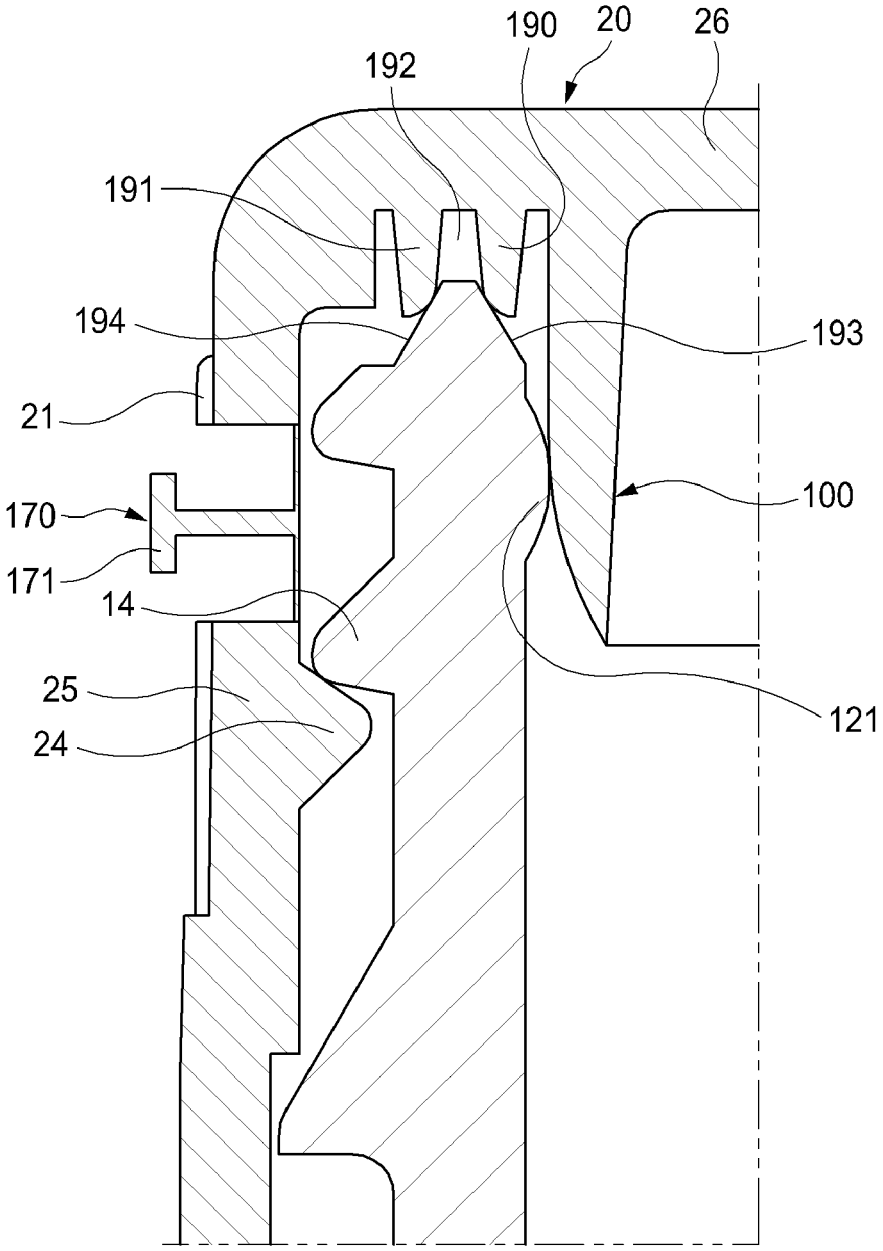
FIG. 17 is an enlarged cross-sectional view illustrating a modified example of FIG. 15.

Specifically, as illustrated in FIGS. 16 and 17, in the container cap 20, an inner contact ring 190 and an outer contact ring 191 may be formed by forming an opposed recessed groove 192 so that at least a portion of the upper end of the container inlet 12 is inserted therebetween.

The inner contact ring 190 and the outer contact ring 191 may have various configurations as components formed by forming the opposed recessed groove 192 so that at least a portion of the upper end of the container inlet 12 is inserted therebetween.

For example, each of the inner contact ring 190 and the outer contact ring 191 may extend downward from the bottom surface of the body part 26.

Here, a portion contacting the upper end of the container inlet 12 of each of the inner contact ring 190 and the outer contact ring 191 may have a curved surface shape.

Also, the sidewalls of the opposed recessed groove 192 may be inclined upward so that lower ends of the inner contact ring 190 and the outer contact ring 191 are deformed in a direction in which a width of the opposed recessed groove 192 is increased, i.e., the inner contact ring 190 and the outer contact ring 191 are spaced apart from each other.

In other words, the inner contact ring 190 and the outer contact ring 191 may have a reverse 'V'-shape.

The upper end of the container inlet 12 may have a sharp shape to be easily inserted to the opposed recessed groove 192 formed by the inner contact ring 190 and the outer contact ring 191.

Also, the upper end of the container inlet 12 may form inclined surfaces 193 and 194 extending inward and outward from an uppermost end so as to be easily inserted to the opposed recessed groove 192.

The container in FIG. 16 includes the cut part 170 described above as a modified example of the container in FIG. 15.

Embodiments, particularly the first and second embodiments, may be applied to the fifth embodiment of the present invention except for conflicted portion (the inner circumferential protruding part 121 in FIG. 3 and the structure in FIG. 4B or 5B).

Sixth Embodiment

Referring to the above-described embodiments, as a unit for increasing the sealing force of the container, the contact portion in which the container cap 20 contacts the container inlet 12 may be increased, and particularly the contact portion between the upper end of the container inlet 12 and the container cap 20 may be relatively increased.

Here, the plurality of contact portions may be formed along the path from the outside to the inside of the container instead of being connected to each other.

Particularly, the plurality of contact portions may be formed by structural deformation of the container inlet 12 and the container cap 20 and realized by forming the inclined surfaces having various angles and structures and the flexibility applying groove.

Also, the plurality of contact portions may be deformed in structure by exchanging the structures of the container inlet 12 and the container cap 20.

Hereinafter, various deformation of the container inlet 12 for forming the plurality of contact portions along the path from the outside to the inside of the container will be described.

Figure 18A:
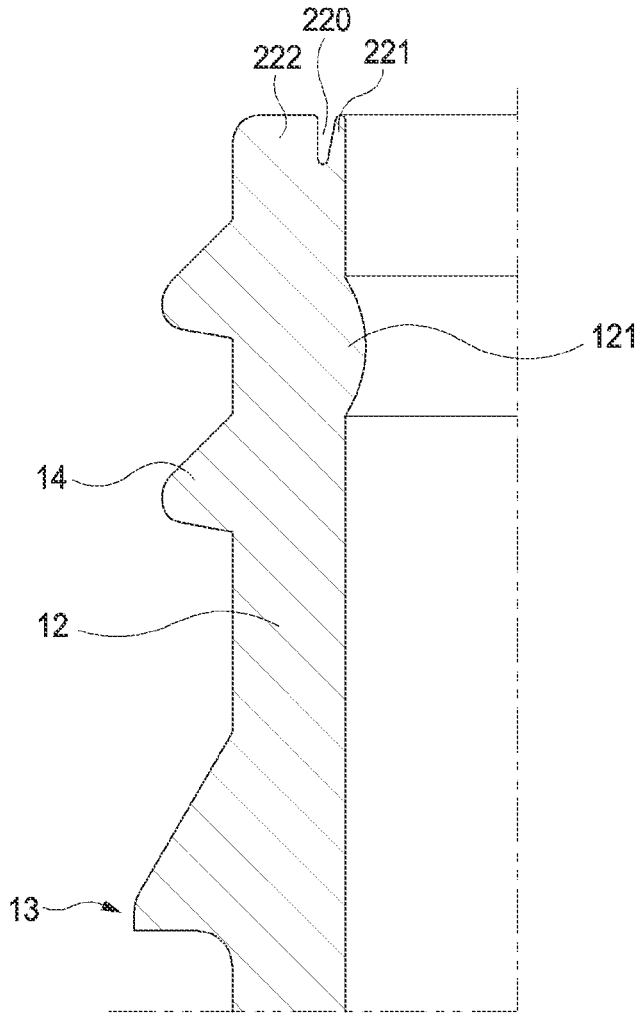
FIGS. 18A to 18H are partial cross-sectional views illustrating examples of a structure of a container inlet used for the container according to the present invention.

As illustrated in FIG. 18A, the container inlet 12 may be formed such that an inner upper end 222 and an outer upper end 221 are formed by using a recessed groove 220 as a center in the upper end thereof.

Here, as the recessed groove is formed adjacent to the inner side or the outer side, one of the inner upper end 222 and the outer upper end 221 may have a width greater than that of the other so as to be easily deformed when one of the inner upper end 222 and the outer upper end 221 contacts the container cap 20.

Also, the inner upper end 222 and the outer upper end 221 may have the same height or different heights.

FIG. 18*a* illustrates a case when the inner upper end 222 has a width less than that of the outer upper end 221.

Also, the recessed groove 220 may have a width that is gradually increased in a direction toward the upper side.

Figure 18B:
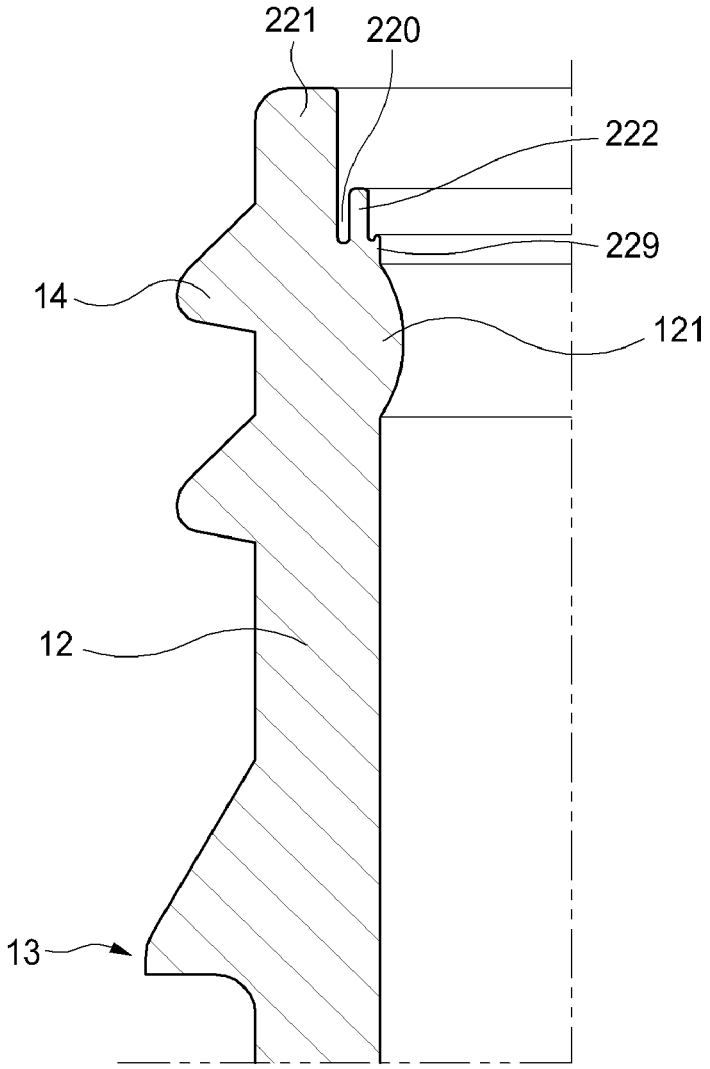

FIG. 18B is a modified example of the container inlet 12 in FIG. 18A.

The container inlet 12 in FIG. 18B may be formed such that the inner upper end 222 has a height less than that of the outer upper end 221.

Furthermore, a minute ring projection 229 may be formed on the inner circumferential surface to increase a contact portion with the container cap 20.

Figure 18C:
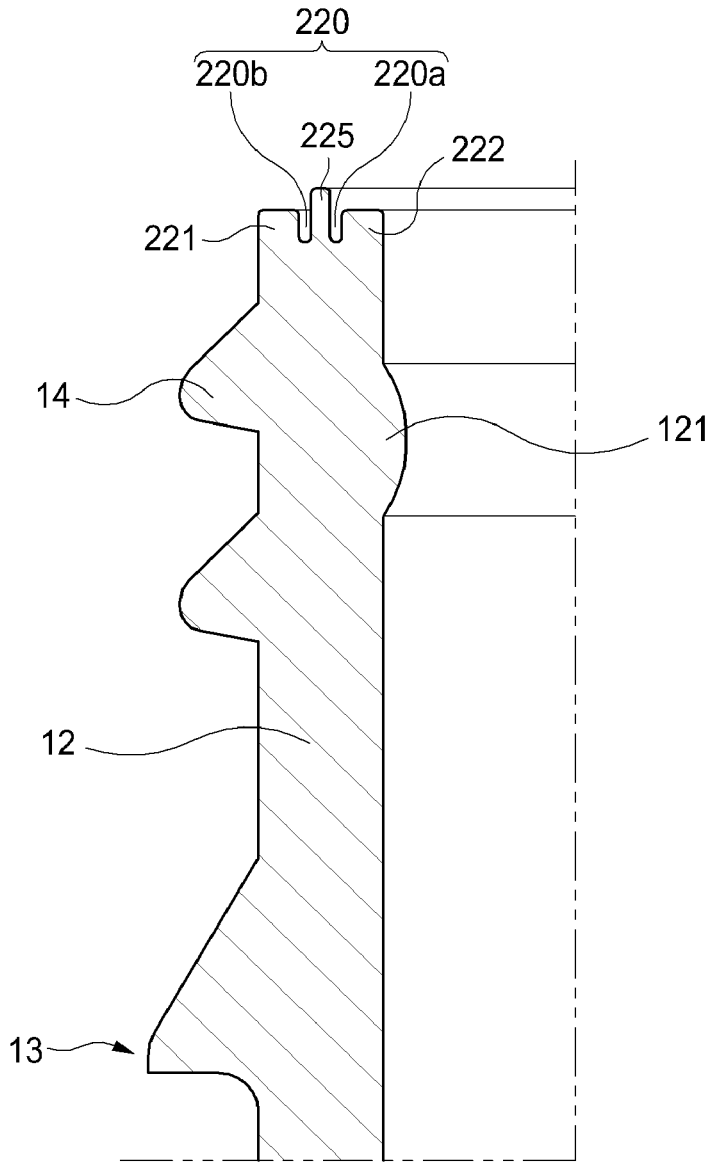

FIG. 18C is a modified example of the container inlet 12 in FIG. 18A.

The container inlet 12 in FIG. 18C may be formed such that a central protruding upper end 225 protruding upward from the recessed groove 220 is additionally formed.

Particularly, the central protruding upper end 225 may have a height greater than that of each of the inner upper end 222 and the outer upper end 221, and the recessed groove 220 may include two divided recessed grooves 220*a* and 220*b*.

Here, the container cap 20 combined with the container inlet 12 may include a ring-shaped groove to which the central protruding upper end 225 is inserted.

Figure 18D:
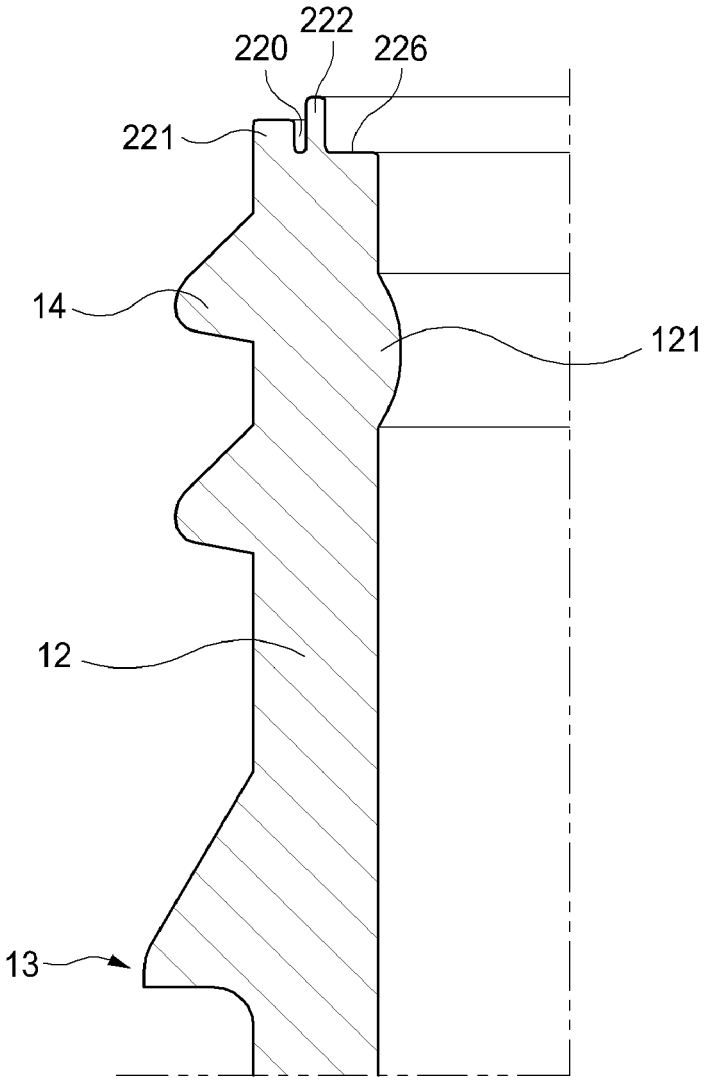

FIG. 18D is a modified example of the container inlet 12 in FIG. 18A.

The container inlet 12 in FIG. 18D may be formed such that an inner upper end 222 is higher than an outer upper end 221 and has a width less than that of the outer upper end 221, and a stepped portion 226 smaller than each of the inner upper end 222 and the outer upper end 221 is formed.

Figure 18E:
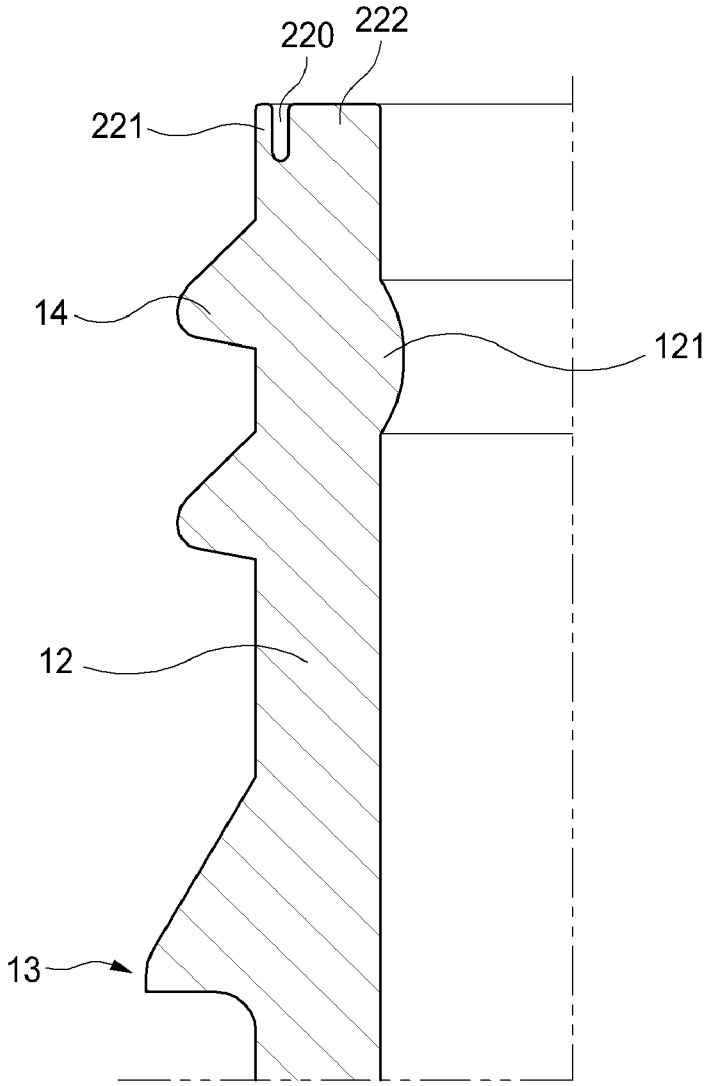

FIG. 18E is a modified example of the container inlet 12 in FIG. 18A.

The container inlet 12 in FIG. 18E may be formed such that an outer upper end 221 has a width less than that of an inner upper end 222 as an opposite case of FIG. 18*a*.

FIGS. 18A and 18D illustrate a structure in which the inner upper end 222 or the outer upper end 221, which has a relatively small width, has a blocking structure deformed by pressing of the container cap 20 or filling of hot contents, and the container inlet 12 may have a whole or a portion of the structures in FIGS. 18E, 18F, 18G, 21A, 21B, 21C, 26A, and 26B in addition to the structures in FIGS. 8A and 8B of the third embodiment.

Figure 18F:
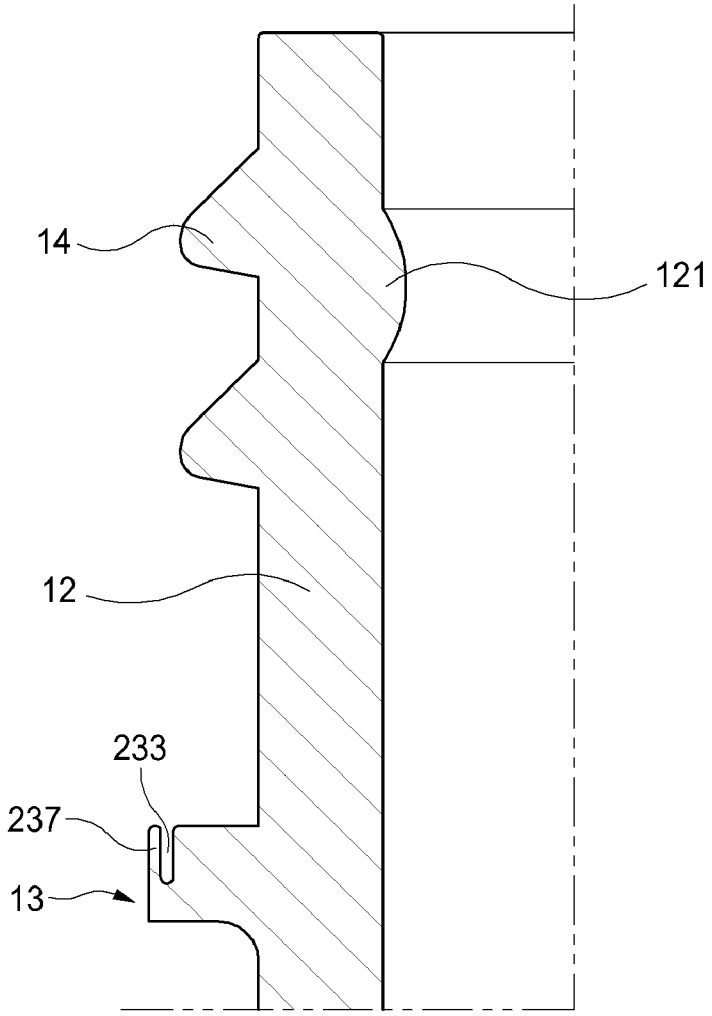

That is, as illustrated in FIGS. 18D and 18F, the flexibility applying groove 233 may be formed in the outer circumferential surface, particularly the scut combining projection 13, of the container inlet 12.

Here, the flexibility applying groove 233 pressed by the container cap 20 may be recessed from the upper side to the lower side of the scut combining projection 13.

Here, the flexibility applying groove 233 may be relatively formed by a groove formation projection ring 237 extending upward.

Figure 18G:
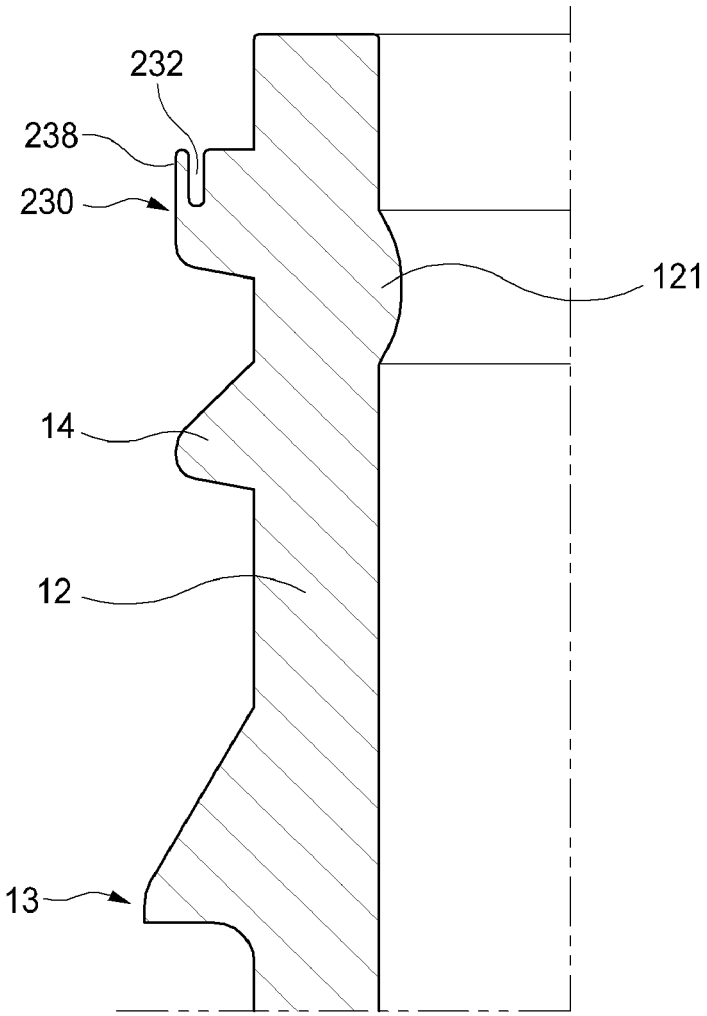
Figure 18H:
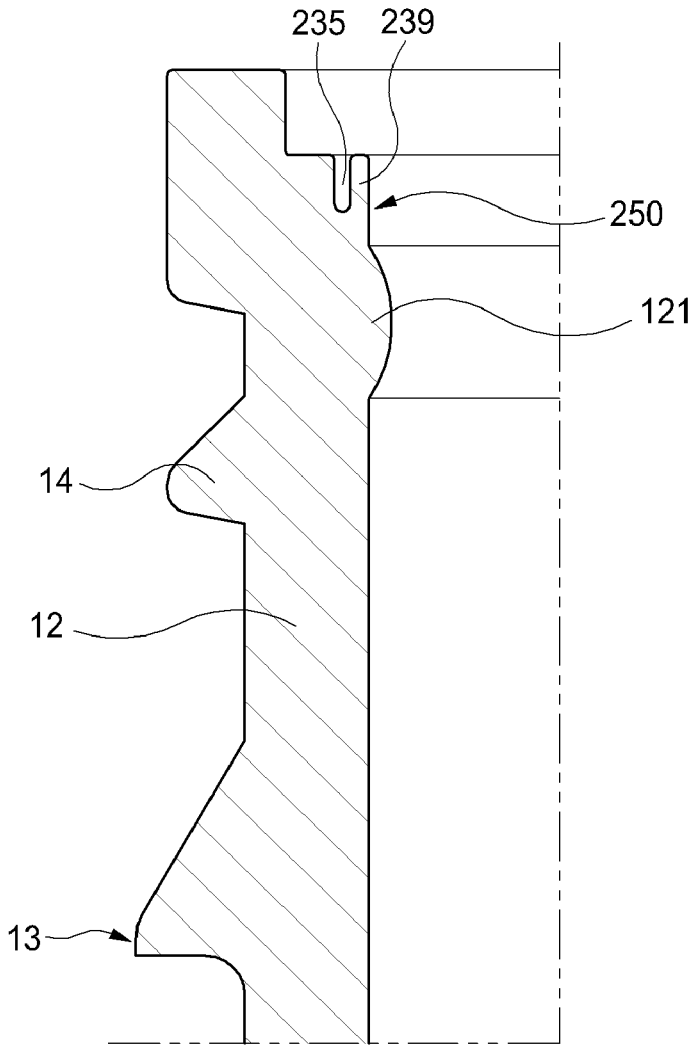

As illustrated in FIGS. 18*g* and 18*h*, the flexibility applying groove may be formed in the outer circumferential surface or the inner circumferential surface between the scut combining projection 13 and the upper end of the container inlet 12.

That is, as illustrated in FIGS. 18C and 18G, the flexibility applying groove 232 may be formed in the outer circumferential surface of the container inlet 12.

Here, a ring-shaped flexibility applying projection 230 may be formed on the outer circumferential surface of the container inlet 12 to form the flexibility applying groove 232 pressed by the container cap 20, and the flexibility applying groove 232 may be recessed from the upper side to the lower side of the flexibility applying projection 230.

Here, the flexibility applying groove 232 may be relatively formed by a groove formation projection ring 238 extending upward.

For another example, as illustrated in FIG. 18H, a flexibility applying groove 235 may be formed in the inner circumferential surface of the container inlet 12.

Here, a ring-shaped flexibility applying projection 250 may be formed on the inner circumferential surface of the container inlet 12 to form the flexibility applying groove 250 pressed by the container cap 20, and the flexibility applying groove 232 may be recessed from the upper side to the lower side of the flexibility applying projection 250.

Here, the flexibility applying groove 235 may be relatively formed by a groove formation projection ring 239 extending upward.

The container cap 20 includes a structure such as the inclined surface or the inner ring for pressing the groove formation projection ring 239.

Hereinafter, various deformation of the container cap 20 for forming the plurality of contact portions along the path from the outside to the inside of the container will be described in addition to the container inlet 12.

Figure 19A:
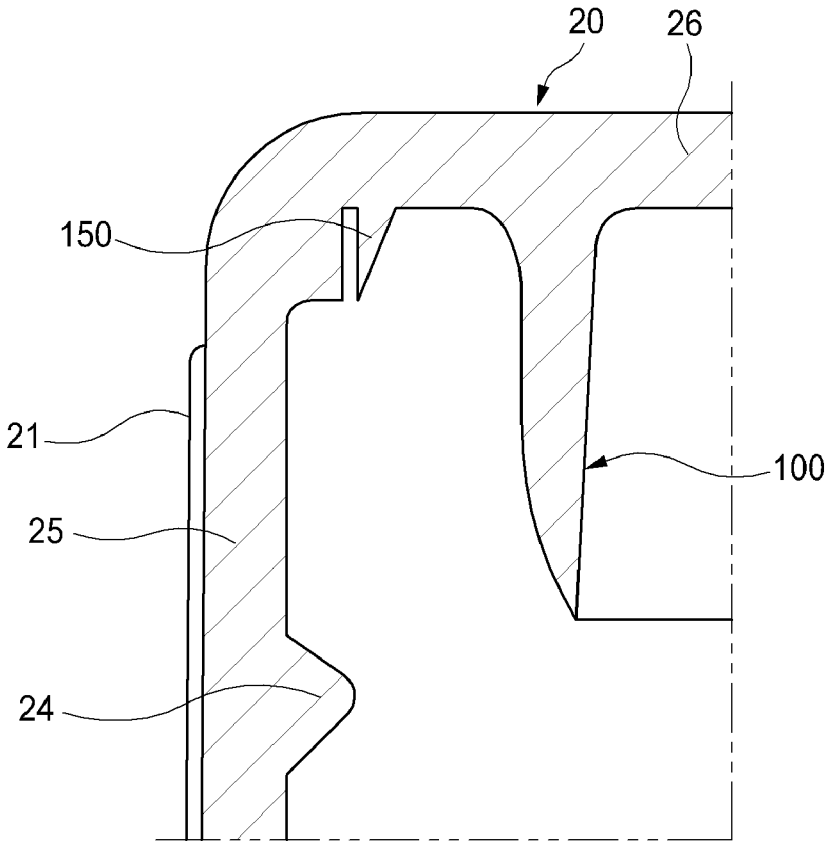
FIGS. 19A to 19C are partial cross-sectional views illustrating examples of a structure of a container cap used for the container according to the present invention.

The container cap 20 in FIG. 19A may have the structure illustrated in FIG. 5C or 8B.

Figure 19B:
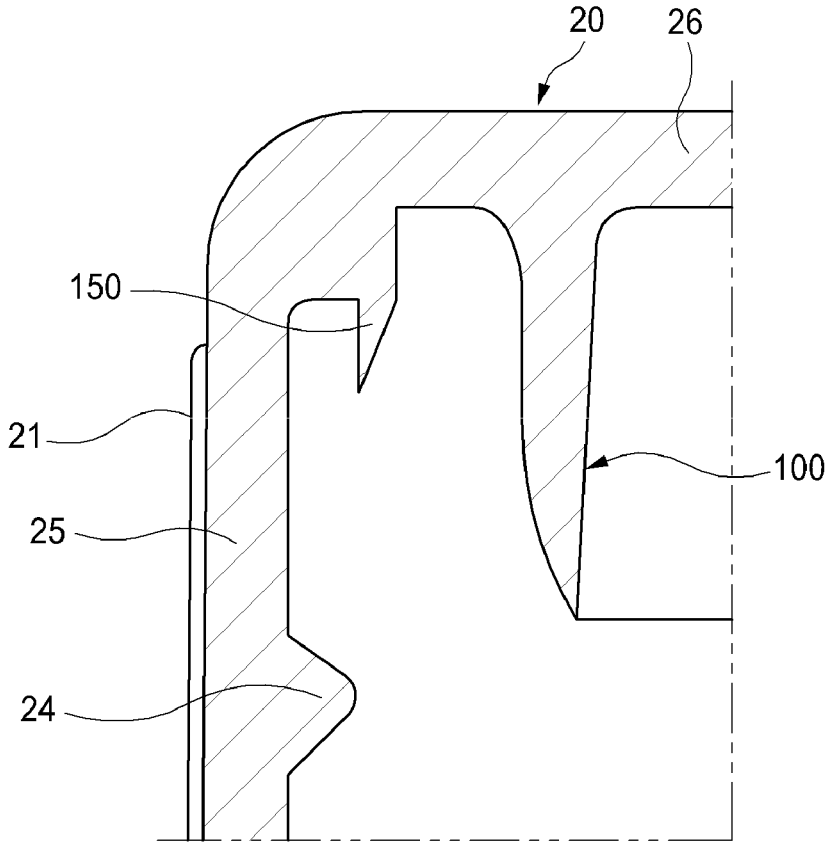

The container cap 20 in FIG. 19B, as a modified example of FIG. 19A, illustrates a case in which a gap between the contact ring 150 and the inner ring 100 is relatively small.

Also, an end of the contact ring 150 may be lower than that of the inner ring 100.

Here, the container inlet 12 may have an inclined surface or a projection ring at a portion contacting the contact ring 150.

Figure 19C:
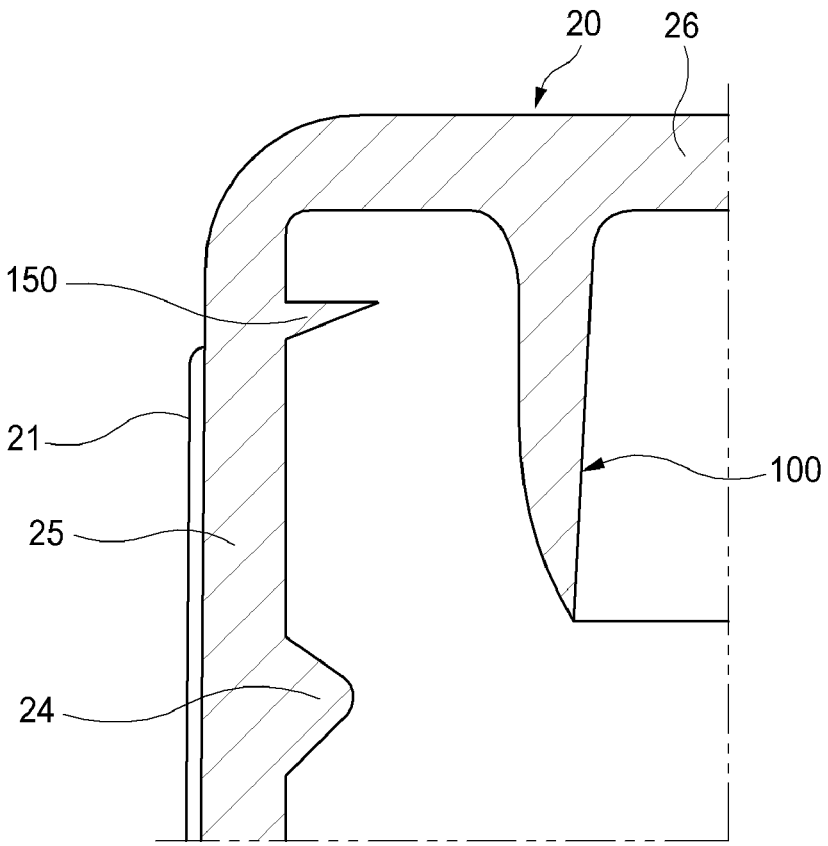

In FIG. 19C, as a modified example of FIG. 19A, the contact ring 150 may protrude from the inner circumferential surface of the sidewall part 25 instead of the bottoms surface of the body part 26.

Here, the container inlet 12 may have an inclined surface or a projection ring at a portion contacting the contact ring 150.

FIGS. 20A to 20D illustrate examples in which the container cap and the container inlet, which have various structures, are combined with each other.

Figure 20A:
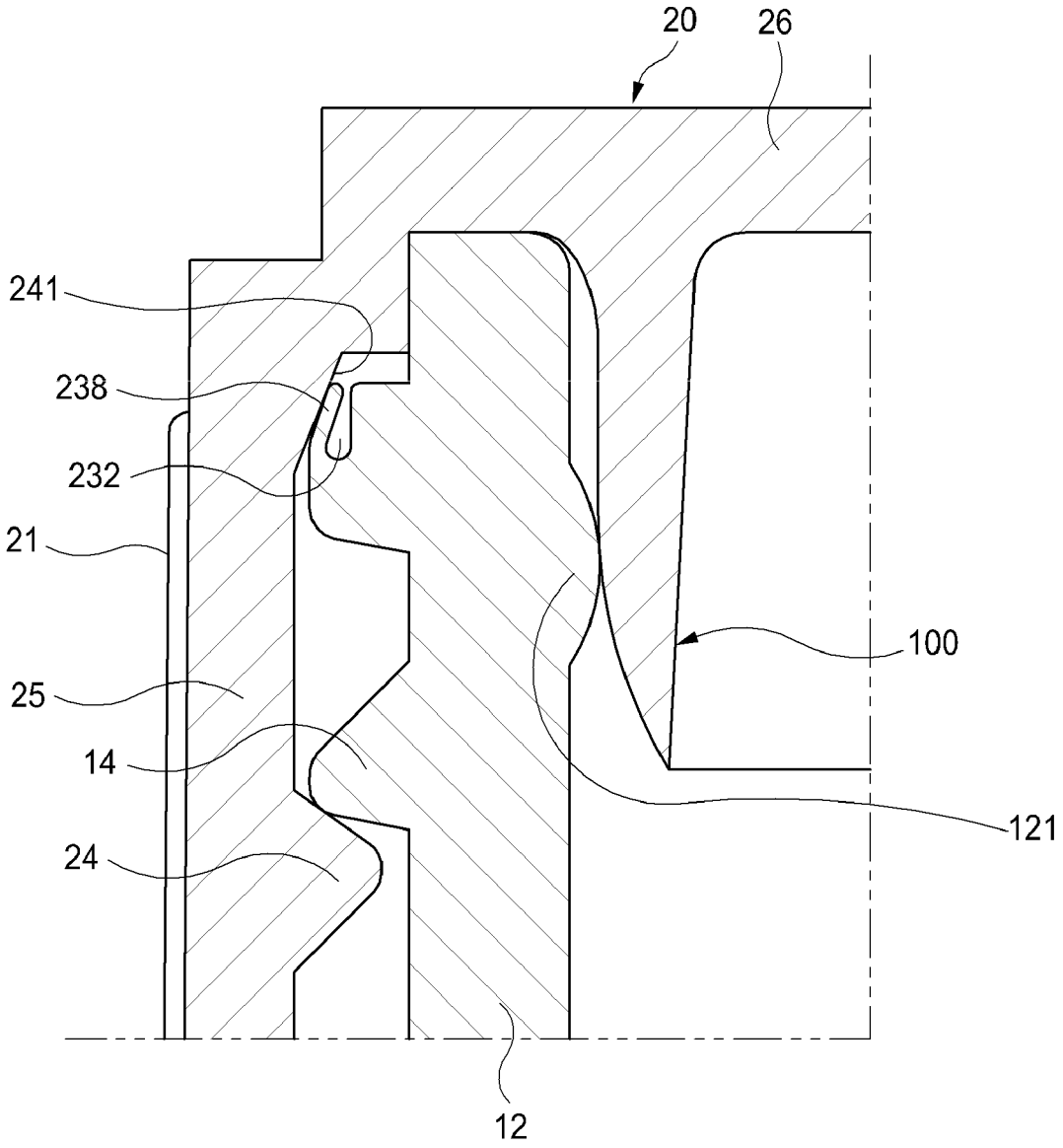
FIGS. 20A to 20D are partial cross-sectional views illustrating examples of structures of the container according to the present invention.

FIG. 20A illustrates an example of a structure in which the container cap is combined with the container inlet in FIG. 18*g*. Since the structure of FIG. 20A is similar to that of FIG. 8C, a detailed description thereof will be omitted.

Figure 20B:
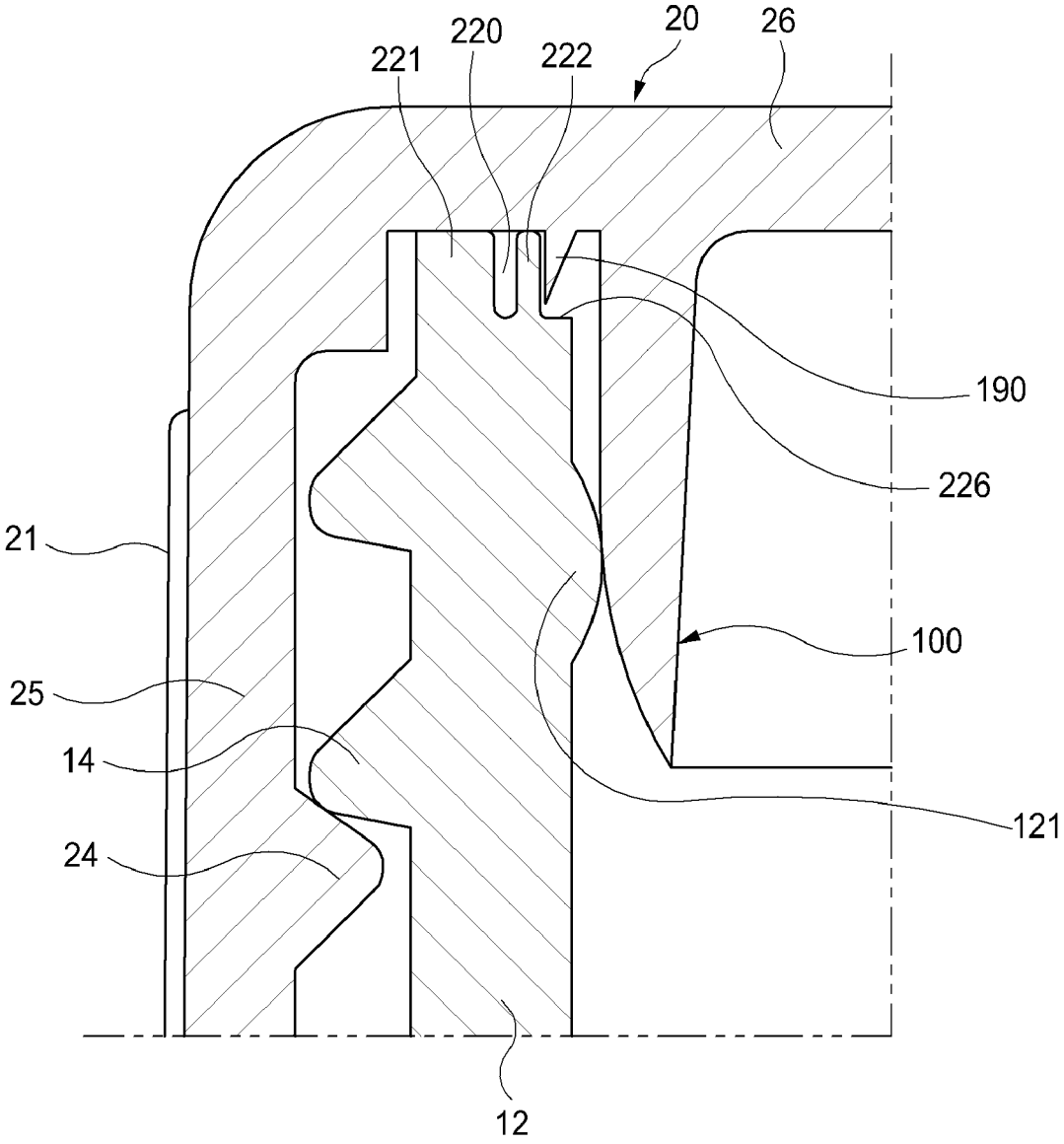

FIG. 20B illustrates a structure in which the container cap having a structure similar to that in FIG. 10A is combined with the container inlet deformed from the structure of FIG. 18A. Since FIG. 20B has a similar structure to that of FIG. 10A, a detailed description thereof will be omitted.

Figure 20C:
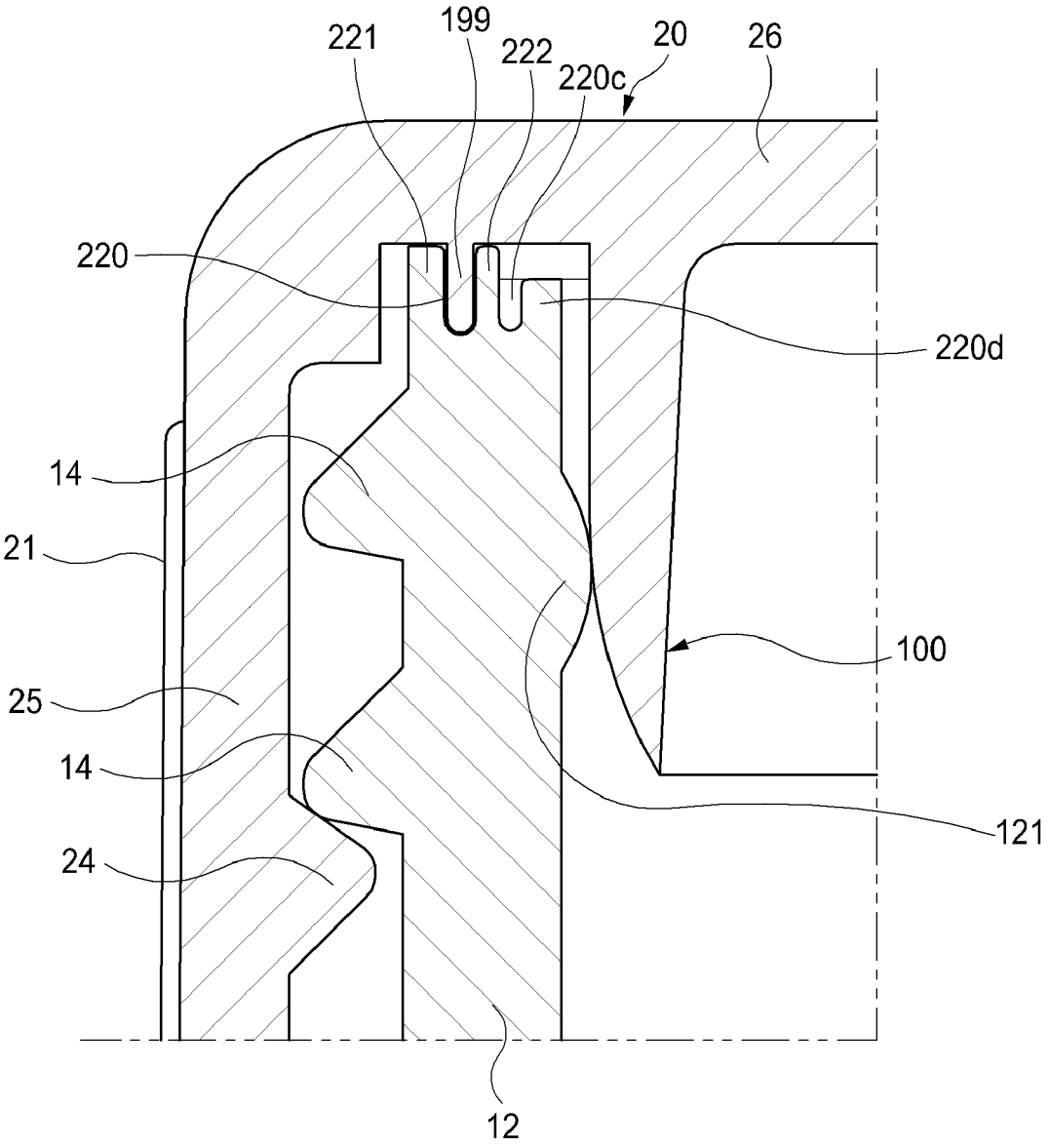

In the container in FIG. 20C, by comparing with the structure of the container according to other embodiments, an inner upper end 222, an outer upper end 221, and an auxiliary upper end may be formed in the upper end of the container inlet 12, and an insertion projection ring 199 inserted to a recessed groove formed by the inner upper end 222 and the outer upper end 221 may be formed on the container cap 20.

Here, as an auxiliary upper end 220*d* having a height less than that of each of the inner upper end 222 and the outer upper end 221 is formed inside the inner upper end 222 of the container inlet 12, an additional recessed groove 220*c* may be formed together with the inner upper end 222.

Figure 20D:
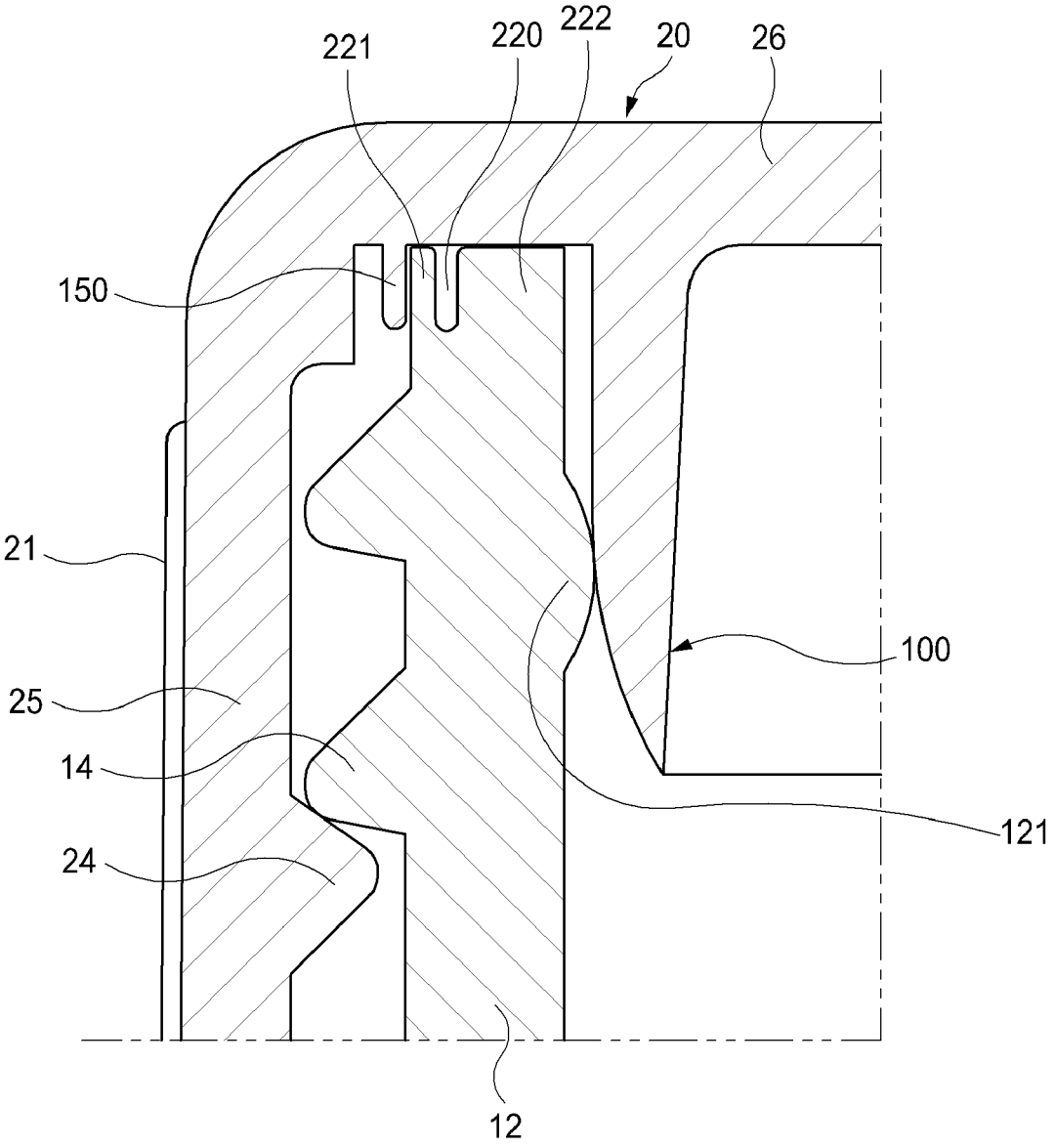

The container in FIG. 20D is substantially same as or similar to that in FIG. 8B except for the shape of the contact ring 150.

Figure 21A:
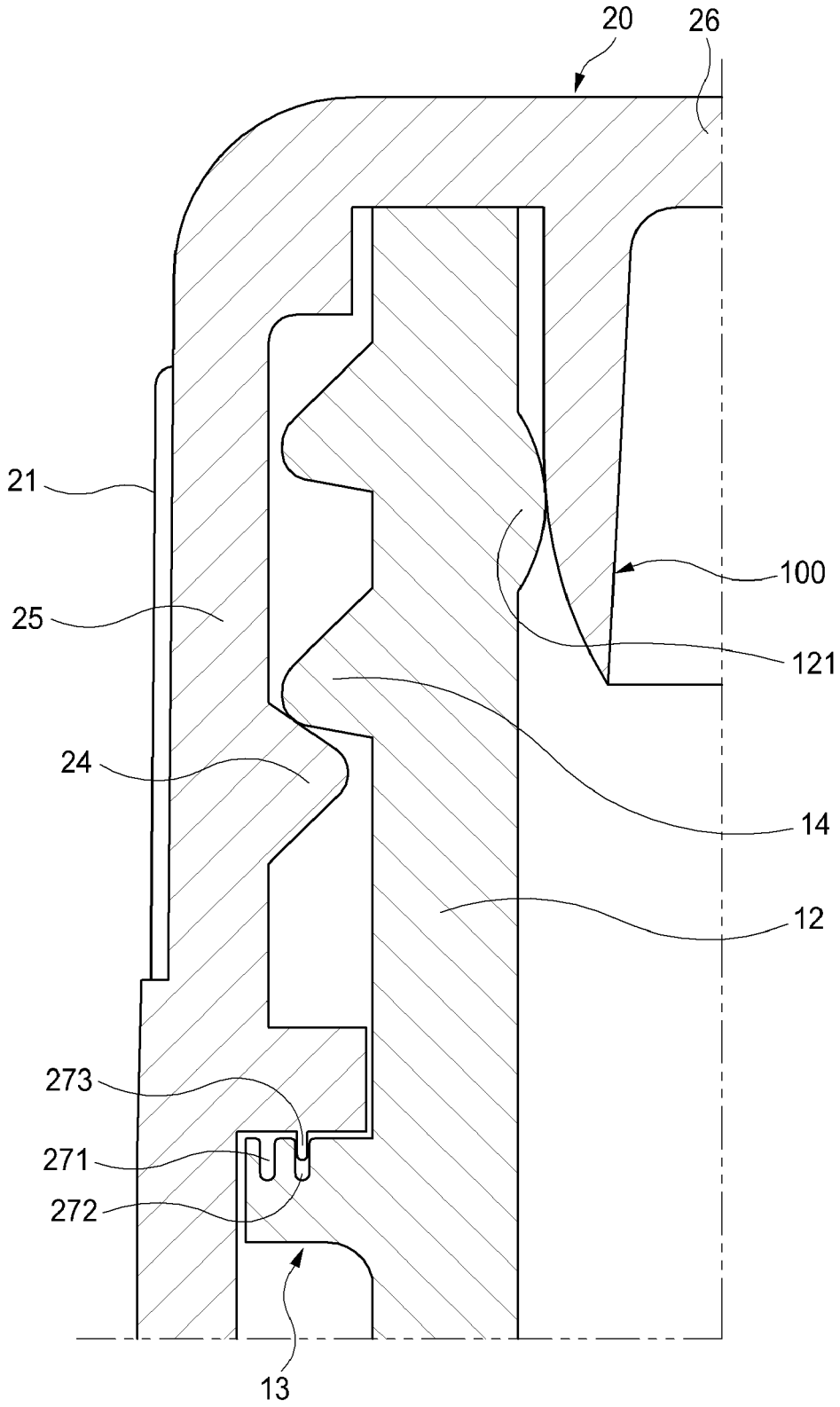
FIGS. 21A to 21C are partial cross-sectional views illustrating examples of structures of the container according to the present invention.

The container in FIG. 21A is characterized in that a plurality of contact portions for blocking external air are formed on a projection formed on the outer circumferential surface of the container inlet 12 such as the scut combining projection 13 and the separation preventing projection 15.

Specifically, at least one recessed groove 271 and 272 is vertically formed in the projection formed on the outer circumferential surface of the container inlet 12 such as the scut combining projection 13 and the separation preventing projection 15, and an insertion projection ring 273 inserted to at least one of the at least one recessed groove 271 and 272 may be formed in the sidewall part 25 of the container cap 20.

As the insertion projection ring 273 is inserted to at least one of the ring-shaped recessed groove 271 and 272 formed in the projection formed on the outer circumferential surface of the container inlet 12 such as the scut combining projection 13 and the separation preventing projection 15, at least one contact portion may be formed.

Figure 21B:
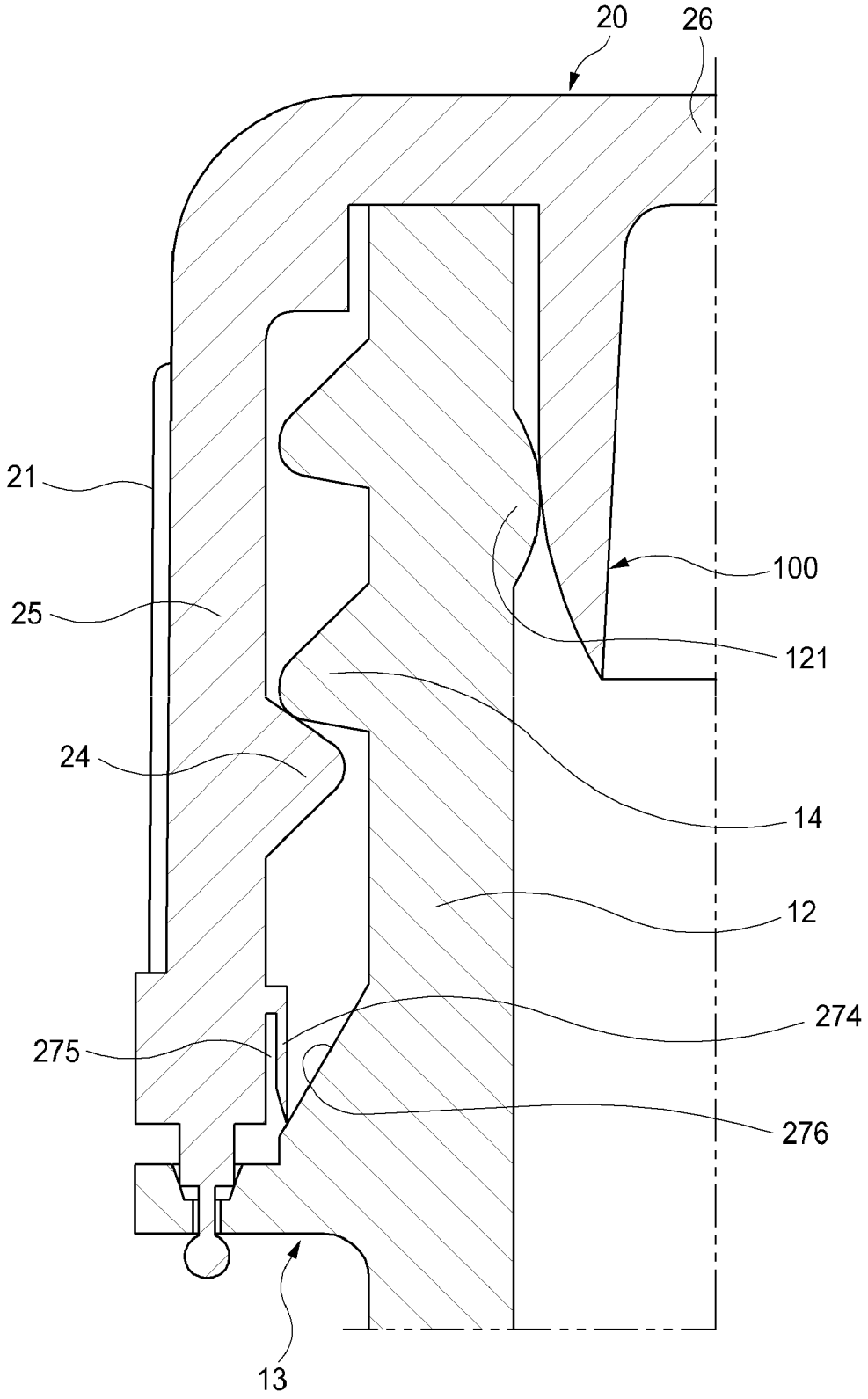

In the container of FIG. 21B, a sealing ring 274 forming a recessed groove 275 defined from the lower side to the upper side may be formed on the inner circumferential surface of the container cap 20. Here, a pressing portion 276 for pressing the sealing ring 274 when the container cap 20 is combined with the container inlet 12 may be formed on the outer circumferential surface of the container inlet 12.

The sealing ring 274 may have various configurations such that, e.g., the sealing ring 274 extends downward while being spaced apart from the inner circumferential surface of the sidewall part 25 of the container cap 20, as a component for forming the recessed groove 275 defined from the lower side to the upper side on the inner circumferential surface of the container cap 20.

Also, the pressing portion 276 may be formed by an inclined surface, as a component formed on the outer circumferential surface of the container inlet 12 to press the sealing ring 274 (strengthen the sealing force) when the container cap 20 is combined with the container inlet 12.

Figure 21C:
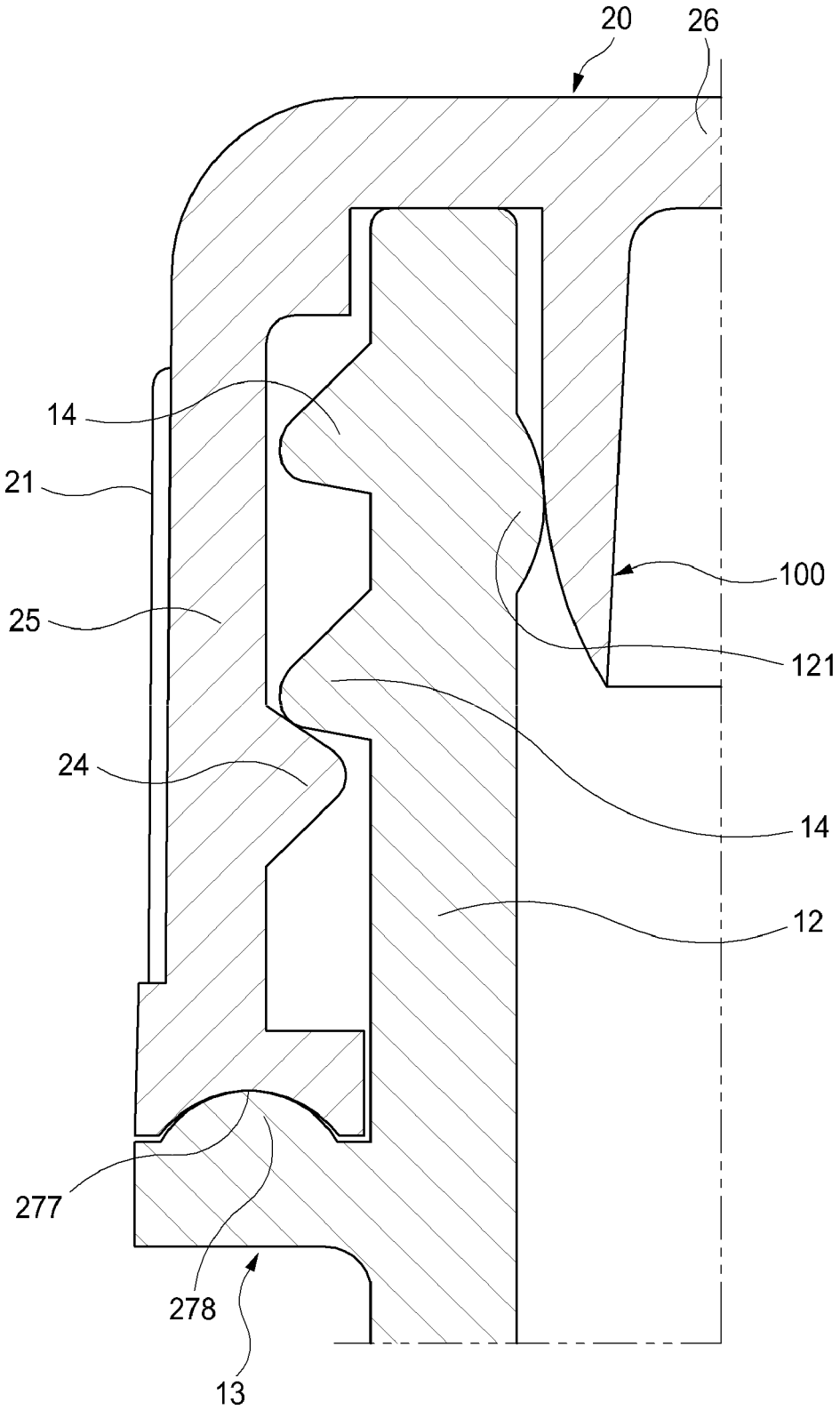

In the container in FIG. 21C, as a modified example of FIG. 21B, at least one protruding part 278 protruding upward from the projection formed on the outer circumferential surface of the container inlet 12 along the circumferential direction in an integrated manner such as the scut combining projection 13 and the separation preventing projection 15 may be formed, and here, an insertion recessed groove ring 277 to which the protruding part 278 is inserted when the container cap 20 is combined with the container inlet 12 may be formed in the container cap 20 at a position corresponding to the protruding part 278.

Seventh Embodiment

The above-described embodiments may have various combinations by combining or replacing each other in a range in which the embodiments are not conflicted.

Also, the container cap may have various structures in addition to the embodiments.

Figure 22:
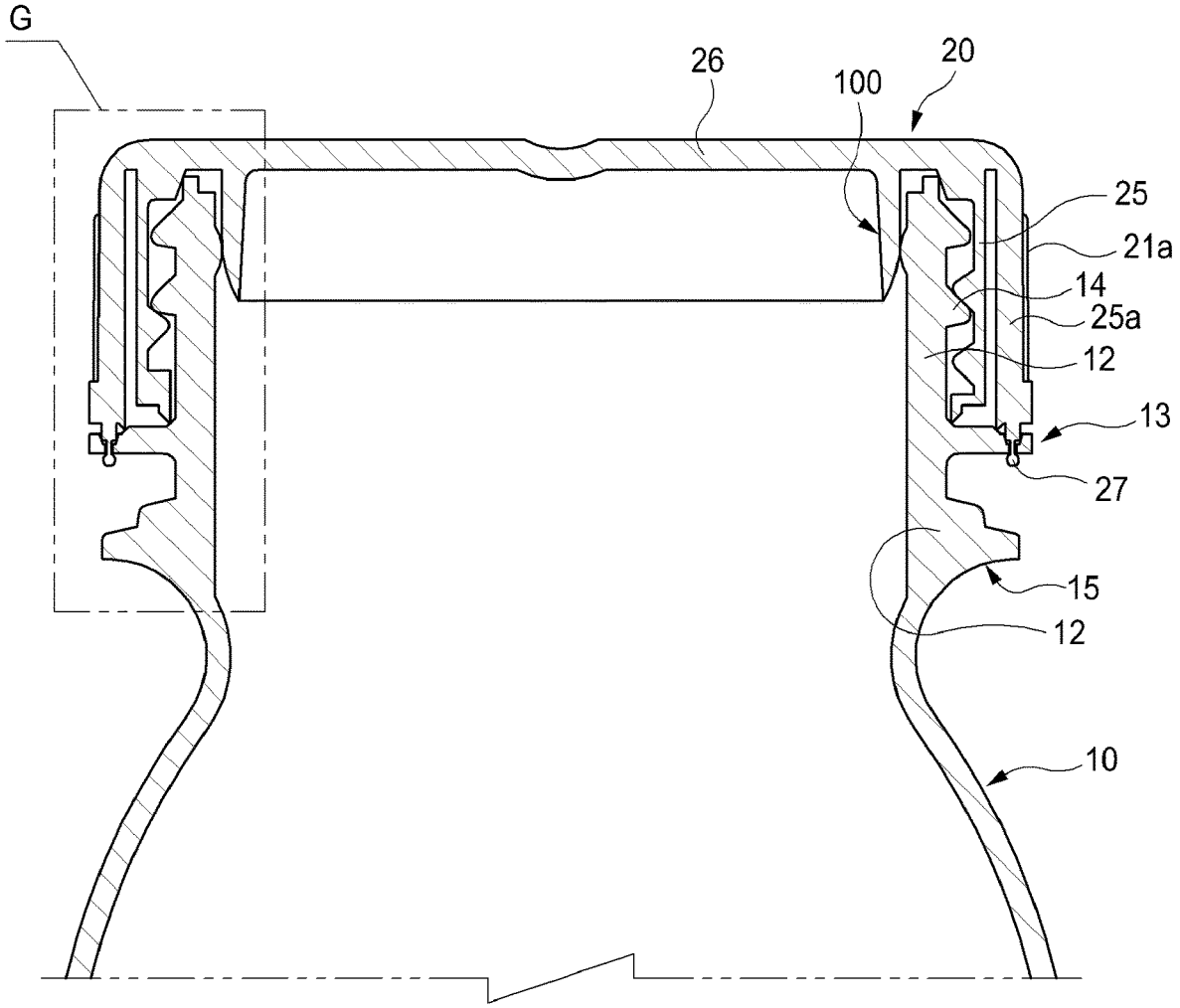
FIG. 22 is a cross-sectional view illustrating a container according to a seventh embodiment of the present invention.
Figure 23:
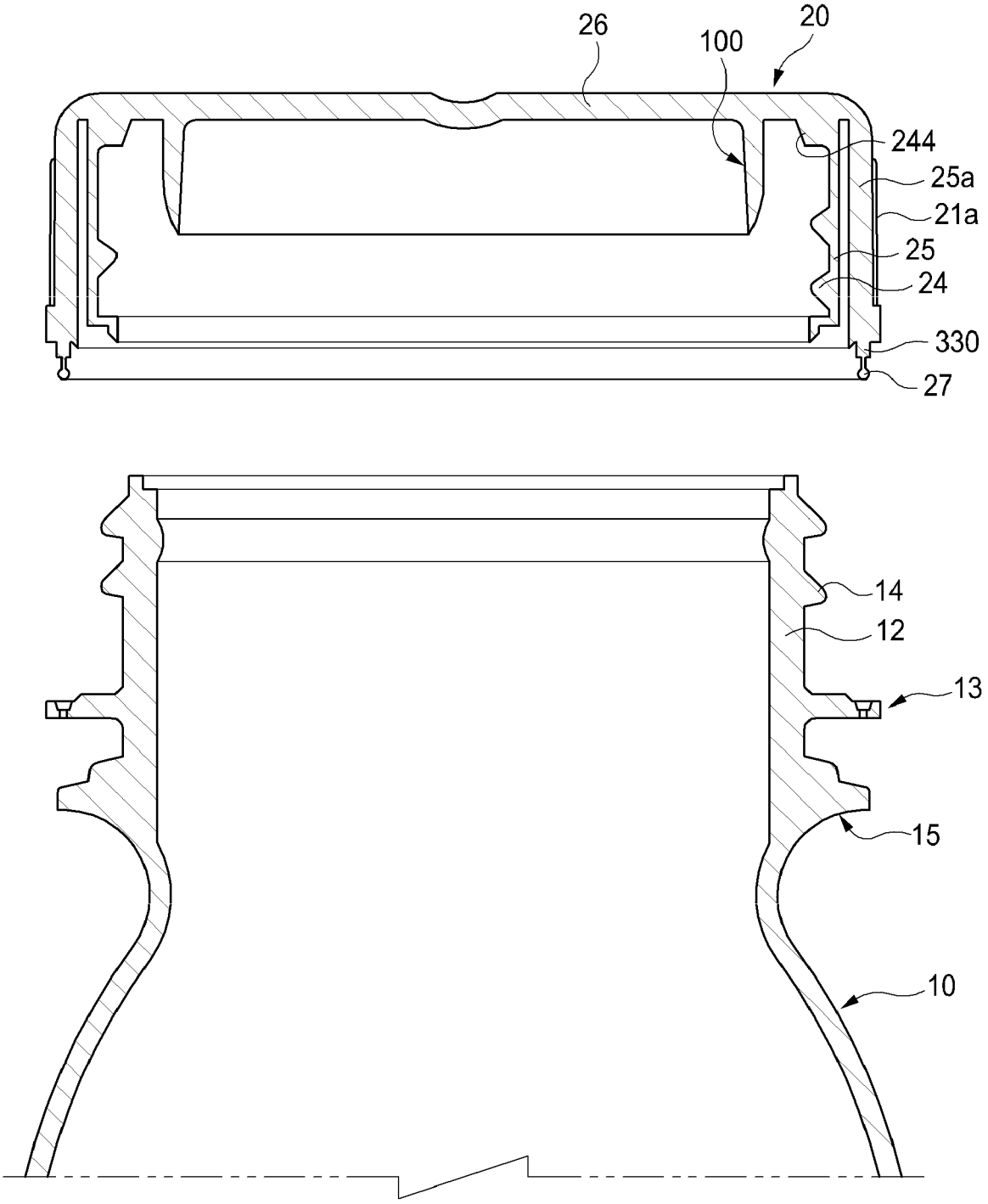
FIG. 23 is a cross-sectional view illustrating a state in which the container cap is separated from the container of FIG. 22.
Figure 24:
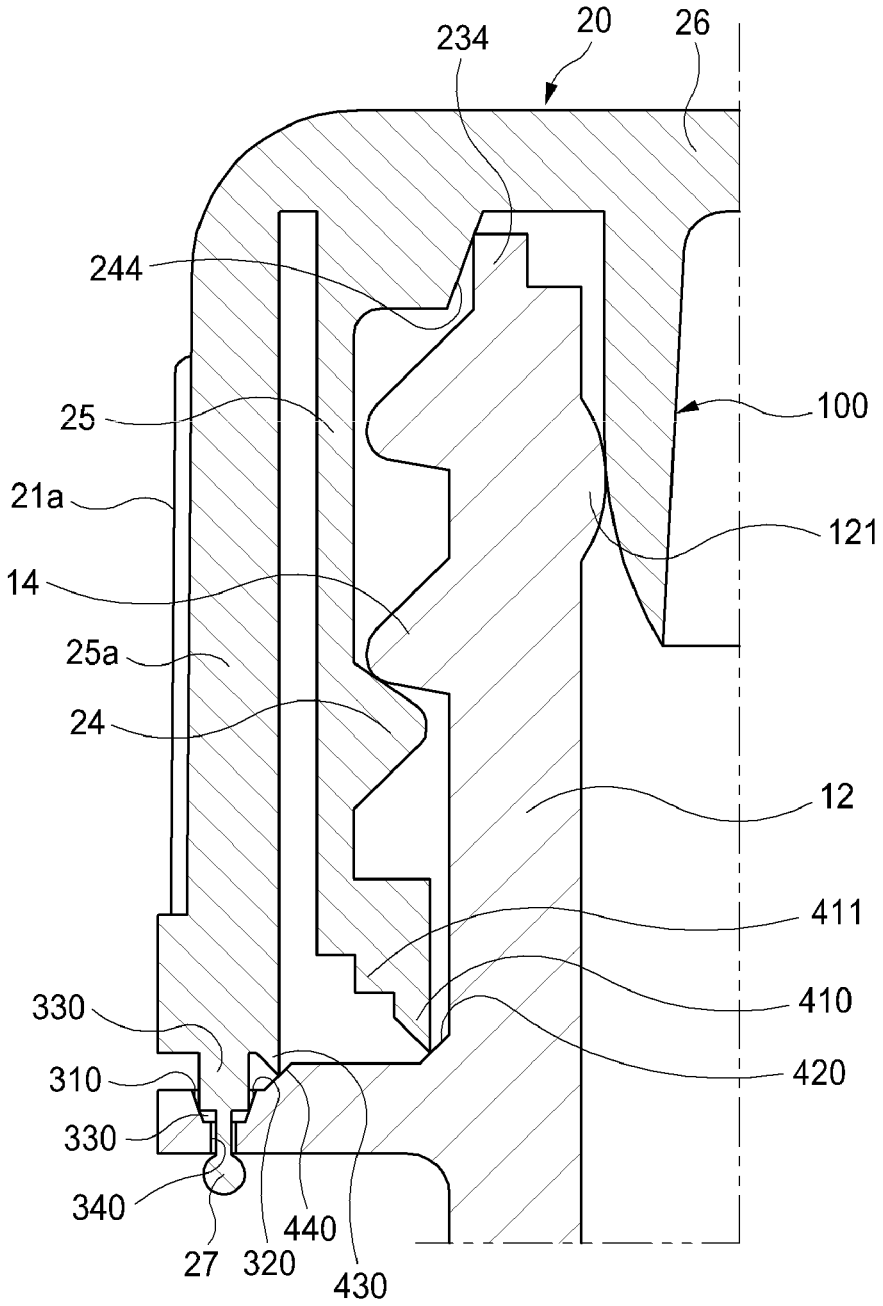
FIG. 24 is an enlarged cross-sectional view illustrating portion G of FIG. 22.

As illustrated in FIGS. 22 to 24, the container according to a seventh embodiment of the present invention may include the double sidewall parts 25 of the container cap 20 and be combined with the above-described embodiments.

Specifically, the container cap 20 may further include an auxiliary sidewall part 25*a* extending downward from the body part 26 while being spaced apart from the outer circumferential surface of the sidewall part 25 extending downward from the body part 26.

The auxiliary sidewall part 25*a* may include a scut part 27 combined with the scut combining projection 13 as a portion extending downward from the body part 26 while being spaced apart from the outer circumferential surface of the sidewall part 25 extending downward from the body part 26.

That is, the auxiliary sidewall part 25*a* may include the scut structure in FIG. 4*b* and the scut structure in FIG. 5B.

A contact projection ring 430 contacting a contact portion 440 formed on the container inlet 12 when the container cap 20 is combined with the container inlet 12 may be formed on the auxiliary sidewall part 25*a*.

The contact projection ring 430 may have various structures as a component contacting the contact portion 440 formed on the container inlet 12 when the container cap 20 is combined with the container inlet 12.

For example, the contact projection ring 430 may form a lower end of the auxiliary sidewall part 25*a* and have a cross-sectional thickness that is relatively small to have flexibility.

Furthermore, the contact projection ring 430 may have a sharp end.

The contact portion 440 may be variously formed, e.g., an inclined surface or a projection, as a portion formed on the container inlet 12 to contact the contact projection ring 410 when the container cap 20 is combined with the container inlet 12.

Particularly, the contact portion 440 may be formed as an inclined surface in the scut combining projection 13.

A contact projection ring 410 contacting a contact portion 420 formed on the container inlet 12 when the container cap 20 is combined with the container inlet 12 may be formed on the sidewall part 25.

The contact projection ring 410 may have various structures as a component contacting the contact portion 420 formed on the container inlet 12 when the container cap 20 is combined with the container inlet 12.

For example, the contact projection ring 410 may form a lower end of the sidewall part 25*a* and have a cross-sectional thickness that is relatively small to have flexibility.

Furthermore, the contact projection ring 410 may have a sharp end.

Also, the contact projection ring 410 may have a cross-sectional thickness that is decreased by a plurality of steps at the lower end of the sidewall part The contact portion 420 may be variously formed, e.g., an inclined surface or a projection, as a portion formed on the container inlet 12 to contact the contact projection ring 410 when the container cap 20 is combined with the container inlet 12.

The contact portion 420 contacting the contact projection ring 410 formed on the sidewall part may be formed above the scut combining projection 13.

As illustrated in FIG. 24, a protruding ring 234 protruding upward may be formed on the upper end of the container inlet 12, and an inclined surface 244 or a projection contacting the protruding ring 234 may be formed in the container cap 20.

Figure 25:
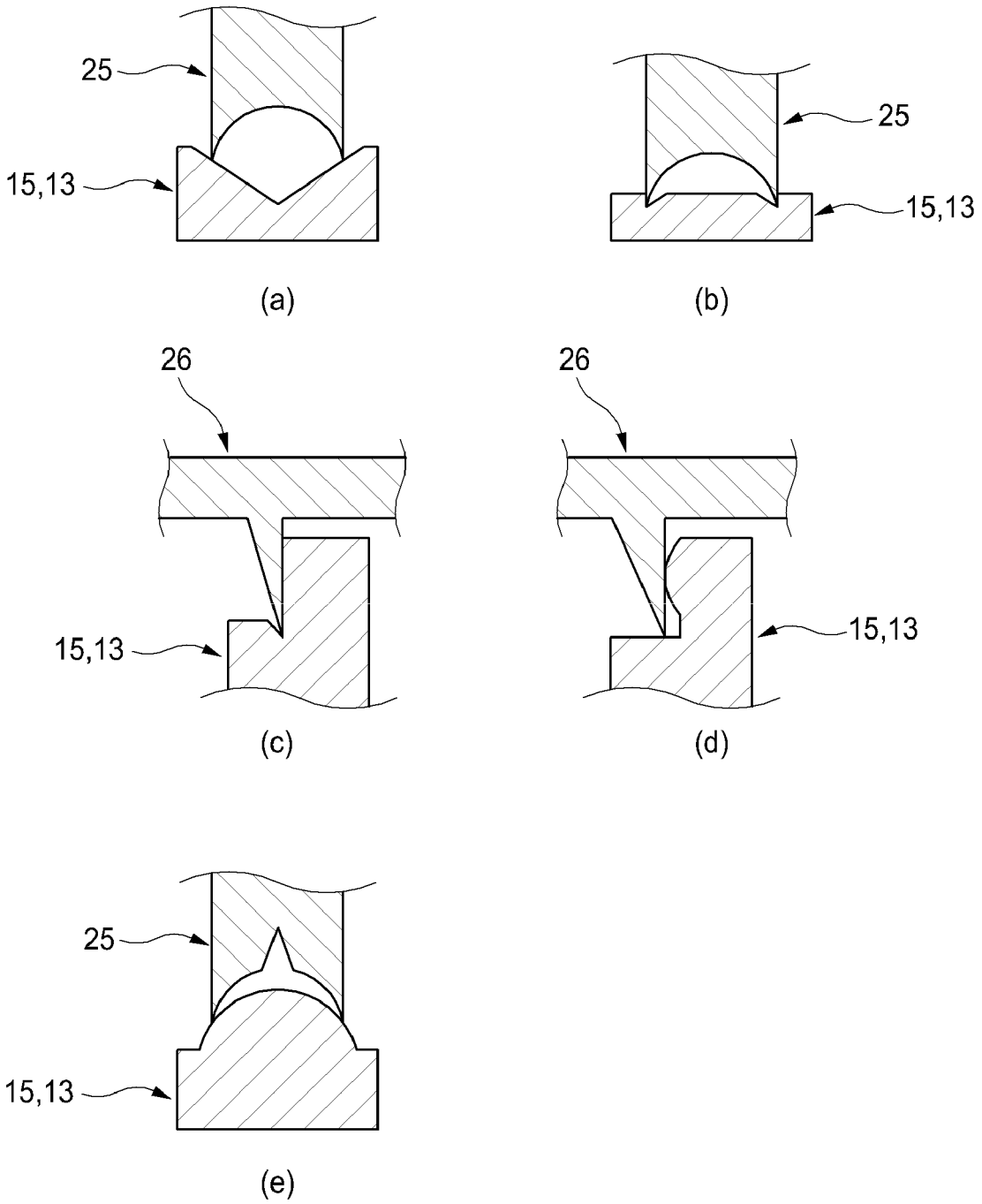
FIG. 25 shows cross-sectional views illustrating examples of contact structures between the container cap and the container inlet in the container according to the present invention.

FIG. 25 shows cross-sectional views illustrating examples of various structures such as projection-projection contact or projection-recessed groove contact when the container cap contacts the container inlet.

The structures in FIG. 25 illustrate examples capable of realizing a blocking function as a flexible portion and a flexible portion or a hard portion and a flexible portion contact each other.

Figure 26A:
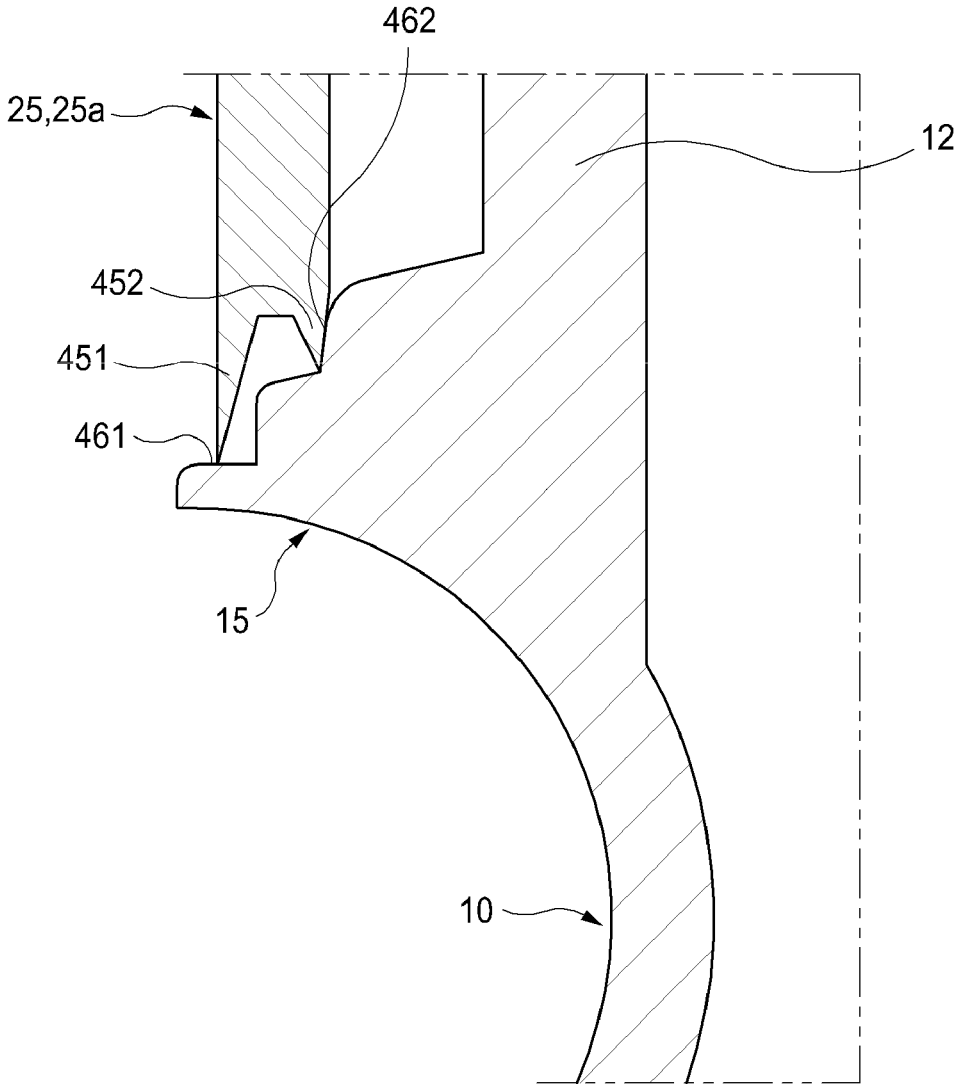
FIGS. 26A and 26B are partial cross-sectional views illustrating structures of at least one projection ring formed on a lower end of a sidewall part of the container cap and the container inlet contacting the same in the container according to the present invention.
Figure 26B:
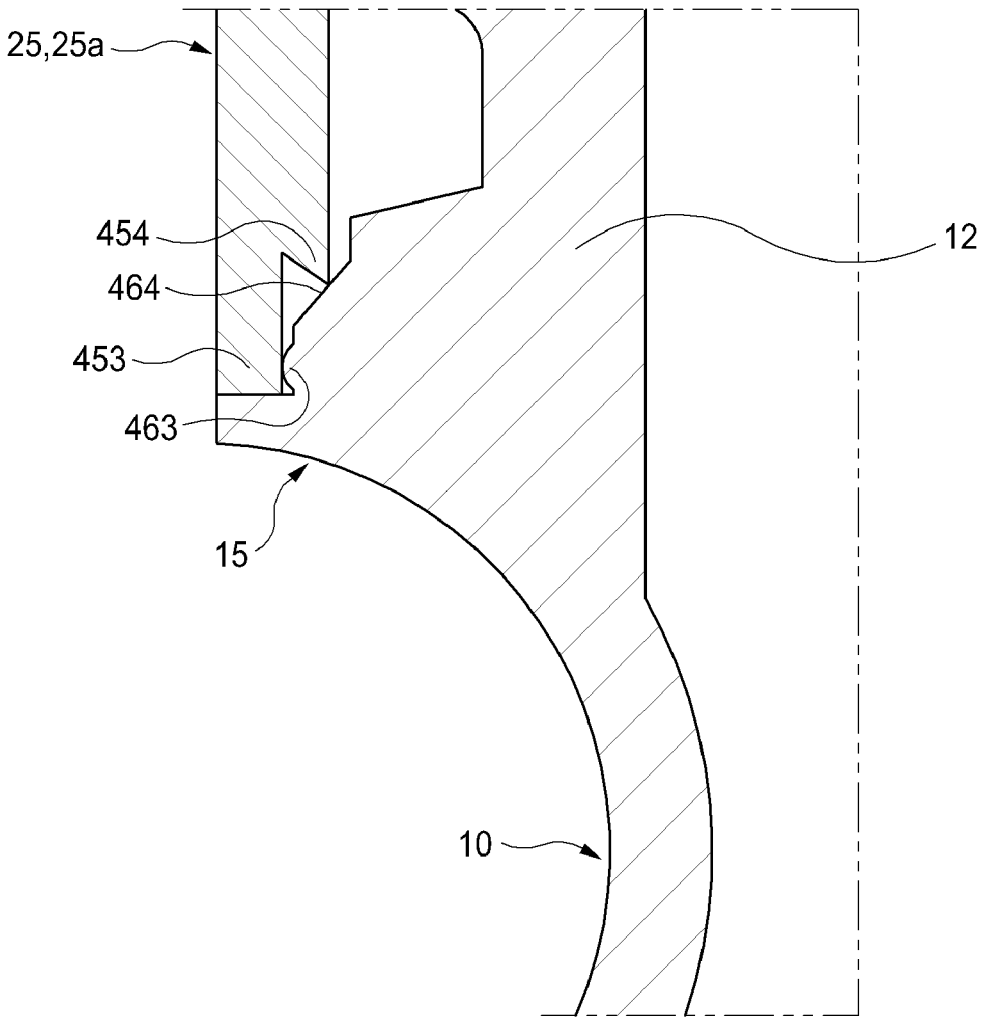

FIGS. 26A and 26B are partial cross-sectional views illustrating structures of at least one projection ring 451, 452, 453, and 454 formed on the lower end of the sidewall part of the container cap and the container inlet contacting the same in the container according to the present invention.

At least one projection ring 451, 452, 453, and 454 is formed on the lower end of the sidewall part 25 or the auxiliary sidewall part 25*a* and contact a contact portion 461, 462, 463, and 464 formed on the container inlet 12.

Here, the contact portion 461, 462, 463, and 464 includes an inclined surface or a projection, as a portion contacting the projection ring 451, 452, 453, and 454 when the container cap 20 is combined with the container inlet 12.

Although the above description merely corresponds to some exemplary embodiments that may be implemented by the present disclosure, as well known, the scope of the present disclosure should not be interpreted as being limited to the above-described embodiments, and all technical spirits having the same basis as that of the above-described technical spirit of the present disclosure are included in the scope of the present disclosure.

The invention claimed is:

1. A container assembly comprising:

a container body containing contents and having a container inlet; and a container cap combined with the container inlet, wherein a plurality of contact portions are formed on at least one of the container cap and the container inlet, and the plurality of contact portions form a closed curve enclosing the container inlet so as to block inflow of external air from outside into the container body, wherein the container cap comprises:

a body part in close contact with an upper end of the container inlet;

a sidewall part which extends downward from the body part and in which a female screw part that is screw-coupled with a male screw part formed on an outer circumferential surface of the container inlet is formed; and an inner ring protruding from a bottom surface of the body part and inserted into an inner circumferential surface of the container inlet, and wherein the container inlet includes an inner upper end and an outer upper end, each having a curved outer circumferential surface, a recessed groove being formed between the inner upper end and the outer upper end, wherein an inclined surface is formed on the container cap, the inclined surface including a first inclined surface and a second inclined surface, the first inclined surface being in contact with the curved outer circumferential surface of the inner upper end and the second inclined surface being in contact with the curved outer circumferential surface of the outer upper end when the container cap is combined with the container inlet, wherein an inner circumferential protruding part is formed on the inner circumferential surface of the container inlet, and the inner circumferential protruding part protrudes toward the inner ring to contact an outer circumferential surface of the inner ring when the container cap is combined with the container inlet, wherein the inner circumferential protruding part has a curved shape so that a cross-section in the longitudinal direction of the container inlet is in surface-contact with the outer circumferential surface of the inner ring, wherein a middle ring is formed on a bottom surface of the body part of the container cap, the middle ring being inserted into the recessed groove formed between the inner upper end and the outer upper end, the middle ring forming at least one close contact portion with the container inlet when the container cap is combined with the container inlet, a bottom of the middle ring being positioned above and spaced apart from a surface defining a bottom of the recessed groove, creating a gap therebetween, and wherein each of the inner upper end and the outer upper end has a structure inclined at a portion in which the recessed groove is formed and having elasticity.

2. The container assembly of claim 1, wherein the inner upper end of the container inlet is lower than the outer upper end of the container inlet based on the recessed groove in the upper end of the container inlet.

* * * * *